US009314908B2

(12) United States Patent
Tanimoto et al.

(10) Patent No.: US 9,314,908 B2
(45) Date of Patent: Apr. 19, 2016

(54) IMPACT TOOL

(75) Inventors: Hideyuki Tanimoto, Ibaraki (JP); Nobuhiro Takano, Ibaraki (JP); Tomomasa Nishikawa, Ibaraki (JP); Kazutaka Iwata, Ibaraki (JP); Hironori Mashiko, Ibaraki (JP); Hayato Yamaguchi, Ibaraki (JP); Atsushi Nakagawa, Ibaraki (JP); Katsuhiro Oomori, Ibaraki (JP); Mizuho Nakamura, Ibaraki (JP); Hiroki Uchida, Ibaraki (JP); Saroma Nakano, Ibaraki (JP); Yutaka Ito, Ibaraki (JP)

(73) Assignee: HITACHI KOKI CO., LTD., Tokyo (JP)

( * ) Notice: Subject to any disclaimer, the term of this patent is extended or adjusted under 35 U.S.C. 154(b) by 1091 days.

(21) Appl. No.: 13/387,741

(22) PCT Filed: Jul. 29, 2010

(86) PCT No.: PCT/JP2010/063235

§ 371 (c)(1),
(2), (4) Date: Jul. 23, 2012

(87) PCT Pub. No.: WO2011/013853

PCT Pub. Date: Feb. 3, 2011

(65) Prior Publication Data

US 2012/0279736 A1 Nov. 8, 2012

(30) Foreign Application Priority Data

Jul. 29, 2009 (JP) ..... 2009-177116
Mar. 31, 2010 (JP) ..... 2010-083755
Mar. 31, 2010 (JP) ..... 2010-083757

(51) Int. Cl.
*B25B 21/00* (2006.01)
*B25B 21/02* (2006.01)

(Continued)

(52) U.S. Cl.
CPC ..... *B25B 21/02* (2013.01); *B25B 21/026* (2013.01); *B25B 23/1475* (2013.01)

(58) Field of Classification Search
CPC .... B25B 21/00; B25B 21/02; B25B 23/1475; B25B 23/1405; B25D 16/006; B25D 11/00
USPC ..... 173/2, 93.5, 10, 176, 20–21, 117, 110; 318/432–434; 310/50
See application file for complete search history.

(56) References Cited

U.S. PATENT DOCUMENTS 8,084,901 B2 12/2011 Oomori et al.
2004/0050566 A1 3/2004 Totsu (Continued)

FOREIGN PATENT DOCUMENTS

EP 1595651 A1 12/2005
EP 1695794 A2 2/2006

(Continued)

OTHER PUBLICATIONS

Notification of Reasons for Refusal from Japanese Patent App. No. 2010-083749 (Oct. 17, 2013) with English language translation thereof.

(Continued)

*Primary Examiner* — Michelle Lopez
(74) *Attorney, Agent, or Firm* — Kenealy Vaidya LLP

(57) ABSTRACT

According to an aspect of the present invention, there is provided an impact tool including: a motor drivable in an intermittent driving mode; a hammer connected to the motor; an anvil to be struck by the hammer to thereby rotate/strike a tip tool; and a control unit that controls a rotation of the motor by switching a driving pulse supplied to the motor in accordance with a load applied onto the tip tool.

5 Claims, 34 Drawing Sheets

(51) Int. Cl.
*B25D 11/00* (2006.01)
*B25B 23/147* (2006.01)

(56) References Cited

U.S. PATENT DOCUMENTS

| | | | |
|---|---|---|---|
| 2005/0263303 | A1 | 12/2005 | Shimizu et al. |
| 2006/0185869 | A1 | 8/2006 | Arimura |
| 2009/0014192 | A1 | 1/2009 | Ito et al. |

FOREIGN PATENT DOCUMENTS

| | | | |
|---|---|---|---|
| GB | 2441670 | A | 10/2006 |
| JP | 56-89485 | A | 7/1981 |
| JP | 61-100376 | A | 5/1986 |
| JP | 62-74579 | A | 4/1987 |
| JP | 64-071673 | A | 3/1989 |
| JP | 2-83173 | A | 3/1990 |
| JP | 4-75879 | A | 3/1992 |
| JP | 8-141928 | A | 6/1996 |
| JP | 8-192370 | A | 7/1996 |
| JP | 2000-176850 | A | 6/2000 |
| JP | 2003-289694 | A | 10/2003 |
| JP | 2004-322262 | A | 11/2004 |
| JP | 2005-169534 | A | 6/2005 |
| JP | 2005-324263 | A | 11/2005 |
| JP | 2006-166601 | A | 6/2006 |
| JP | 2006-231446 | A | 9/2006 |
| JP | 2006-289535 | A | 10/2006 |
| JP | 2006-315125 | A | 11/2006 |
| JP | 2007-007784 | A | 1/2007 |
| JP | 2007-282308 | A | 10/2007 |
| JP | 2008-55580 | A | 3/2008 |
| JP | 2008-68376 | A | 3/2008 |
| JP | 2008-307664 | A | 12/2008 |
| JP | 2009-56590 | A | 3/2009 |
| JP | 2009-072888 | A | 4/2009 |
| JP | 2009-072889 | A | 4/2009 |
| JP | 2009-078349 | A | 4/2009 |
| JP | 2009-83039 | A | 4/2009 |
| JP | 2009-241222 | A | 10/2009 |
| JP | 2009-285787 | A | 12/2009 |
| JP | 2010-058186 | A | 3/2010 |
| WO | 02/060651 | A1 | 8/2002 |
| WO | WO 2009038230 | A1 * | 3/2009 |

OTHER PUBLICATIONS

Japanese Office Action for the related Japanese Patent Application No. 2010-083752 dated Jul. 9, 2013.
Japanese Office Action for the related Japanese Patent Application No. 2010-083750 dated Jul. 11, 2013.
Japanese Office Action for the related Japanese Patent Application No. 2010-083751 dated Jul. 11, 2013.
Japanese Notification of Information Offer Form for the related Japanese Patent Application No. 2009-177116 dated Aug. 5, 2013.
Japanese Office Action for the related Japanese Patent Application No. 2009-177116 dated Aug. 26, 2013.
Notification of Reasons for Refusal for Japanese Patent App. No. 2010-083753 (Sep. 26, 2013) with English language translation thereof.
Japanese Office Action for the related Japanese Patent Application No. 2010-083755 dated Oct. 9, 2013.
Japanese Office Action for the related Japanese Patent Application No. 2010-083756 dated Oct. 10, 2013.

* cited by examiner (1)

(2)

(3)

(4)

IMPACT TOOL

TECHNICAL FIELD

An aspect of the present invention relates to an impact tool which is driven by a motor and realizes a new striking mechanism.

Another aspect of the present invention relates to a power tool, and particularly, to an electronic pulse driver which outputs a rotational driving force.

Still another aspect of the present invention relates to a power tool, and particularly, to an electronic pulse driver which outputs a rotational driving force.

Still another aspect of the present invention relates to a power tool, and particularly, to an electronic pulse driver which outputs a rotational driving force.

Still another aspect of the present invention relates to a power tool, and particularly, to an electronic pulse driver which outputs a rotational driving force.

Still another aspect of the present invention relates to a power tool, and particularly, to an electronic pulse driver which outputs a rotational driving force.

Still another aspect of the present invention relates to a power tool, and particularly, to an electronic pulse driver which outputs a rotational driving force.

Still another aspect of the present invention relates to a power tool, and particularly, to an electronic pulse driver which outputs a driving force.

Still another aspect of the present invention relates to a power tool, and particularly, to an electronic pulse driver which outputs a rotational driving force.

Still another aspect of the present invention relates to a power tool, and particularly, to an electronic pulse driver which outputs a rotational driving force.

BACKGROUND ART

In an impact tool, a rotation striking mechanism is driven by a motor as a driving source to provide rotation and striking to an anvil, thereby intermittently transmitting rotation striking power to a tip tool for performing operation, such as screwing. As a motor, a brushless DC motor is widely used. The brushless DC motor is, for example, a DC (direct current) motor with no brush (brush for commutation). Coils (windings) are used on the stator side, magnets (permanent magnets) are used on the rotor side, and a rotor is rotated as the electric power driven by an inverter circuit is sequentially applied to predetermined coils. The inverter circuit is constructed using an FET (field effect transistor), and a high-capacity output transistor such as an IGBT (insulated gate bipolar transistor), and is driven by a large current. The brushless DC motor has excellent torque characteristics as compared with a DC motor with a brush, and is able to fasten a screw, a bolt, etc. to a base member with a stronger force.

JP-2009-072888-A discloses an impact tool using the brushless DC motor. In JP-2009-072888-A, the impact tool has a continuous rotation type impact mechanism. When torque is given to a spindle via a power transmission mechanism (speed-reduction mechanism), a hammer which movably engages in the direction of a rotary shaft of the spindle rotates, and an anvil which abuts on the hammer is rotated. The hammer and the anvil have two hammer convex portions (striking portions) which are respectively arranged symmetrically to each other at two places on a rotation plane, these convex portions are at positions where the gears mesh with each other in a rotation direction, and rotation striking power is transmitted by meshing between the convex portions. The hammer is made axially slidable with respect to the spindle in a ring region surrounding the spindle, and an inner peripheral surface of the hammer includes an inverted V-shaped (substantially triangular) cam groove. A V-shaped cam groove is axially provided in an outer peripheral surface of the spindle, and the hammer rotates via balls (steel balls) inserted between the cam groove and the inner peripheral cam groove of the hammer.

In the conventional power transmission mechanism, the spindle and the hammer are held via the balls arranged in the cam groove, and the hammer is constructed so as to be able to retreat axially rearward with respect to the spindle by the spring arranged at the rear end thereof. As a result, the number of parts of the spindle and the hammer increases, high attaching accuracy between the spindle and the hammer is required, thereby increasing the manufacturing cost.

Meanwhile, in the impact tool of the conventional technique, in order to perform a control so as not to operate the impact mechanism (that is, in order that striking does not occur), for example, a mechanism for controlling a retreat operation of the hammer is required. The impact tool of JP-2009-072888-A cannot be used in a so-called drill mode. Further, even if a drill mode is realized (even if a retreat operation of the hammer is controlled), in order to realize even the clutch operation of interrupting power transmission when a given fastening torque is achieved, it is necessary to provide a clutch mechanism separately, and realizing the drill mode and the drill mode with a clutch in the impact tool leads to cost increase.

Further, in JP-2009-072888-A, the driving electric power to be supplied to the motor is constant irrespective of the load state of a tip tool during the striking by the hammer. Accordingly, striking is performed with a high fastening torque even in the state of light load. As a result, excessive electric power is supplied to the motor, and useless power consumption occurs. And, a so-called coming-out phenomenon occurs where a screw advances excessively during screwing as striking is performed with a high fastening torque, and the tip tool is separated from a screw head.

A conventional power tool mainly has a motor, a hammer rotationally driven by the motor, and an anvil to which torque is imparted through collision with the hammer (for example, refer to JP-2008-307664-A). As the torque transmitted to the anvil is imparted to a tip tool, the fastening work of a screw or the like is performed. In the power tool, as an engaging projection provided on the hammer and an engaged projection provided on the anvil collide with each other, torque is imparted to the anvil, and the torque is transmitted to the tip tool.

However, in a conventional power tool, the engaging projection collides in a state where the speed has been increased by the motor. For this reason, a problem occurs in that the impact of the collision between the engaging projection and the engaged projection becomes large, and fastening torque increases. Particularly when the increased fastening of fastening a screw or the like which has been fastened again is performed, since the fastening torque is already imparted to the screw, the torque may become excessively large due to the impact of the collision between the engaging projection and the engaged projection. Thus, the object of the invention is to provide a power tool capable of preventing torque exceeding a target torque from being supplied to a fastener.

In conventional power tools, there is a power tool in which it is determined that a predetermined torque has been obtained when a predetermined current value is reached, and supply of electric power to a motor is automatically stopped. Although such products have been sold, the stopping of the supply of electric power to the motor occurs, for example, when a power cord has been pulled in a case where the power cord is used, or when the remaining battery level of the charging battery has been reduced in a case where the charging battery is used, other than when the predetermined torques are reached. For this reason, when a predetermined torque is reached, it is necessary to make the event easily understood by a worker.

However, in the conventional power tool, the operation continues unless the worker takes his/her finger off the trigger. Therefore, useless power consumption occurs, and the temperature of the motor also rises. Especially when compared with normal operation (the motor rotates continuously in one direction), the normal rotation and stop of the motor are repeated in a ratcheting operation mode. Therefore, the power consumption and the temperature rise of the battery are conspicuous. Thus, an object of the invention is to provide a power tool capable of, when a predetermined torque is reached, making the event easily understood. Another object of the invention is to provide a power tool capable of making it hard to uselessly consume electric power and obtaining high-precision torque, when making the event easily understood.

A worker is able to make a screw or the like and a tip tool of a power tool fit each other, and to depress a trigger, thereby performing fastening work of a fastener. When a worker fastens a bolt to a member to be worked in which a lead is formed, since resistance is small, a current value shifts to a low value, and at a moment when a bolt is seated, the current value abruptly rises and exceeds a threshold value at once.

In such a case, even if the motor is stopped by turning OFF the trigger, a stop operation is delayed due to the inertia of the motor, and the bolt is fastened with a value which is equal to or more than a desired torque value. Thus, the object of the invention is to provide a power tool capable of supplying a precise target torque.

In a conventional power tool, a structure in which an anvil is struck in a given direction by a hammer which rotates in the given direction is known (for example, refer to JP-2008-307664-A).

However, in the conventional power tool, when a trigger is depressed in a state where the fitting between a screw and a tip tool is in an imperfect state at the time of start-up, the fitting between the screw and the tip tool may be released (coming-out), and the head of the screw may be damaged. Thus, the object of the invention is to provide a power tool capable of preventing the coming-out of a tip tool from a fastener.

In a conventional power tool, a motor is controlled regardless of the temperature of a built-in object of the housing (for example, refer to JP-2010-058186-A).

In the conventional power tool, the motor is driven without taking generation of heat of the built-in object of the housing into consideration. For this reason, for example, if the ambient temperature is low, there is a case where the viscosity of grease of a gear mechanism changes, the grease hardens, and the current value of the motor rises. For this reason, it is necessary to alter the electric power to be supplied to the motor depending on whether the ambient temperature is low, or the ambient temperature is high.

Additionally, if the ambient temperature is high, switching elements for supplying electric power to coils of the motor may be damaged as the switching elements generate heat. For this reason, it is necessary to prevent the temperature of the switching elements from becoming too high. The object of the invention is to provide a power tool adapted to change the control method of a motor according to the temperature of a built-in object of the housing.

In a conventional power tool, a structure in which an anvil is struck in a given direction by a hammer which rotates in the given direction is known (for example, refer to JP-2008-307664-A).

Meanwhile, the applicant of the invention has newly developed an electronic pulse driver constructed to normally rotate and reversely rotate the hammer, thereby striking the anvil. However, in the newly developed electronic pulse driver, the fitting between a screw or the like and a tip tool may be released (come-out), and the head of the screw may be damaged. Moreover, a force in the direction reverse to the rotational direction is generated in the power tool by the reaction caused by the operation after seating, and the worker experiences discomport. Thus, the object of the invention is to provide a power tool capable of reducing the reaction force from a member to be worked.

A conventional power tool is adapted to rotate a fastener by an output shaft. The control of a motor is the same even when a plurality of fasteners is used (for example, refer to JP-2008-307664-A).

However, in the conventional power tool, it is difficult to perform fastening according to the fasteners used. Particularly when the fastening work of a wood screw is performed, the wood screw needs to perform fastening even after seating, and a control which gives a high torque to a tip tool is required. Moreover, when the fastening work of a bolt is performed, further fastening cannot be performed after seating. Therefore, when the normal rotation time of pulses is long, a force reverse to a rotational direction is generated in an impact driver by the reaction of the bolt, and the worker experiences discomfort. Then, the object of the invention is to provide a power tool capable of discriminating a fastener. By such a power tool, the control of a motor can be varied in a case where fasteners are different.

In an electric impact driver which is an example of a conventional power tool, a motor is rotated in a given rotational direction to rotate a hammer in the given direction and to rotate an anvil in a given direction (for example, refer to JP-2008-307664-A).

In the conventional power tool, the motor is controlled regardless of the temperature of a built-in object of the housing. Additionally, as an embodiment of the invention, in a power tool which normally rotates or reversely rotates the motor, generation of heat by the motor increases. As such, in the power tool in which generation of heat of the motor becomes large, the temperature of the motor may rise excessively in a case where the motor is controlled regardless of the temperature of the motor. The object of the invention is to provide a power tool capable of controlling a motor according to the temperature of a built-in object of the housing. By such a power tool, the temperature of the built-in object of the housing rarely rises excessively.

In a conventional power tool, a structure in which an anvil is struck in a given direction by a hammer which rotates in the given direction is known (for example, refer to JP-2008-307664-A).

Meanwhile, the applicant of the invention has newly developed an electronic pulse driver constructed to normally rotate and reversely rotate the hammer, thereby striking the anvil. However, in the newly developed electronic pulse driver, if the normal rotation time is long during high-load work, the reaction of the impact driver also increases, and the worker experiences increasing discomfort. Thus, the object of the invention is to provide a power tool which is comfortable to use.

SUMMARY OF INVENTION

One object of the invention is to provide an impact tool in which an impact mechanism is realized by a hammer and an anvil with a simple mechanism.

Another object of the invention is to provide an impact tool which can drive a hammer and an anvil between which the relative rotation angle is less than 360 degrees, thereby performing a fastening operation, by devising a driving method of a motor.

According to Point 1 of the present invention, there is provided an impact tool including: a motor drivable in an intermittent driving mode; a hammer connected to the motor; an anvil to be struck by the hammer to thereby rotate/strike a tip tool; and a control unit that controls a rotation of the motor by switching a driving pulse supplied to the motor in accordance with a load applied onto the tip tool.

According to Point 2 of the present invention, there may be provided the impact tool, wherein the control unit switches the driving pulse based on a rotation number of the motor.

According to Point 3 of the present invention, there may be provided the impact tool, wherein the control unit switches the driving pulse based on a change in a driving current flowing into the motor.

According to Point 4 of the present invention, there may be provided the impact tool, wherein the control unit changes an output time of the driving pulse in accordance with the load on the tip tool.

According to Point 5 of the present invention, there may be provided the impact tool, wherein the control unit changes an effective value of the driving pulse in accordance with the load on the tip tool.

According to Point 6 of the present invention, there may be provided the impact tool, wherein the control unit changes a maximum value of the driving pulse in accordance with the load on the tip tool.

According to Point 7 of the present invention, there may be provided the impact tool, wherein the intermittent driving mode includes: a first intermittent driving mode in which the motor is driven only in a normal rotation; and a second intermittent driving mode in which the motor is driven in the normal rotation and in a reverse rotation.

According to Point 8 of the present invention, there may be provided the impact tool, wherein the control unit supplies a driving pulse to the motor so that a section where a driving current is supplied to the motor and a section where the driving current is not supplied to the motor appear alternately.

According to Point 1, since the motor is driven in an intermittent driving mode, and the control unit switches a driving pulse supplied to the motor according to the load state applied to the tip tool, it is possible to prevent useless electric power from being consumed when the load applied to the tip tool is light. Further, it is possible to prevent a so-called coming-out phenomenon where the tip tool is separated from the head of a screw or the like, by being driven with large electric power during light load.

According to Point 2, since the control unit switches the driving pulse based on the rotation number of the motor, switching control of the driving pulse can be performed by using a rotation number detection sensor which has conventionally been loaded. And, it is possible to realize the simplification and/or cost reduction for configuring the control unit.

According to Point 3, since the control unit switches the driving pulse based on a change in a driving current which flows into the motor, switching control of the driving pulse can be performed by using a current sensor which has conventionally been loaded. And, it is possible to realize the simplification and/or cost reduction for configuring the control unit.

According to Point 4, since the control unit changes the output time of the driving pulse according to the load state of the tip tool, striking torque can be adjusted while suppressing a peak current to be supplied to the motor. Therefore, there is no need for enlarging the switching element used for the inverter circuit.

According to Point 5, since the control unit changes the output time of the driving pulse according to the load state of the tip tool, the switching element in the inverter circuit can be protected from an excess current.

According to Point 6, since the control unit changes the maximum value of the driving pulse according to the load state of the tip tool, consumption of the useless electric power when the load applied to the tip tool is light can be prevented.

According to Point 7, since two different intermittent driving modes include an intermittent driving mode of only the normal rotation and an intermittent driving mode of the normal rotation and the reverse rotation, fastening can be performed at high speed with a lower fastening torque in the intermittent driving mode of only normal rotation, and fastening can be reliably performed with a higher fastening torque in the intermittent driving mode of normal rotation and reverse rotation.

According to Point 8, since the control unit supplies a driving pulse to the motor so that a section where a driving current is supplied to the motor, and a section where a driving current is not supplied to the motor appear alternately, the conventional inverter circuit can be used to realize the intermittent driving mode.

In order to achieve the above object, the invention provides an electronic pulse driver including a rotatable motor; a hammer rotated by a driving force being supplied thereto from the motor; an anvil provided separately from the hammer and rotated by the hammer integrally therewith; a tip tool holding portion capable of holding a tip tool and transmitting the rotation of the anvil to the tip tool; an electric power supply unit which supplies the driving electric power to the motor; and a control unit which controls the electric power supply unit so as to stop the supply of the driving electric power to the motor in a case where an electric current which flows into the motor in a state where the driving electric power is supplied has increased to a predetermined value. The control unit controls the electric power supply unit so as to supply electric power for soft starting which is smaller than the driving electric power to the motor before the driving electric power is supplied, in order to make the electric power supply unit supply the driving electric power in a state where the hammer and the anvil are brought into contact with each other.

According to such a construction, the hammer and the anvil are brought into contact with each other by supplying electric power for soft starting to the motor before the driving electric power is supplied. Thus, it is possible to prevent torque exceeding a target torque from being supplied to a fastener by striking.

Additionally, the invention provides a power tool including a motor serving as a power source; a hammer connected to and rotated by the motor; and an anvil rotatable with respect to the hammer, and capable of supplying first power which integrally rotates the hammer and the anvil, and second power smaller than the first power, to the hammer from the motor. The second power is supplied to the hammer at the beginning of the starting of the motor, and the first power is supplied to the hammer after the supply of the second power.

According to such a construction, as power for pre-start is applied to the hammer, the hammer and the anvil are prevented from colliding with each other to generate a large impact. For this reason, a large torque is prevented from being generated due to the impact between the hammer and the anvil. For this reason, the tip tool rarely fastens a fastener with a greater torque than a targeted torque.

Additionally, the invention provides a power tool including an electric motor; a hammer connected to the electric motor; and an anvil rotatable with respect to the hammer, and capable of supplying first electric power, and second electric power smaller than the first electric power, to the electric motor. The second electric power is supplied to the electric motor at the beginning of the starting of the motor, and the first electric power is supplied to the electric motor after the supply of the second electric power.

By such a construction, as a normal rotation voltage for pre-start is applied to the motor, the hammer and the anvil are prevented from colliding with each other to generate a large impact. For this reason, a large torque is prevented from being generated due to the impact between the hammer and the anvil. For this reason, the tip tool rarely fastens a fastener with a greater torque than a targeted torque.

Preferably, the hammer is capable of striking the anvil.

Preferably, the supply of the electric power to the motor is stopped by detecting that predetermined electric power has been supplied to the motor.

Since the supply of the electric power to the motor is automatically stopped by such a construction, the fastening torque of a fastener can be made highly precise. For this reason, the fastening high-precision torque can be obtained by an effect which is synergetic with pre-start.

Preferably, the time during which the second electric power is supplied is longer than the time until the anvil and the hammer come into contact with each other.

By using such a construction to make the pre-start time longer than the time until the hammer and the anvil come into contact with each other, the hammer and the anvil come into contact with each other within the pre-start time. For this reason, the hammer is prevented from striking the anvil to generate a large impact. For this reason, generation of a large impact when the collision between the anvil and the hammer occurs can be reduced. If the pre-start time is shorter than the time until the hammer and the anvil come into contact with each other, the hammer accelerates, and strikes the anvil, and a large impact is transmitted to the anvil from the hammer.

Preferably, the power tool further includes a trigger capable of energizing the motor, and capable of changing the amount of electric power to be supplied to the motor, and the second electric power is smaller than a predetermined value irrespective of the pulling amount of the trigger.

Preferably, the amount of electric power to be supplied to the motor is capable of being changed by changing the duty ratio of a PWM signal.

Preferably, the second electric power is smaller than a predetermined value during a predetermined time.

According to the power tool of the invention, it is possible to provide a power tool capable of preventing torque exceeding a target torque from being supplied to a fastener.

In order to achieve the above object, the invention provides an electronic pulse driver including a motor capable of normally rotating and reversely rotating; a hammer rotated in a normal rotation direction or a reverse rotation direction by a driving force being supplied thereto from the motor; an anvil provided separately from the hammer and rotated by the hammer integrally therewith in the normal rotation direction; a tip tool holding portion capable of holding a tip tool and transmitting the rotation of the anvil to the tip tool; an electric power supply unit which supplies the motor with normal rotation electric power for rotation, normal rotation electric power for a clutch smaller than the normal rotation electric power for rotation, or reverse rotation electric power for a clutch having a smaller absolute value than the normal rotation electric power for rotation; and a control unit which controls the electric power supply unit so as to alternately switch the normal rotation electric power for a clutch and the reverse rotation electric power for a clutch to generate a pseudo-clutch in a case where an electric current which flows into the motor in a state where the normal rotation electric power for rotation is supplied has increased to a predetermined value, and stop the pseudo-clutch after the elapse of a predetermined time from the generation of the pseudo-clutch.

According to such a construction, since the pseudo-clutch is stopped after the elapse of a predetermined time from the generation thereof, it is possible to suppress power consumption and a temperature rise.

Additionally, the invention provides a power tool including a motor; and an output shaft rotated by the motor. If the electric power to be supplied to the motor for rotating the output shaft in the normal rotation direction has become a first electric power value, a second electric power value smaller than the first electric power value is capable of being intermittently supplied to the motor.

By such a construction, the second electric power is smaller than the first electric power. Thus, fastening/loosening of a fastener hardly occurs while the second electric power is added. For this reason, high-precision torque can be obtained.

Preferably, the supply of the second electric power value to the motor is automatically stopped after a predetermined time.

By such a construction, since the motor automatically stops, electric power can be prevented from being excessively used.

Preferably, the motor is rotatable in the normal rotation direction and the reverse rotation direction by the supply of the second electric power value to the motor.

By such a construction, as the motor rotates in the normal rotation direction and the reverse rotation direction, a fastener hardly fastens or loosens. For this reason, high-precision torque can be obtained. If the second electric power value is only in the normal rotation, fastening is apt to occur.

According to the power tool of the invention, it is possible to provide a power tool capable of, when a predetermined torque is reached, making the event easily understood. Additionally, it is possible to provide a power tool capable of making it hard to consume electric power uselessly and obtaining high-precision torque, when making the event easily understood.

In order to achieve the above object, the invention provides an electronic pulse driver including a motor capable of normally rotating and reversely rotating; a hammer rotated in a normal rotation direction or a reverse rotation direction by a driving force being supplied thereto from the motor; an anvil provided separately from the hammer and rotated by the hammer integrally therewith in the normal rotation direction; a tip tool holding portion capable of holding a tip tool and transmitting the rotation of the anvil to the tip tool; an electric power supply unit which supplies the motor with normal rotation electric power or reverse rotation electric power; and a control unit which controls the electric power supply unit so as to supply the reverse rotation electric power to the motor if the increasing rate of an electric current when the electric current which flows into the motor in a state where the normal rotation electric power has increased to a predetermined value is supplied is equal to or more than a predetermined value.

According to such a construction, the reverse rotation electric power is supplied to the motor when the electric current which flows into the motor has increased to a predetermined value. Thus, even if a fastener such as a bolt in which torque abruptly increases just before a target torque is fastened, it is possible to prevent the torque caused by an inertial force from being supplied, and it is possible to supply an accurate target torque.

Additionally, the invention provides a power tool including a motor; and an output shaft rotated by the motor. If a normal rotation current to the motor for rotating the output shaft in one direction is equal to or more than a predetermined value, a reverse rotation current for rotating the output shaft in a direction reverse to the one direction is supplied to the motor.

According to such a construction, since the reverse rotation current is supplied if the normal rotation current has a predetermined value, a fastener can be kept from being excessively fastened due to the inertia of the normal rotation current. For this reason, an accurate screw fastening torque can be obtained.

Additionally, the invention provides a power tool including a motor; and an output shaft rotated by the motor. If the increasing rate of a normal rotation current per unit time to the motor for rotating the output shaft in one direction is equal to or more than a predetermined value, a reverse rotation current for rotating the output shaft in a direction reverse to the one direction is supplied to the motor.

By such a construction, since the reverse rotation current is supplied if the increasing rate of the normal rotation current has a predetermined value, a fastener can be kept from being excessively fastened due to the inertia of the normal rotation current. For this reason, an accurate screw fastening torque can be obtained.

According to the power tool of the invention, it is possible to provide a power tool capable of supplying a precise target torque.

In order to achieve the above object, the invention provides an electronic pulse driver including a motor capable of normally rotating and reversely rotating; a hammer rotated in a normal rotation direction or a reverse rotation direction by a driving force being supplied thereto from the motor; an anvil provided separately from the hammer and rotated by torque being supplied thereto by the rotation of the hammer in the normal rotation direction; a tip tool holding portion capable of holding a tip tool and transmitting the rotation of the anvil to the tip tool; an electric power supply unit which supplies the motor with normal rotation electric power for rotation or reverse rotation electric power for fitting; and a control unit which controls the electric power supply unit so as to supply the reverse rotation electric power for fitting to the motor so that the hammer rotates in the reverse rotation direction to strike the anvil before the normal rotation electric power for rotation is supplied.

According to such a construction, the hammer is reversely rotated and struck on the anvil by supplying the reverse rotation electric power for fitting to the motor before the supply of the normal rotation electric power for rotation. Thus, even if the fitting between a fastener and a tip tool is insufficient, the fastener and the tip tool can be made to fit to each other firmly, and it is possible to prevent the tip tool from coming out of the fastener during operation.

Additionally, the invention provides a power tool including a motor, a hammer rotated by the motor, and an anvil struck by the hammer. The anvil is rotated in the reverse rotation direction before the hammer strikes the anvil in the normal rotation direction.

By such a construction, since the anvil rotates in the reverse rotation direction, the fitting between the anvil and a fastener can be made firm. For this reason, the fastener is rarely damaged by the anvil. For this reason, the durability of the fastener can be enhanced.

Additionally, the invention provides a power tool including a motor, a hammer rotated by the motor, and an anvil struck by the hammer. The hammer and the anvil come into contact with each other in the reverse rotation direction before the hammer strikes the anvil in the normal rotation direction.

By such a construction, since the anvil is struck and rotates in the reverse rotation direction, the fitting between the anvil and a fastener can be made firm. For this reason, the fastener is rarely damaged by the anvil. For this reason, the durability of the fastener can be enhanced.

Preferably, in the invention, the tip tool is held by the anvil.

Additionally, the invention provides a power tool including a motor, and a tip tool holding portion rotated by the motor. The tip tool holding portion is constructed so as to reversely rotate before the tip tool holding portion rotates in the normal rotation direction.

According to the power tool of the invention, it is possible to provide a power tool capable of preventing the coming-out of a tip tool from a fastener.

In order to achieve the above object, the invention provides an electronic pulse driver including a rotatable motor; switching elements for powering the motor; a gear mechanism connected to the motor to change the rotational speed of the motor; a hammer rotated by a driving force being supplied thereto via the gear mechanism from the motor; an anvil provided separately from the hammer and rotated by torque being supplied thereto by the rotation of the hammer; a tip tool holding portion capable of holding a tip tool and transmitting the rotation of the anvil to the tip tool; an electric power supply unit which supplies the driving electric power to the motor; a control unit which controls the electric power supply unit so as to change the magnitude of the driving electric power in a case where the electric current which flows into the motor in a state where the driving electric power is supplied has increased to a predetermined threshold value; a temperature detection unit which detects the temperature of the switching elements; and a threshold value changing portion which changes the threshold value based on the temperature of the switching elements.

According to such a construction, by changing the threshold value in consideration of a change in temperature, it is possible to change the mode of striking in a suitable situation.

Additionally, the invention provides a power tool including a motor, an output unit driven by the motor, and a housing which houses the motor. A temperature detection unit capable of detecting the temperature of a built-in object of the housing is provided, and a control method of the motor is capable of being changed according to the output value of the temperature detection unit.

By such a construction, it is possible to keep the built-in object of the housing from excessively generating heat. For this reason, the built-in object is rarely damaged by heat.

Additionally, the invention provides a power tool including a motor unit, an output unit driven by the motor, and a housing which houses the motor. A temperature detection unit capable of detecting the temperature of the motor unit is provided, and a control method of the motor unit is capable of being changed according to the output value of the temperature detection unit.

By such a construction, it is possible to keep the motor unit from excessively generating heat. For this reason, the motor unit can be rarely damaged by heat.

Preferably, the motor unit has a circuit board, and switching elements and temperature detecting elements are provided on the circuit board.

By such a construction, by detecting the temperature of the switching elements, which are apt to be especially influenced by the generation of heat, via the circuit board, it is possible to perform a control so as to prevent the generation of heat of the switching elements. For this reason, the switching elements are hardly damaged.

According to the invention, it is possible to provide a power tool adapted to change the control method of the motor according to the temperature of a built-in object of the housing.

In order to achieve the above object, the invention provides an electronic pulse driver including a motor capable of normally rotating and reversely rotating; a hammer rotated in a normal rotation direction or a reverse rotation direction by a driving force being supplied thereto from the motor; an anvil provided separately from the hammer and struck and rotated by the rotation of the hammer, which has gained acceleration distance due to the rotation in the reverse rotation direction, in the normal rotation direction; a tip tool holding portion capable of holding a tip tool and transmitting the rotation of the anvil to the tip tool; an electric power supply unit which switches between normal rotation electric power or reverse rotation electric power in a first cycle so as to be supplied to the motor; and a control unit which controls the electric power supply unit so as to switches between the normal rotation electric power and the reverse rotation electric power in a second cycle shorter than the first cycle if the increasing rate of an electric current when the electric current which flows into the motor in a state where the normal rotation electric power and the reverse rotation electric power are supplied has increased to a predetermined value is equal to or greater than a predetermined value.

According to such a construction, if the increasing rate of an electric current when the electric current which flows into the motor has increased to a predetermined value is equal to or greater than a predetermined value, a wood screw is regarded as seated, and the switching cycle of the normal rotation electric power and the reverse rotation electric power is switched to a short cycle. Thus it is possible to reduce a subsequent reaction force from a member to be worked.

Additionally, the invention provides a power tool including a motor, a hammer rotated by the motor, and an anvil struck by the hammer. If an electric current which flows into the motor is equal to or less than a predetermined value, the hammer strikes the anvil at a first interval, and if the electric current to be supplied to the motor is equal to or greater than a predetermined value, the hammer strikes the anvil at a second interval shorter than the first interval.

By such a construction, if the electric current is equal to or greater than a predetermined value, the torque is also made to be equal to or greater than a predetermined value, and if the torque is equal to or greater than a predetermined value, the striking interval is shortened. For this reason, since striking increases in a shorter time when the torque increases, worker's productivity increases. If the anvil is not struck at the second interval, the reaction force is large. Thus, the rotation of a fastener decreases and the rotating speed of the fastener becomes low. For this reason, worker's productivity will worsen.

Additionally, the invention provides a power tool including a motor, a hammer rotated by the motor, and an anvil struck by the hammer. If the electric current which flows into the motor is equal to or less than a predetermined value, the hammer strikes the anvil at a first interval, and if the electric current to be supplied to the motor is equal to or greater than a predetermined value, the hammer strikes the anvil at a second interval shorter than the first interval.

Additionally, in another aspect of the invention, the invention provides a power tool including a motor, and an output shaft rotationally driven ed by the motor. Seating is detected according to electric current caused in the motor.

According to the power tool of the invention, it is possible to provide a power tool capable of reducing the reaction force from a member to be worked.

In order to achieve the above object, the invention provides, as Point 10 thereof, an electronic pulse driver including a motor capable of normally rotating and reversely rotating; a hammer rotated in a normal rotation direction or a reverse rotation direction by a driving force being supplied thereto from the motor; an anvil provided separately from the hammer and rotated by torque being supplied by the rotation of the hammer in the normal rotation direction; a tip tool holding portion capable of holding a tip tool and transmitting the rotation of the anvil to the tip tool; an electric power supply unit which supplies the motor with normal rotation electric power or reverse rotation electric power; and a control unit which controls the electric power supply unit so as to supply the normal rotation electric power to the motor in order to rotate the anvil integrally with the hammer during a predetermined period, and supply the reverse rotation electric power to the motor when the predetermined period has elapsed, and which controls the electric power supply unit so as to switch between the normal rotation electric power and the reverse rotation electric power in a first switching cycle if the electric current which flows into the motor by the reverse rotation electric power is equal to or greater than a first predetermined value, and switch between the normal rotation electric power and the reverse rotation electric power in a second cycle if the electric current is less than the first predetermined value.

According to such a construction, the switching cycle of the normal rotation electric power and the reverse rotation electric power is changed according to an electric current which flows into the motor by the reverse rotation electric power. For example, if the electric current which flows into the motor is large, the fastener can be determined to be a wood screw, and if the electric current is small, the fastener can be determined to be a bolt. Thereby, the normal rotation electric power and the reverse rotation electric power can be switched between in a cycle suitable for each fastener, and it is possible to perform suitable fastening according to the kind of fasteners.

Additionally, the invention provides, as Point 9 thereof, a power tool including a motor, and an output shaft rotated in a normal rotation direction by the motor. A control method of the motor is automatically changed according to a current value occurring when a signal is imparted so as to reversely rotate the motor.

According to such a construction, since a fastener which is rotated by the output shaft can be determined according to a current value when the output shaft is reversely rotated, only the output of a current has to be detected. For this reason, since other separate detections or the like are not necessary, an inexpensive electric power tool can be obtained.

According to the power tool of the invention, it is possible to provide a power tool capable of discriminating a fastener.

In order to achieve the above object, the invention provides, as Point 11 thereof, an electronic pulse driver including a motor capable of normally rotating and reversely rotating; a hammer rotated in a normal rotation direction or a reverse rotation direction by a driving force being supplied thereto from the motor; an anvil provided separately from the hammer and struck and rotated by the rotation of the hammer, which has gained acceleration distance due to rotation in the reverse rotation direction, in the normal rotation direction; a tip tool holding portion capable of holding a tip tool and transmitting the rotation of the anvil to the tip tool; an electric power supply unit which alternately switches normal rotation electric power or reverse rotation electric power in a first cycle so as to be supplied to the motor; a temperature detection unit which detects the temperature of the motor; and a control unit which controls the electric power supply unit so as to switch between the normal rotation electric power and the reverse rotation electric power in a second cycle longer than the first cycle if the temperature of the motor has risen to a predetermined value.

According to such a construction, the normal rotation electric power and the reverse rotation electric power is switched in a second cycle longer than the first cycle if the temperature of the motor has risen to a predetermined value. Thus, generation of heat caused at the time of the switching can be suppressed, and it is possible to enhance the durability of the whole impact driver.

Additionally, the invention provides a power tool including a motor, an output unit driven by the motor, a housing which houses the motor, and a temperature detection unit capable of detecting the temperature of a built-in object of the housing. A control method of the motor is changed according to the output value from the temperature detection unit.

By such a construction, since the value of electric power supplied to the motor can be changed according to the temperature of the built-in object of the housing. Thus, it is possible to keep the temperature of the built-in object of the housing from becoming too high. For this reason, it is possible to keep the built-in object of the housing from being damaged due to a high temperature.

Additionally, the invention provides a power tool including a motor unit, an output unit driven by the motor, a housing which houses the motor unit, and a temperature detection unit capable of detecting the temperature of the motor unit. The value of electric power supplied to the motor unit is changed according to the output value from the temperature detection unit.

By such a construction, since the value of electric power supplied to the motor can be changed according to the temperature of the motor unit. Thus, it is possible to keep the temperature of the motor unit from becoming too high. For this reason, it is possible to keep the motor unit from being damaged due to a high temperature.

Preferably, a hammer is connected to the motor unit, the anvil is enabled to be struck by the hammer, if the output value from the temperature detection unit is a first value, the hammer strikes the anvil at a first interval, and if the output value from the temperature detection unit is a second value greater than the first value, the hammer strikes the anvil at a second interval longer than the first interval.

By such a construction, if the temperature is high, the load decreases. Thus, if the temperature of the motor unit is high, the temperature of the motor unit can be prevented from rising. For this reason, it is rare that the motor unit is damaged as the temperature of the motor unit rises excessively.

Additionally, in another aspect of the invention, the invention provides a power tool including an intermittently driven motor, an output unit driven by the motor, a housing which houses the motor, and a temperature detection unit capable of detecting the temperature of a built-in object of the housing. A cycle in which the motor is intermittently driven is changed according to the output value from the temperature detection unit.

According to the power tool of the invention, it is possible to provide a power tool capable of controlling a motor according to the temperature of a built-in object of the housing.

In order to achieve the above object, the invention provides, as Point 12 thereof, an electronic pulse driver including a motor capable of normally rotating and reversely rotating; a hammer rotated in a normal rotation direction or a reverse rotation direction by a driving force being supplied thereto from the motor; an anvil struck and rotated by the rotation of the hammer, which has gained acceleration distance due to rotation in the reverse rotation direction, in the normal rotation direction; a tip tool holding portion capable of holding a tip tool and transmitting the rotation of the anvil to the tip tool; an electric power supply unit which alternately switches between normal rotation electric power or reverse rotation electric power so as to be supplied to the motor; and a control unit which controls the electric power supply unit so as to increase the ratio of a period during which the reverse rotation electric power is supplied with respect to a period during which the normal rotation electric power is supplied, with an increase in the electric current which flows into the motor.

According to such a construction, the ratio of the reverse rotation period to the normal rotation period is increased with an increase in the electric current which flows into the motor. Thus, the reaction force from a member to be worked can be suppressed, and it is possible to provide an impact tool which is comfortable to use.

According to Point 13 of the present invention, preferably, the control unit controls the electric power supply unit in a first mode in which the normal rotation period during which the normal rotation electric power is supplied is reduced, in a first step where the electric current which flows into the motor increases to a predetermined value, and controls the electric power supply unit in a second mode in which the reverse rotation period during which the reverse rotation electric power is supplied is increased, in a second step where the electric current which flows into the motor has exceeded the predetermined value.

According to such a construction, if the electric current which flows into the motor is equal to or less than a predetermined value, fastening is performed in the first mode centered on a pressing force, and if the electric current is greater than the predetermined value, fastening is performed in the second mode centered on a striking force. Thus, it is possible to perform fastening in a mode which is most suitable for the fastener.

According to Point 14 of the present invention, preferably, the control unit is capable of selecting one mode from a plurality of second modes with different ratios, in the second step.

According to such a construction, even if the electric current which flows into the motor has abruptly increased, it is possible to perform fastening in a suitable striking mode.

According to Point 15 of the present invention, preferably, the control unit permits only shifting to a second mode with a long reverse rotation period from a second mode with a short reverse rotation period, among a plurality of second modes with different ratios, in the second step.

According to such a construction, it is possible to prevent an abrupt change in feeling.

According to Point 16 of the present invention, preferably, the control unit permits only shifting to a second mode which is adjacent in its length of the reverse rotation period, among a plurality of second modes with different ratios, in the second step.

According to such a construction, it is possible to prevent an abrupt change in feeling.

Additionally, the invention provides, as Point 17 thereof, a power tool including an intermittently driven motor, a hammer driven by the motor, and an anvil struck by the hammer. The time during which the hammer is normally rotated is gradually decreased.

By such a construction, since the time during which the hammer is normally rotated is gradually decreased, the striking interval of the hammer can be decreased in correspondence with the load which gradually increases. For this reason, the reaction force to a worker decreases, and a power tool which hardly slips off the fastener and good productivity can be obtained.

Additionally, the invention provides, as Point 18 thereof, a power tool including an intermittently driven motor, a hammer driven by the motor, and an anvil struck by the hammer. The time during which the hammer is reversely rotated is gradually increased.

By such a construction, since the time during which the hammer is reversely rotated is gradually increased, the amount of reverse rotation of the hammer can be increased in correspondence with the rotational amount of the anvil having decreased in correspondence to the load which gradually increases. For this reason, an acceleration interval of the hammer can be enlarged. For this reason, the anvil can be struck by accelerating the hammer reliably, and the anvil can be efficiently struck. For this reason, a power tool with good productivity can be obtained.

Additionally, the invention provides, as Point 19 thereof, a power tool including an intermittently driven motor; a hammer driven by the motor; an anvil struck by the hammer; and a detecting means capable of detecting the value of the electric current which flows into the motor. A first current value, a second current value greater than the first current value, and a third current value greater than the second current value are capable of flowing to the motor. A control is capable of being performed by a first mode according to the first current value, a second mode according to the second current value, and a third mode according to the third current value. A control is performed in the second mode after the control in the first mode if the detecting means of the motor has detected the first current value, and has detected the third current value immediately after the detection of the first current value.

By such a construction, even if the current value has abruptly changed (for example, even if a change to the third current value from the first current value), a mode is not abruptly changed (a change to the second mode from the first mode is made (an abrupt change to the third mode is not made)). Thus, a worker rarely feels a sense of discomfort by a change in mode. For this reason, a power tool with good workability can be obtained.

Additionally, the invention provides, as Point 20 thereof, a power tool including an intermittently driven motor; a hammer driven by the motor; an anvil struck by the hammer; and a detecting means capable of detecting the value of the electric current which flows into the motor. A first current value, and a second current value greater than the first current value are capable of flowing to the motor. A control is capable of being performed by a first mode according to the first current value, and a second mode according to the second current value. A control is not performed in the first mode after a control is performed in the first mode, and a control is performed in the second mode.

By such a construction, even if the load becomes light during screw fastening, the pattern of the voltage is not changed to a mode for light load. Thus, the mode is gradually changed to a mode for heavy load. For this reason, modes for light load and heavy load are not repeated. For this reason, a power tool with a good feeling of use for a worker can be obtained.

According to Point 21 of the present invention, preferably, a third current value greater than the second current value is capable of flowing into the motor, a control is capable of being performed by the third mode according to the third current value, and a control is performed in the second mode or the third mode after the control in the second mode.

Additionally, the invention provides, as Point 22 thereof, a power tool including an intermittently driven motor; a hammer driven by the motor; an anvil struck by the hammer; and a detecting means capable of detecting the value of the electric current which flows into the motor. A first current value, a second current value greater than the first current value, and a third current value greater than the second current value are capable of flowing to the motor. A control is capable of being performed by a first mode according to the first current value, a second mode according to the second current value, and a third mode according to the third current value. A control is performed in the third mode after the first mode if the first current value has been detected, and the third current value has been detected.

By such a construction, if it has been detected that the current value becomes large and the load become large, work can be performed in a mode according to a load by changing to the mode according to the load. For this reason, a power tool with good working efficiency can be obtained.

Additionally, in another aspect of the invention, the invention, as Point 23 thereof, provides a power tool including an intermittently driven motor, a hammer driven by the motor, and an anvil struck by the hammer. The control method of the motor is capable of being automatically changed.

According to Point 24 of the present invention, preferably, the control method of the motor is automatically changed according to the load to the motor.

According to Point 25 of the present invention, preferably, the load of the motor is an electric current generated in the motor.

According to Point 26 of the present invention, preferably, the control method of the motor is automatically changed according to the amount of time.

According to the power tool of the invention, it is possible to provide a power tool with good feeling in use.

The above and other objects and new features of the invention will be apparent from the following description of the specification and the drawings.

DESCRIPTION OF EMBODIMENTS

Hereinafter, embodiments will be described with reference to the drawings. In the following description, the directions of up and down, front and rear, and right and left correspond to the directions shown in FIGS. 1 and 2.

Figure 1:
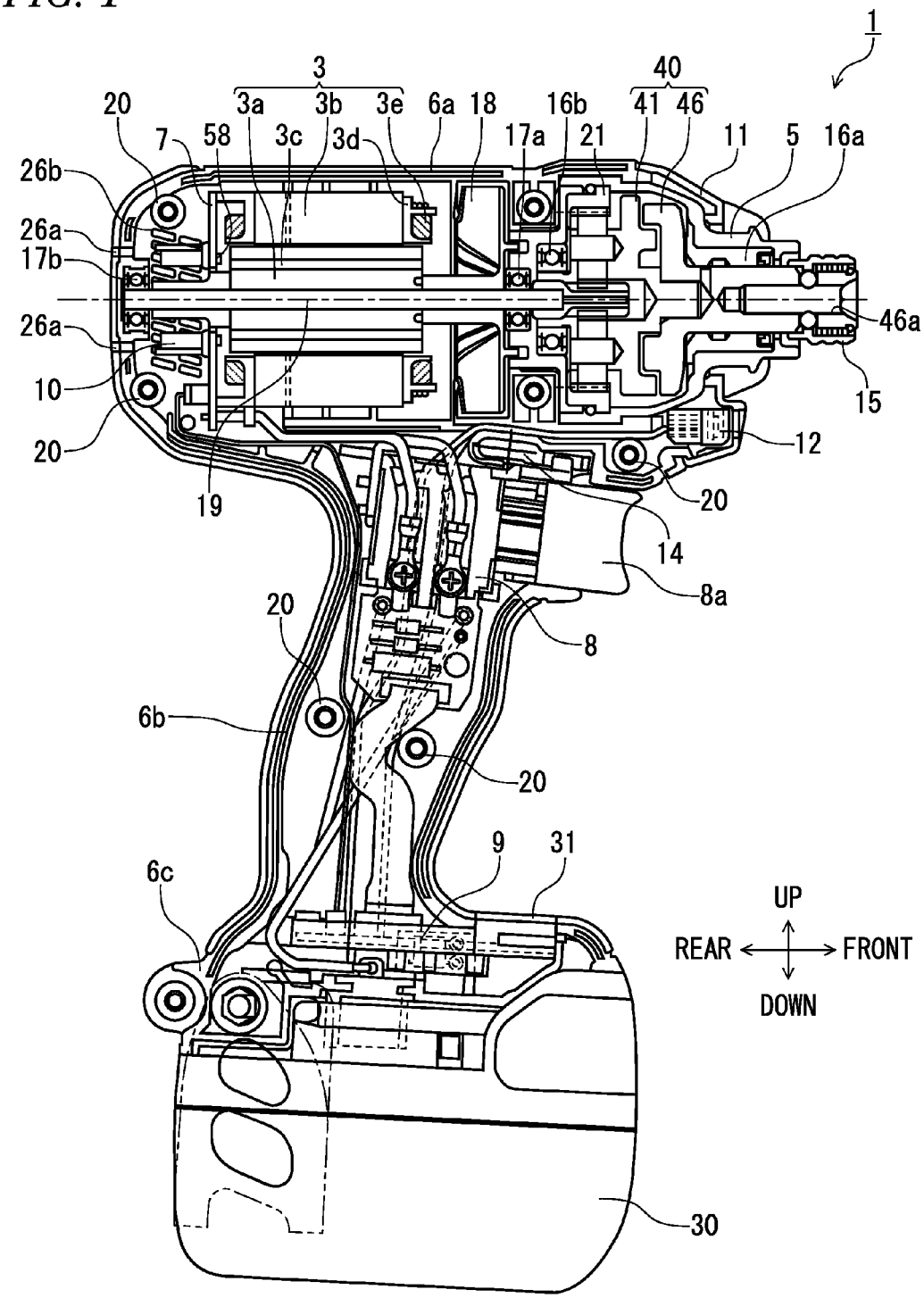
FIG. 1 cross-sectionally illustrates an impact tool 1 related to an embodiment.

FIG. 1 illustrates an impact tool 1 according to one embodiment. The impact tool 1 drives the striking mechanism 40 with a chargeable battery pack 30 as a power source and a motor 3 as a driving source, and gives rotation and striking to the anvil 46 as an output shaft to transmit continuous torque or intermittent striking power to a tip tool (not shown), such as a driver bit, thereby performing an operation, such as screwing or bolting.

The motor 3 is a brushless DC motor, and is accommodated in a tubular trunk portion 6*a* of a housing 6 which has a substantial T-shape as seen from the side. The housing 6 is splittable into two substantially-symmetrical right and left members, and the right and left members are fixed by plural screws. For example, one (the left member in the embodiment) of the right and left members of the housing 6 is formed with plural screw bosses 20, and the other (the right member in the embodiment) is formed with plural screw holes (not shown). In the trunk portion 6*a*, the rotary shaft 19 of the motor 3 is rotatably held by bearings 17*b* at the rear end, and bearings 17*a* provided around the central portion. A board on which six switching elements 10 are loaded is provided at the rear of the motor 3, and the motor 3 is rotated by inverter-controlling these switching elements 10. A rotational position detecting element 58, such as a Hall element or a Hall IC, are loaded at the front of the board 7 to detect the position of the rotor 3*a*.

In the housing 6, a grip portion 6*b* extends almost perpendicularly and integrally from the trunk portion 6*a*. A trigger switch 8 and a normal/reverse switching lever 14 are provided at an upper portion in the grip portion 6*b*. A trigger operating portion 8*a* of the trigger switch 8 is urged by a spring (not shown) to protrude from the grip portion 6*b*. A control circuit board 9 for controlling the speed of the motor 3 through the trigger operating portion 8*a* is accommodated in a lower portion in the grip portion 6*b*. A battery holding portion 6*c* is formed in the lower portion of the grip portion 6*b*, and a battery pack 30 including plural nickel hydrogen or lithium ion battery cells is detachably mounted on the battery holding portion 6*c*.

A cooling fan 18 is attached to the rotary shaft 19 at the front of the motor 3 to synchronizedly rotate therewith. The cooling fan 18 sucks air through air inlets 26*a* and 26*b* provided at the rear of the trunk portion 6*a*. The sucked air is discharged outside the housing 6 from plural slits 26*c* (refer to FIG. 2) formed around the radial outer peripheral side of the cooling fan 18 in the trunk portion 6*a*.

The striking mechanism 40 includes the anvil 46 and the hammer 41. The hammer 41 is fixed so as to connect rotary shafts of plural planetary gears of the planetary gear speed-reduction mechanism 21. Unlike a conventional impact mechanism which is now widely used, the hammer 41 does not have a cam mechanism which has a spindle, a spring, a cam groove, balls, etc. The anvil 46 and the hammer 41 are connected with each other by a fitting shaft 41*a* and a fitting groove 46*f* formed around rotation centers thereof so that only less than one relative rotation can be performed therebetween. At a front end of the anvil 46, an output shaft portion to mount a tip tool (not shown) and a mounting hole 46*a* having a hexagonal cross-sectional shape in an axial direction are integrally formed. The rear side of the anvil 46 is connected to the fitting shaft 41*a* of the hammer 41, and is held around the axial center by a metal bearing 16*a* so as to be rotatable with respect to a case 5. The detailed shape of the anvil 46 and the hammer 41 will be described later.

The case 5 is integrally formed from metal for accommodating the striking mechanism 40 and the planetary gear speed-reduction mechanism 21, and is mounted on the front side of the housing 6. The outer peripheral side of the case 5 is covered with a cover 11 made of resin in order to prevent a heat transfer, and an impact absorption, etc. The tip of the anvil 46 includes a sleeve 15 and balls 24 for detachably attaching the tip tool. The sleeve 15 includes a spring 15*a*, a washer 15*b* and a retaining ring 15*c*.

When the trigger operating portion 8*a* is pulled and the motor 3 is started, the rotational speed of the motor 3 is reduced by the planetary gear speed-reduction mechanism 21, and the hammer 41 rotates at a rotation number with a given reduction ratio with respect to the rotation number of the motor 3. When the hammer 41 rotates, the torque thereof is transmitted to the anvil 46, and the anvil 46 starts rotation at the same speed as the hammer 41. When the force applied to the anvil 46 becomes large by a reaction force received from the tip tool side, a control unit detects an increase in fastening reaction force, and drives the hammer 41 continuously or intermittently while changing the driving mode of the hammer 41 before the rotation of the motor 3 is stopped (the motor 3 is locked).

Figure 2:
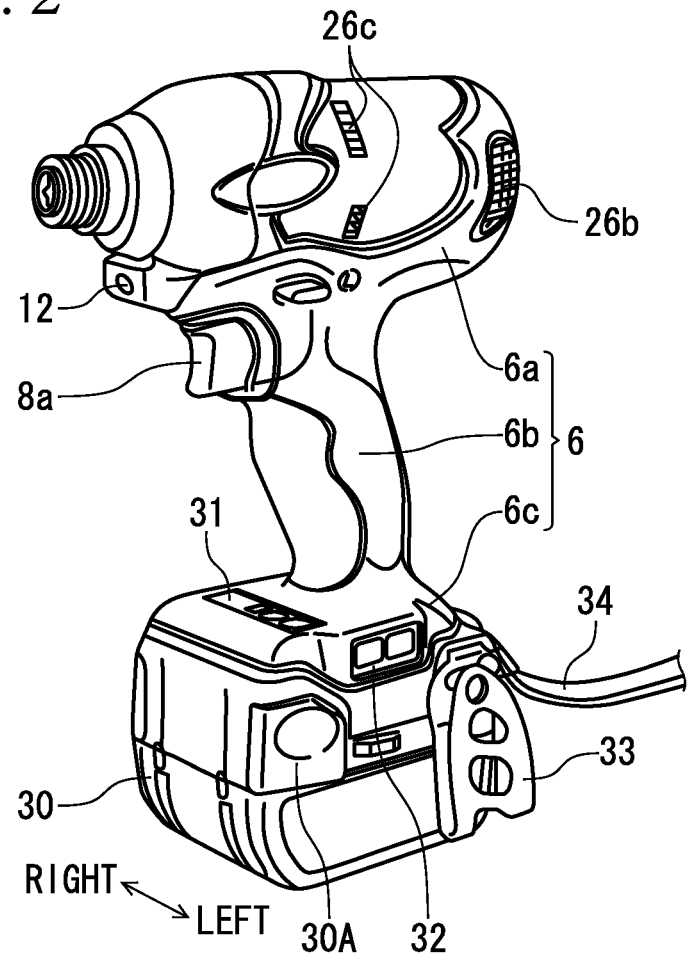
FIG. 2 illustrates an appearance of the impact tool 1 related to the embodiment.

FIG. 2 illustrates the appearance of the impact tool 1 of FIG. 1. The housing 6 includes three portions 6*a*, 6*b*, and 6*c*, and slits 26*c* for discharge of cooling air is formed around the radial outer peripheral side of the cooling fan 18 in the trunk portion 6*a*. A control panel 31 is provided on the upper face of the battery holding portion 6*c*. Various operation buttons, indicating lamps, etc. are arranged at the control panel 31, for example, a switch for turning on/off an LED light 12, and a button for confirming the residual amount of the battery pack are arranged on the control panel 31. A toggle switch 32 for switching the driving mode (the drill mode and the impact mode) of the motor 3 is provided on a side face of the battery holding portion 6*c*, for example. Whenever the toggle switch 32 is depressed, the drill mode and the impact mode are alternately switched.

The battery pack 30 includes release buttons 30A located on both right and left sides thereof, and the battery pack 30 can be detached from the battery holding portion 6*c* by moving the battery pack 30 forward while pushing the release buttons 30A. A metallic belt hook 33 is detachably attached to one of the right and left sides of the battery holding portion 6*c*. Although the belt hook 33 is attached at the left side of the impact tool 1 in FIG. 2, the belt hook 33 can be detached therefrom and attached to the right side. A strap 34 is attached around a rear end of the battery holding portion 6*c*.

Figure 3:
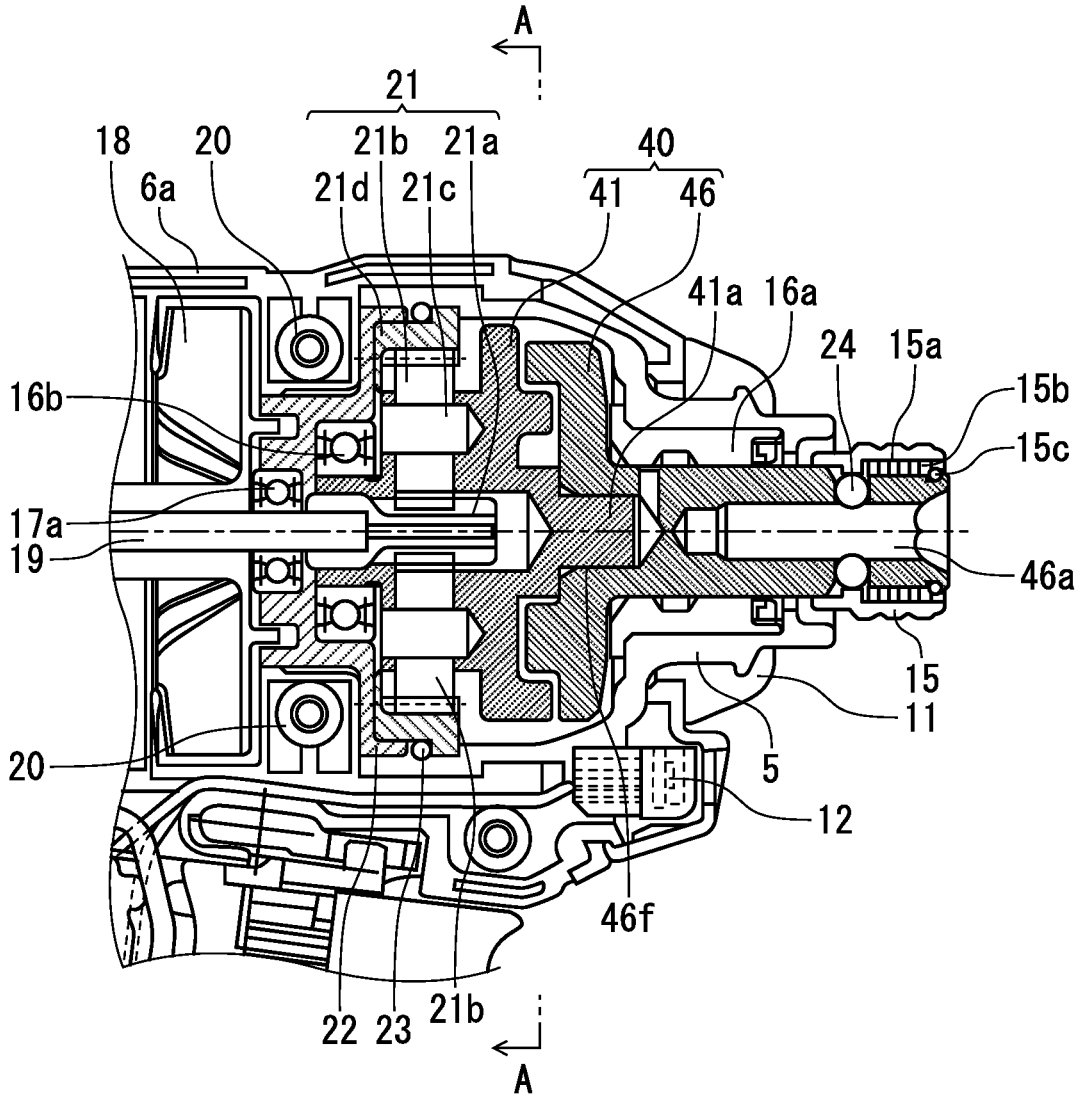
FIG. 3 enlargedly illustrates around a striking mechanism 40 of FIG. 1.

FIG. 3 enlargedly illustrates around a striking mechanism 40 of FIG. 1. The planetary gear speed-reduction mechanism 21 is a planetary type. A sun gear 21*a* connected to the tip of the rotary shaft 19 of the motor 3 functions as a driving shaft (input shaft), and plural planetary gears 21*b* rotate within an outer gear 21*d* fixed to the trunk portion 6*a*. Plural rotary shafts 21*c* of the planetary gears 21*b* is held by the hammer 41 as a planetary carrier. The hammer 41 rotates at a given reduction ratio in the same direction as the motor 3, as a driven shaft (output shaft) of the planetary gear speed-reduction mechanism 21. This reduction ratio is set based on factors, such as a fastening subject (a screw or a bolt) and the output of the motor 3 and the required fastening torque. In the present embodiment, the reduction ratio is set so that the rotation number of the hammer 41 becomes about ⅛ to 1/15 of the rotation number of the motor 3.

An inner cover 22 is provided on the inner peripheral side of two screw bosses 20 inside the trunk portion 6*a*. The inner cover 22 is manufactured by integral molding of synthetic resin, such as plastic. A cylindrical portion is formed on the rear side of the inner cover, and bearings 17*a* which rotatably fixes the rotary shaft 19 of the motor 3 are held by a cylindrical portion of the inner cover. A cylindrical stepped portion which has two different diameters is provided on the front side of the inner cover 22. Ball-type bearings 16*b* are provided at the stepped portion with a smaller diameter, and a portion of an outer gear 21*d* is inserted from the front side at the cylindrical stepped portion with a larger diameter. Since the outer gear 21*d* is non-rotatably attached to the inner cover 22, and the inner cover 22 is non-rotatably attached to the trunk portion 6*a* of the housing 6, the outer gear 21*d* is fixed in a non-rotating state. An outer peripheral portion of the outer gear 21*d* includes a flange portion with a largely formed external diameter, and an O ring 23 is provided between the flange portion and the inner cover 22. Grease (not shown) is applied to rotating portions of the hammer 41 and the anvil 46, and the O ring 23 performs sealing so that the grease does not leak into the inner cover 22 side.

In the present embodiment, a hammer 41 functions as a planetary carrier which holds the plural rotary shafts 21*c* of the planetary gear 21*b*. Therefore, the rear end of the hammer 41 extends to the inner peripheral side of the bearings 16*b*. The rear inner peripheral portion of the hammer 41 is arranged in a cylindrical inner space which accommodates the sun gear 21*a* attached to the rotary shaft 19 of the motor 3. A fitting shaft 41*a* which protrudes axially forward is formed around the front central axis of the hammer 41, and the fitting shaft 41*a* fits to a cylindrical fitting groove 46*f* formed around the rear central axis of the anvil 46. The fitting shaft 41*a* and the fitting groove 46*f* are journalled so that both are rotatable relative to each other.

Figure 4:
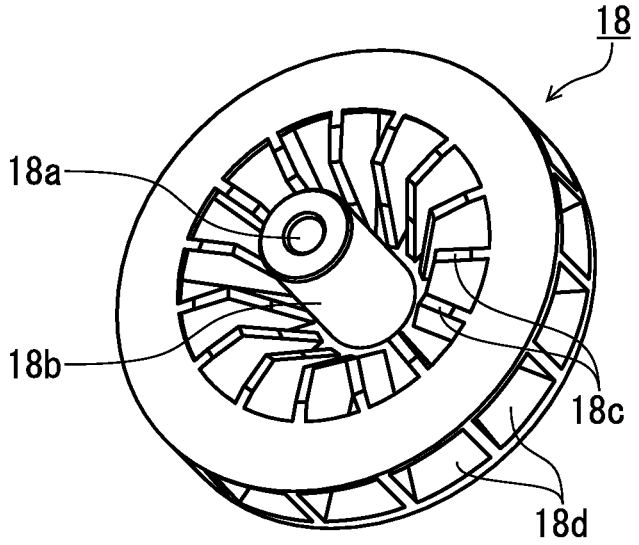
FIG. 4 illustrates a cooling fan 18 of FIG. 1.

FIG. 4 illustrates the cooling fan 18. The cooling fan 18 is manufactured by integral molding of synthetic resin, such as plastic. The rotation center of the cooling fan is formed with a through hole 18*a* which the rotary shaft 19 passes through, a cylindrical portion 18*b* which secures a given distance from a rotor 3*a* which covers the rotary shaft 19 by a given distance in the axial direction is formed, and plural fins 18*c* is formed on an outer peripheral side from the cylindrical portion 18*b*. An annular portion is provided on the front and rear sides of each fin 18*c*, and the air sucked from the axial rear side (not only the rotation direction of the cooling fan 18) is discharged outward in the circumferential direction from plural openings 18*d* formed around the outer periphery of the cooling fan. Since the cooling fan 18 exhibits the function of a so-called centrifugal fan, and is directly connected to the rotary shaft 19 of the motor 3 without going through the planetary gear speed-reduction mechanism 21, and rotates with a sufficiently larger rotation number than the hammer 41, sufficient air volume can be secured.

Next, the construction and operation of the motor driving control system will be described with reference to FIG. 5.

Figure 5:
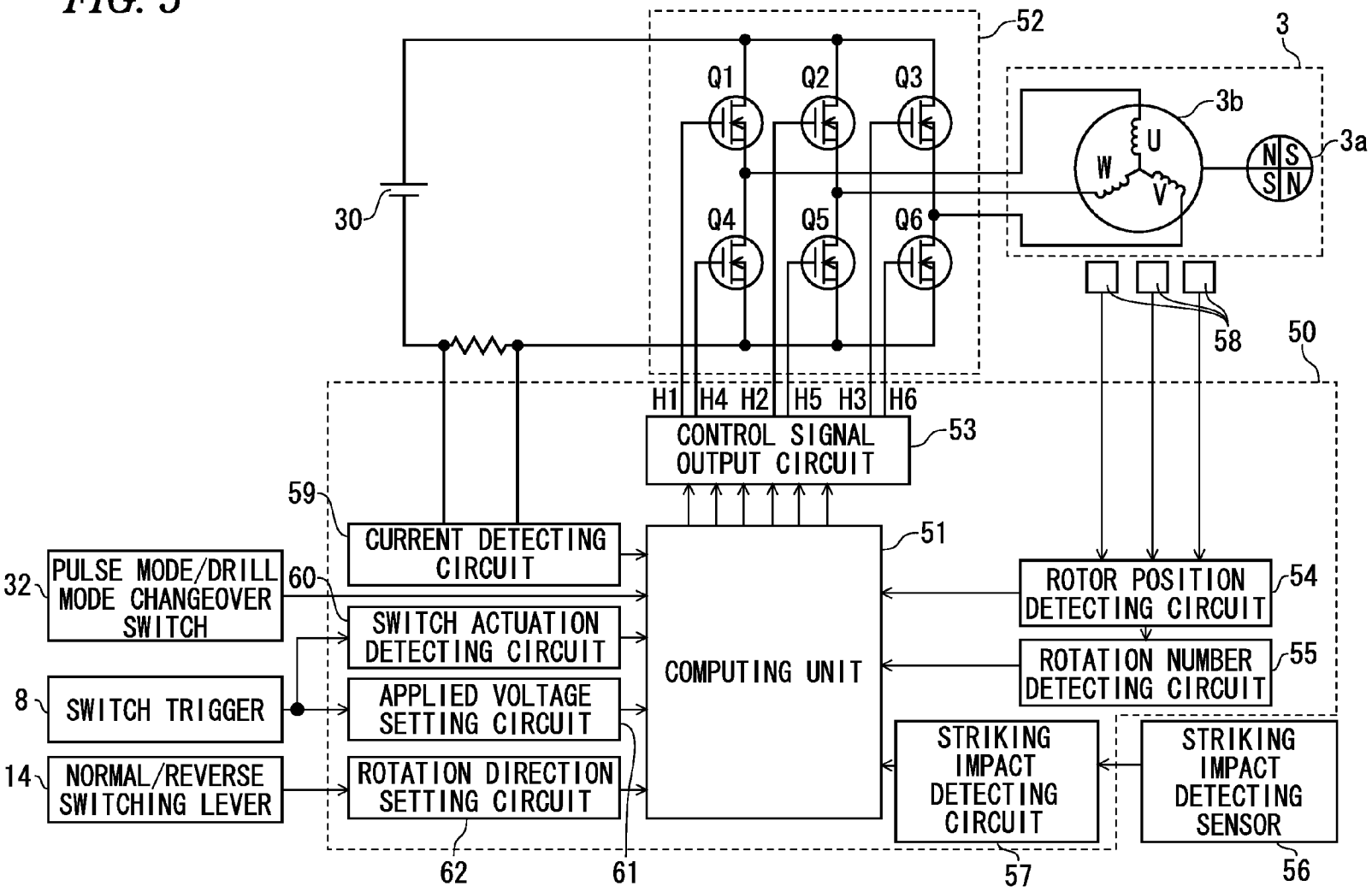
FIG. 5 illustrates a functional block diagram of a motor driving control system of the impact tool related to the embodiment.

FIG. 5 illustrates the motor driving control system. In the present embodiment, the motor 3 includes a three-phase brushless DC motor. This brushless DC motor is a so-called inner rotor type, and has a rotor 3*a* including permanent magnets (magnets) including plural (two, in the embodiment) N-S poles sets, a stator 3*b* composed of three-phase stator windings U, V, and W which are wired as a stator, and three rotational position detecting elements (Hall elements) 58 arranged at given intervals, for example, at 60 degrees in the peripheral direction in order to detect the rotational position of the rotor 3*a*. Based on position detection signals from the rotational position detecting elements 58, the energizing direction and time to the stator windings U, V, and W are controlled, thereby rotating the motor 3. The rotational position detecting elements 58 are provided at positions which face the permanent magnets 3*c* of the rotor 3*a* on the board 7.

Electronic elements to be loaded on the board 7 include six switching elements Q1 to Q6, such as FET, which are connected as a three-phase bridge. Respective gates of the bridge-connected six switching elements Q1 to Q6 are connected to a control signal output circuit 53 loaded on the control circuit board 9, and respective drains/sources of the six switching elements Q1 to Q6 are connected to the stator windings U, V, and W which are wired as a stator. Thereby, the six switching elements Q1 to Q6 perform switching operations by switching element driving signals (driving signals, such as H4, H5, and H6) input from the control signal output circuit 53, and supplies electric power to the stator windings U, V, and W with the direct current voltage of the battery pack 30 to be applied to the inverter circuit 52 as three-phase voltages (U phase, V phase, and W phase) Vu, Vv, and Vw.

Among switching elements driving signals (three-phase signals which drive the respective signals of the six switching elements Q1 to Q6, driving signals for the three negative power supply side switching element Q4, Q5, and Q6 are supplied as pulse width modulation signals (PWM signals) H4, H5, and H6, and the pulse width (duty ratio) of the PWM signals is changed by the computing unit 51 loaded on the control circuit board 9 based on a detection signal of the operation amount (stroke) of the trigger operating portion 8*a* of the trigger switch 8, whereby the power supply amount to the motor 3 is adjusted, and the start/stop and rotating speed of the motor 3 are controlled.

PWM signals are supplied to either the positive power supply side switching elements Q1 to Q3 or the negative power supply side switching elements Q4 to Q6 of the inverter circuit 52, and the electric power to be supplied to stator windings U, V, and W from the direct current voltage of the battery pack 30 is controlled by switching the switching elements Q1 to Q3 or the switching elements Q4 to Q6 at high speed. In the present embodiment, PWM signals are supplied to the negative power supply side switching elements Q4 to Q6. Therefore, the rotating speed of the motor 3 can be controlled by controlling the pulse width of the PWM signals, thereby adjusting the electric power to be supplied to each of the stator windings U, V, and W.

The impact tool 1 includes the normal/reverse switching lever 14 for switching the rotation direction of the motor 3. Whenever a rotation direction setting circuit 62 detects the change of the normal/reverse switching lever 14, the control signal to switch the rotation direction of the motor is transmitted to a computing unit 51. The computing unit 51 includes a central processing unit (CPU) for outputting a driving signal based on a processing program and data, a ROM for storing a processing program or control data, and a RAM for temporarily storing data, a timer, etc., although not shown.

The control signal output circuit 53 forms a driving signal for alternately switching predetermined switching elements Q1 to Q6 based on output signals of the rotation direction setting circuit 62 and a rotor position detecting circuit 54, and outputs the driving signal to the control signal output circuit 53. This alternately energizes a predetermined winding wire of the stator windings U, V, and W, and rotates the rotor 3*a* in a set rotation direction. In this case, driving signals to be applied to the negative power supply side switching elements Q4 to Q6 are output as PWM modulating signals based on an output control signal of an applied voltage setting circuit 61. The value of a current to be supplied to the motor 3 is measured by the current detecting circuit 59, and is adjusted into a set driving electric power as the value of the current is fed back to the computing unit 51. The PWM signals may be applied to the positive power supply side switching elements Q1 to Q3.

A striking impact sensor 56 which detects the magnitude of the impact generated in the anvil 46 is connected to the control unit 50 loaded on the control circuit board 9, and the output thereof is input to the computing unit 51 via the striking impact detecting circuit 57. The striking impact sensor 56 can be realized by a strain gauge, etc. attached to the anvil 46, and when fastening is completed with normal torque by using the output of the striking impact sensor 56, the motor 3 may be automatically stopped.

Figure 6:
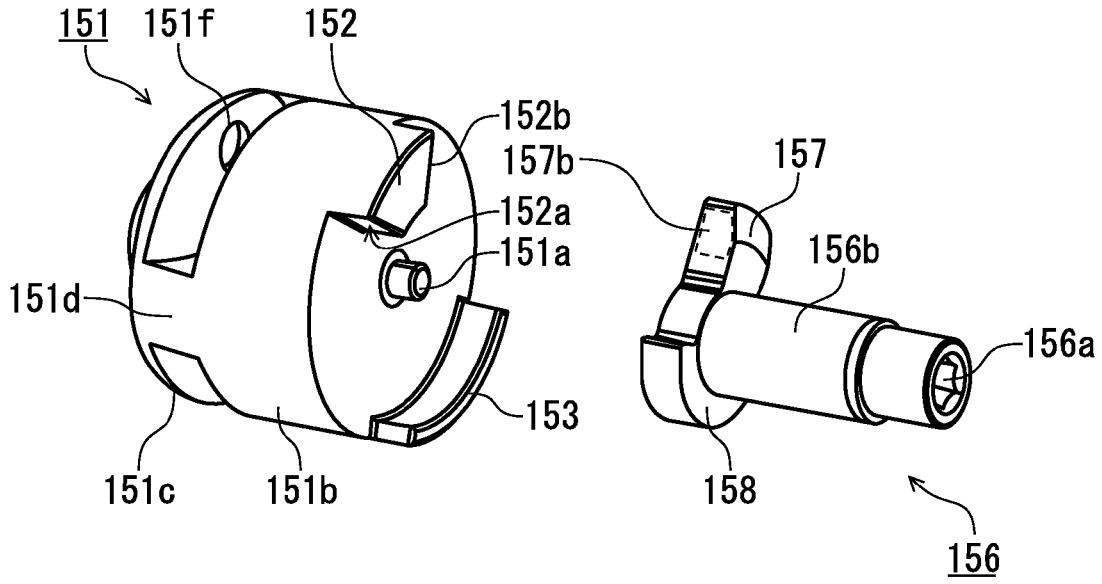
FIG. 6 illustrates a hammer 151 and an anvil 156 related to a basic construction (second embodiment) of the invention.

Next, before the striking operation of the hammer 41 and the anvil 46 related to the present embodiment is described, the basic construction of the hammer and the anvil and the striking operation principle thereof will be described with reference to FIGS. 6 and 7. FIG. 6 illustrates the hammer 151 and the anvil 156 related to a basic construction (a second embodiment). The hammer 151 is formed with a set of protruding portions, i.e., a protruding portion 152 and a protruding portion 153 which protrude axially from the cylindrical main body portion 151*b*. The front center of the main body portion 151*b* is formed with a fitting shaft 151*a* which fits to a fitting groove (not shown) formed at the rear of the anvil 156, and the hammer 151 and the anvil 156 are connected together so as to be rotatable relative to each other by a given angle of less than one rotation (less than 360 degrees). The protruding portion 152 acts as a striking pawl, and has planar striking-side surfaces 152*a* and 152*b* formed on both sides in a circumferential direction. The hammer 151 further includes a protruding portion 153 for maintaining rotation balance with the protruding portion 152. Since the protruding portion 153 functions as a weight portion for taking rotation balance, no striking-side surface is formed.

A disc portion 151*c* is formed on the rear side of the main body portion 151*b* via a connecting portion 151*d*. The space between the main body portion 151*b* and the disc portion 151*d* is provided to arrange the planetary gear 21*b* of the planetary gear mechanism 21, and the disc portion 151*d* is formed with a through hole 151*f* for holding the rotary shafts 21*c* of the planetary gear 21*b*. Although not shown, a holding hole for holding the rotary shafts 21*c* of the planetary gear 21*b* is formed also on the side of the main body portion 151*b* which faces disc portion 151*d*.

The anvil 156 is formed with a mounting hole 156*a* for mounting the tip tool on the front end side of the cylindrical main body portion 156*b*, and two protruding portions 157 and 158 which protrude radially outward from the main body portion 156*b* are formed on the rear side of the main body portion 156*b*. The protruding portion 157 is a striking pawl which has struck-side surfaces 157*a* and 157*b*, and is a weight portion in which a protruding portion 158 does not have a struck-side surface. Since the protruding portion 157 is adapted to collide with the protruding portion 152, the external diameter thereof is made equal to the external diameter of the protruding portion 152. Both the protruding portions 153 and 158 only acting as a weight are formed to not interfere with each other and not to collide with any part. In order to take the rotation angle between the hammer 151 and the anvil 156 as much as possible (less than one rotation at the maximum), the radial thicknesses of the protruding portions 153 and 158 are made small to increase a circumferential length so that the rotation balance between the protruding portions 152 and 157 is maintained. By setting the relative rotation angle greatly, a large acceleration section (run-up section) of the hammer when the hammer is made to collide with the anvil can be taken, and striking can be performed with considerable energy.

Figure 7:
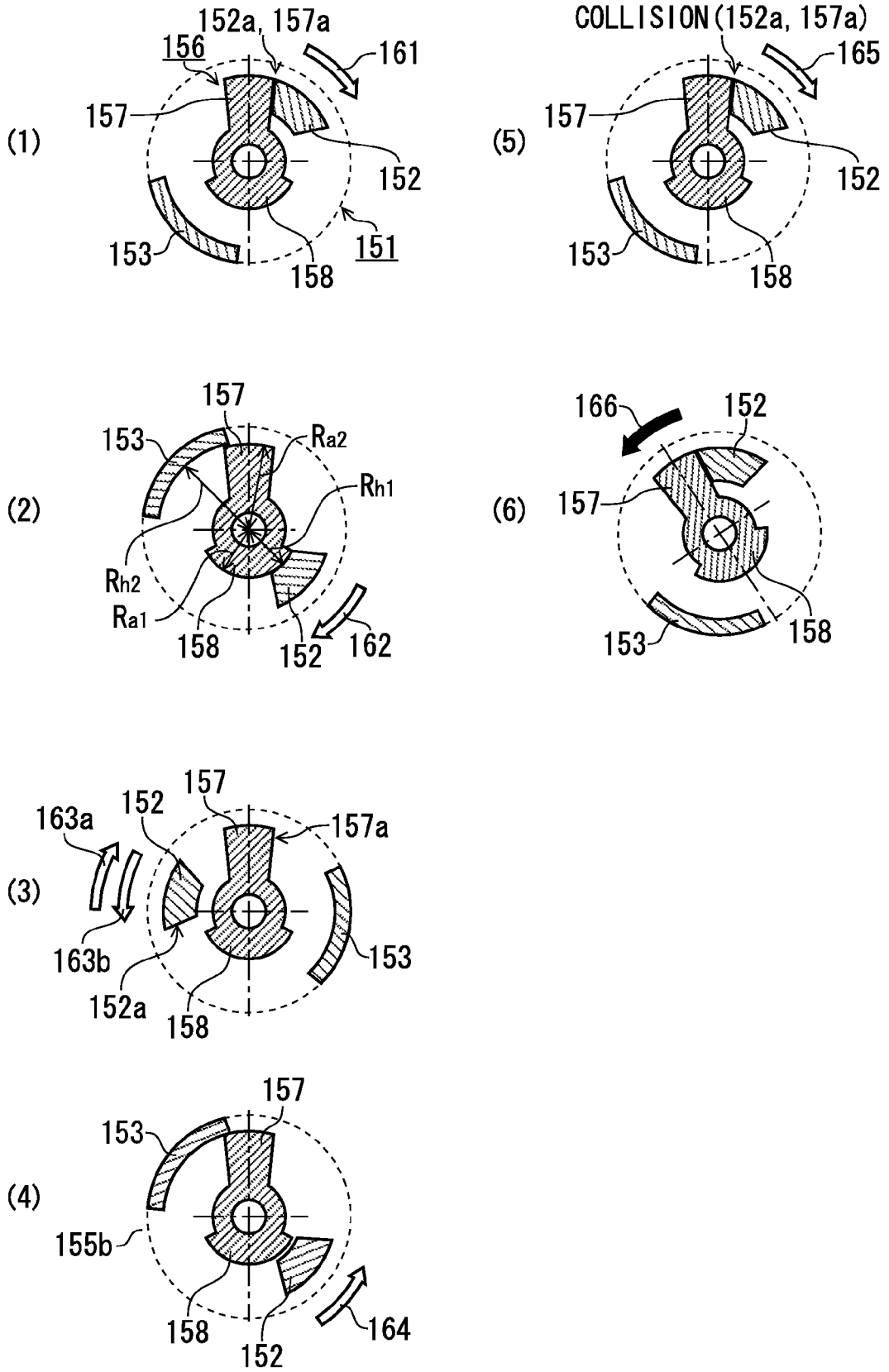
FIG. 7 illustrates the striking operation of the hammer 151 and the anvil 156 of FIG. 6, in six stages.

FIG. 7 illustrates one rotation movement in the usage state of the hammer 151 and the anvil 156 in six stages. The sectional plane of FIG. 7 is vertical to the axial direction, and includes a striking-side surface 152*a* (FIG. 6). In the state of FIG. 7(1), while fastening torque received from the tip tool is small, the anvil 156 rotates counterclockwise by being pushed from the hammer 151. However, when the fastening torque becomes large, and rotation becomes impossible only by the pushing force from the hammer 151, since the anvil 156 is struck by the hammer 151, the reverse rotation of the motor 3 is started in order to reversely rotate the hammer 151 in the direction of arrow 161. By starting the reverse rotation of the motor 3 in a state shown in (1), thereby rotating the protruding portion 152 of the hammer 151 in the direction of arrow 161, and further reversely rotate the motor 3, the protruding portion 152 rotates while being accelerated in the direction of arrow 162 through the outer peripheral side of the protruding portion 158 as shown in (2). Similarly, the external diameter $R_{a1}$ of the protruding portion 158 is made smaller than the internal diameter $R_{h1}$ of the protruding portion 152, and thus both the protruding portions do not collide with each other. The external diameter $R_{a2}$ of the protruding portion 157 is made smaller than the internal diameter $R_{h2}$ of the protruding portion 153, and thus both the protruding portions do not collide with each other. If the protruding portions are constructed in such positional relationship, the relative rotation angle of the hammer 151 and the anvil 156 can be made greater than 180 degrees, and the sufficient reverse rotation angle of the hammer 151 with respect to the anvil 156 can be secured.

When the hammer 151 further reversely rotates, and arrives at a position (stop position of the reverse rotation) of FIG. 7(3) as shown by arrow 163*a*, the rotation of the motor 3 is paused for a given time period, and then, the rotation of the motor 3 in the direction of arrow 163*b* (the normal rotation direction) is started. When the hammer 151 is reversely rotated, it is important to stop the hammer 151 reliably at a stop position so as not to collide with the anvil 156. Although the stop position of the hammer 151 before a position where the hammer collides with the anvil 156 is arbitrary set, it is desirable to make the stop position as large as possible according to the required fastening torque. It is not necessary to set the stop position to the same position each time, and the reverse rotation angle may be made small in an initial stage of fastening, and the reverse rotation angle may be set large as fastening proceeds. If the stop position is made variable in this way, since the time required for reverse rotation can be set to the minimum, striking operation can be rapidly performed in a short time.

Then, the hammer 151 is further accelerated while passing through the position of FIG. 7(4) in the direction of arrow 164, and the striking-side surface 152*a* of the protruding portion 152 collides with the struck-side surface 157*a* of the anvil 156 at a position shown in FIG. 7(5) in a state under acceleration. As a result of this collision, powerful rotation torque is transmitted to the anvil 156, and the anvil 156 rotates in the direction shown by arrow 166. The position of FIG. 7(6) is a state where both the hammer 151 and the anvil 156 have rotated at a given angle from the state of FIG. 7(1), and a fastening subject member is fastened to a proper torque by repeating the operation from the state shown in FIG. 7(1) to FIG. 7(5) again.

As described above, in the hammer 151 and the anvil 156 related to the second embodiment, an impact tool can be realized with a simple construction of the hammer 151 and the anvil 156 serving as a striking mechanism by using a driving mode where the motor 3 is reversely rotated. In the striking mechanism of this construction, the motor can also be rotated in the drill mode by the setting of the driving mode of the motor 3. For example, in the drill mode, it is possible to rotate the hammer so as to follow the anvil 156 like FIG. 7(6) simply by rotating the motor 3 from the state of FIG. 7(5) to rotate the hammer 151 in a normal direction. Thus, by repeating this, members to be fastened, such as screws or bolts, capable of making fastening torque small, can be fastened at high speed.

In the impact tool 1 related to the present embodiment, a brushless DC motor is used as the motor 3. Therefore, by calculating the value of a current which flows into the motor 3 from the current detecting circuit 59 (refer to FIG. 5), detecting a state where the value of the current has become larger than a given value, and making the computing unit 51 stop the motor 3, a so-called clutch mechanism in which power transmission is interrupted after fastening to a given torque can be electronically realized. Accordingly, in the impact tool 1 related to the present embodiment, the clutch mechanism during the drill mode can also be realized, and the multi-use fastening tool which has a drill mode with no clutch, a drill mode with a clutch, and an impact mode can be realized by the striking mechanism with a simple construction.

Figure 8:
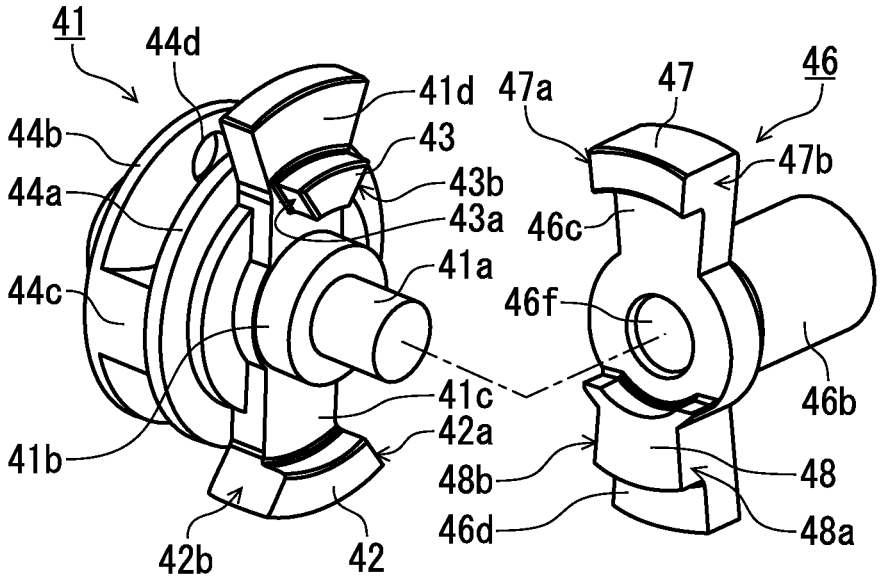
FIG. 8 illustrates the hammer 41 and the anvil 46 of FIG. 1.
Figure 9:
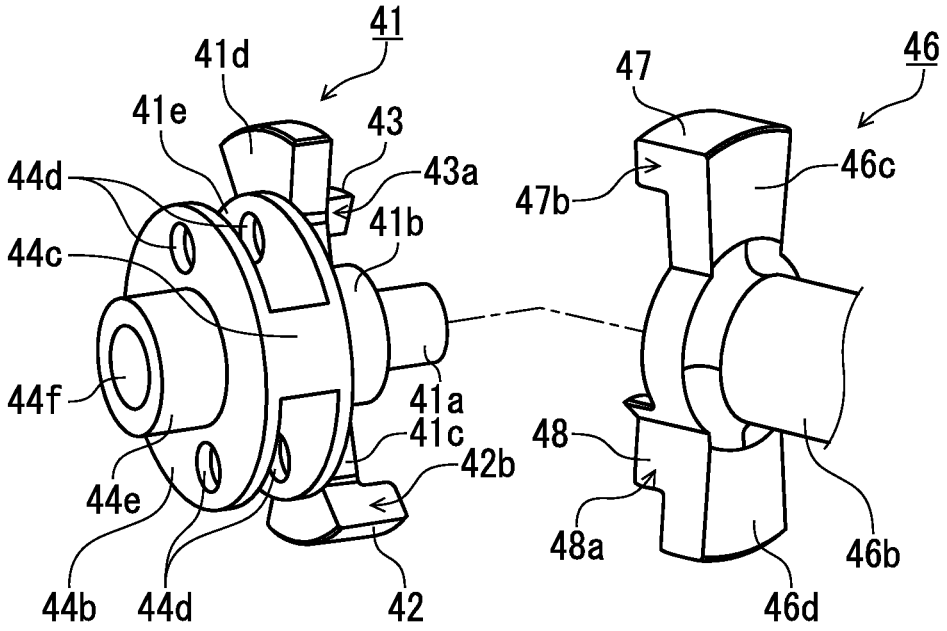
FIG. 9 illustrates a hammer 41 and an anvil 46 of FIG. 1 as viewed from a different angle.

Next, the detailed structure of the striking mechanism 40 shown in FIGS. 1 and 2 will be described with reference to FIGS. 8 and 9. FIG. 8 illustrates the hammer 41 and the anvil 46 related to a first embodiment, in which the hammer 41 is seen obliquely from the front, and the anvil 46 is seen obliquely from the rear. FIG. 9 illustrates the hammer 41 and the anvil 46, in which the hammer 41 is seen obliquely from the rear, and the anvil 46 is seen obliquely from the front. The hammer 41 is formed with two blade portions 41*c* and 41*d* which protrude radially from the cylindrical main body portion 41*b*. Although the blade portions 41*d* and 41*c* are respectively formed with the protruding portions which protrude axially, this construction is different from the basic construction (second embodiment) shown in FIG. 6 in that a set of striking portions and a set of weight portions are formed in the blade portions 41*d* and 41*c*, respectively.

The outer peripheral portion of the blade portion 41*c* has the shape of a fan, and the protruding portion 42 protrudes axially forward from the outer peripheral portion. The fan-shaped portion and the protruding portion 42 function as both a striking portion (striking pawl) and a weight portion. The striking-side surfaces 42*a* and 42*b* are formed on both sides of the protruding portion 42 in a circumferential direction. Both the striking-side surfaces 42*a* and 42*b* are formed into flat surfaces, and a moderate angle is given so as to come into surface contact with a struck-side surface (which will be described later), of the anvil 46 well. Meanwhile, the blade portion 41*d* is formed to have a fan-shaped outer peripheral portion, and the mass of the fan-shaped portion increases due to the shape thereof. As a result, the blade portion acts well as a weight portion. Further, a protruding portion 43 which protrudes axially forward from around the radial center of the blade portion 41*d* is formed. The protruding portion 43 acts as a striking portion (striking pawl), and striking-side surfaces 43*a* and 43*b* are formed on both sides of the protruding portion in the circumferential direction. Both the striking-side surfaces 43*a* and 43*b* are formed into flat surfaces, and a moderate angle is given in the circumferential direction so as to come into surface contact with a struck-side surface (which will be described later), of the anvil 46 well.

The fitting shaft 41*a* to be fitted into the fitting groove 46*f* of the anvil 46 is formed on the front side around the axial center of the main body portion 41*b*. Connecting portions 44*c* which connect two disc portions 44*a* and 44*b* at two places in the circumferential direction so as to function as a planetary carrier are formed on the rear side of the main body portion 41*b*. Through holes 44*d* are respectively formed at two places of the disc portions 44*a* and 44*b* in the circumferential direction, two planetary gears 21*b* (refer to FIG. 3) are arranged between the disc portions 44*a* and 44*b*, and the rotary shafts 21*c* (refer to FIG. 3) of the planetary gear 21*b* are mounted on the through holes 44*d*. A cylindrical portion 44*e* which extends with a cylinder shape is formed on the rear side of the disc portion 44*b*. The outer peripheral side of the cylindrical portion 44*e* is held inside the bearings 16*b*. The sun gear 21*a* (refer to FIG. 3) is arranged in a space 44*f* inside the cylindrical portion 44*e*. It is preferable not only in strength but also in weight to manufacture the hammer 41 and the anvil 46 which are shown in FIGS. 8 and 9 as a metallic integral structure.

The anvil 46 is formed with two blade portions 46*c* and 46*d* which protrude radially from the cylindrical main body portion 46*b*. A protruding portion 47 which protrudes axially rearward is formed around the outer periphery of the blade portion 46*c*. Struck-side surfaces 47*a* and 47*b* are formed on both sides of the protruding portion 47 in the circumferential direction. Meanwhile, a protruding portion 48 which protrudes axially rearward is formed around the radial center of the blade portion 46*d*. Struck-side surfaces 48*a* and 48*b* are formed on both sides of the protruding portion 48 in the circumferential direction. When the hammer 41 normally rotates (a rotation direction in which a screw, etc. is fastened), the striking-side surface 42*a* abuts on the struck-side surface 47*a*, and simultaneously, the striking-side surface 43*a* abuts on the struck-side surface 48*a*. When the hammer 41 reversely rotates (a rotation direction in which a screw, etc. is loosened), the striking-side surface 42*b* abuts on the struck-side surface 47*b*, and simultaneously, the striking-side surface 43*b* abuts on the struck-side surface 48*b*. The protruding portions 42, 43, 47, and 48 are formed to simultaneously abut at two places.

As such, according to the hammer 41 and the anvil 46 which are shown in FIGS. 8 and 9, since striking is performed at two places which are symmetrical with respect to the rotating axial center, the balance during striking is good, and the impact tool 1 is hardly shaken during striking. Since striking-side surfaces are respectively provided on both sides of a protruding portion in the circumferential direction, impact operation becomes possible not only during normal rotation but also during reverse rotation, an impact tool which is easy to use can be realized. Since the hammer 41 strikes the anvil 46 only in the circumferential direction, and the hammer 41 does not strike the anvil 46 axially forward, the tip tool does not unnecessarily push a fastening subject member, and there is an advantage when a wood screw, etc. is fastened into timber.

Figure 10:
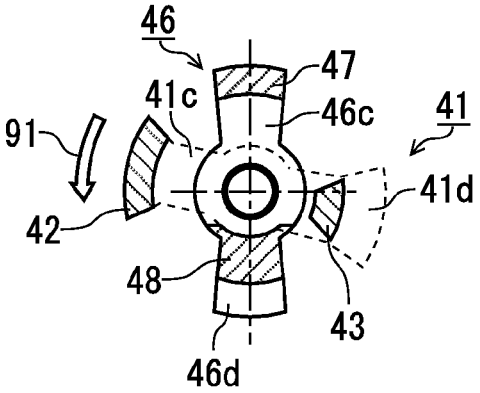
FIG. 10 illustrates the striking operation of the hammer 41 and the anvil 46 shown in FIGS. 8 and 9.
Figure 10:
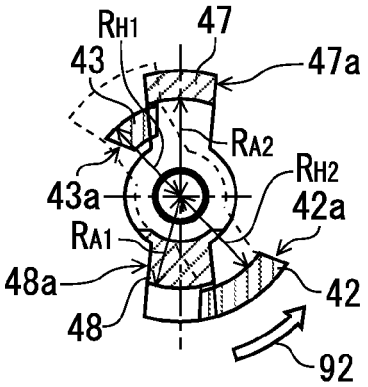
Figure 10:
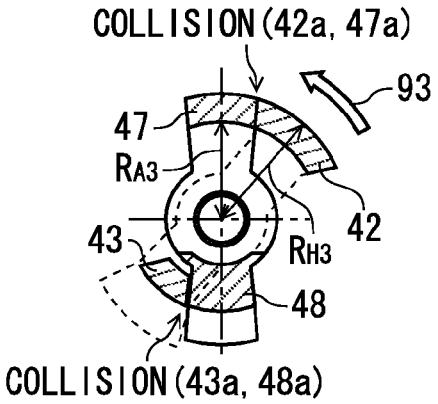
Figure 10:
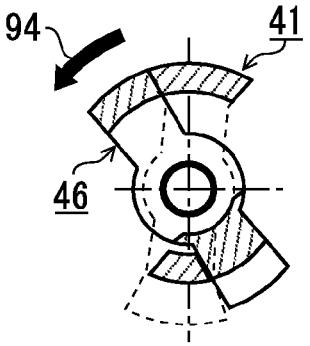

Next, the striking operation of the hammer 41 and the anvil 46 which are shown in FIGS. 8 and 9 will be described with reference to FIG. 10. The basic operation is the same as the operation described in FIG. 7, and the difference is that striking simultaneously performed in striking-side surfaces not at one place but at substantially-axisymmetric two places during striking. FIG. 10 illustrates a cross-section of a portion A-A of FIG. 3. FIG. 10 illustrates the positional relationship between the protruding portions 42 and 43 which protrude axially from the hammer 41, and the protruding portions 47 and 48 which protrude axially from the anvil 46. The rotation direction of the anvil 47 during the fastening operation (during normal rotation) is counterclockwise.

FIG. 10(1) is in a state where the hammer 41 reversely rotates to the maximum reverse rotation position with respect to the anvil 46 (equivalent to the state of FIG. 7(3)). From this state, the hammer 41 is accelerated in the direction of arrow 91 (in the normal direction) to strike the anvil 46. Then, like FIG. 10(2), the protruding portion 42 passes through the outer peripheral side of the protruding portion 48, and simultaneously the protruding portion 43 passes through the inner peripheral side of the protruding portion 47. In order to allow passage of both the protruding portions, the internal diameter $R_{H2}$ of the protruding portion 42 is made greater than the external diameter $R_{A1}$ of the protruding portion 48, and thus the protruding portions do not collide with each other. Similarly, the external diameter $R_{H1}$ of the protruding portion 43 is made smaller than the internal diameter $R_{A2}$ of the protruding portion 47, and thus both the protruding portions do not collide with each other. According to such positional relationship, the relative rotation angle of the hammer 41 and the anvil 46 can be made larger more than 180 degrees, the sufficient reverse rotation angle of the hammer 41 to the anvil 46 can be secured, and this reverse rotation angle can be located in the accelerating section before the hammer 41 strikes the anvil 46.

Next, when the hammer 41 normally rotates to the state of FIG. 10(3), the striking-side surface 42*a* of the protruding portion 42 collides with the struck-side surface 47*a* of the protruding portion 47. Simultaneously, the striking-side surface 43*a* of the protruding portion 43 collides with the striking-side surface 48*a* of the protruding portion 48. By causing collision at two places opposite to a rotation axis in this way, the striking which is well-balanced with respect to the anvil 46 can be performed. As a result of this striking, as shown in FIG. 10(4), the anvil 46 rotates in the direction of arrow 94, and fastening of a fastening subject member is performed by this rotation. The hammer 41 has the protruding portion 42 which is a solitary protrusion at a radial concentric position (a position above $R_{H2}$ and below $R_{H3}$), and has the protruding portion 43 which is a third solitary protrusion at a concentric position (position below $R_{H1}$). The anvil 46 has the protruding portion 47 which is a solitary protrusion at a radial concentric position (a position above $R_{A2}$ and below $R_{A3}$), and has the protruding portion 48 which is a solitary protrusion at a concentric position (position below $R_{A1}$).

Figure 11:
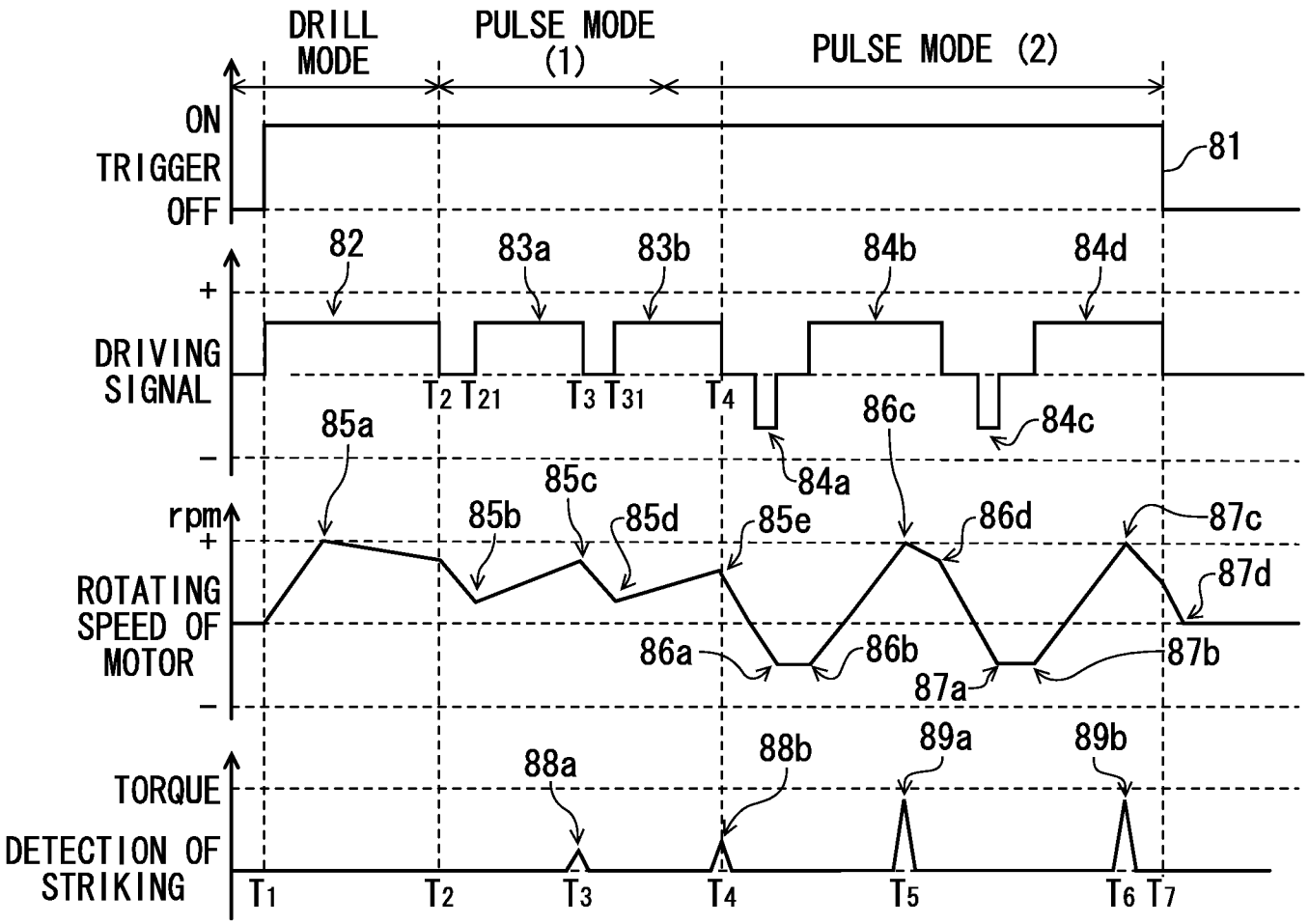
FIG. 11 illustrates a trigger signal during the operation of the impact tool 1, a driving signal of an inverter circuit, the rotating speed of the motor 3, and the striking state of the hammer 41 and the anvil 46.

Next, the driving method of the impact tool 1 related to the present embodiment will be described. In the impact tool 1 related to the present embodiment, the anvil 46 and the hammer 41 are formed so as to be relatively rotatable at a rotation angle of less than 360 degrees. Since the hammer 41 cannot perform rotation of more than one rotation relative to the anvil 46, the control of the rotation is also unique. FIG. 11 illustrates a trigger signal during the operation of the impact tool 1, a driving signal of an inverter circuit, the rotating speed of the motor 3, and the striking state of the hammer 41 and the anvil 46. The horizontal axis is time in the respective graphs (timings of the respective graphs are matched).

In the impact tool 1 related to the present embodiment, in the case of the fastening operation in the impact mode, fastening is first performed at high speed in the drill mode, fastening is performed by switching to the impact mode (1) if it is detected that the required fastening torque becomes large, and fastening is performed by switching to the impact mode (2) if the required fastening torque becomes still larger. In the drill mode from time $T_1$ to time $T_2$ of FIG. 11, the control unit 51 controls the motor 3 based on a target rotation number. For this reason, the motor is accelerated until the motor 3 reaches the target rotation number shown by arrow 85*a*. Thereafter, the rotating speed of the motor 3 with a large fastening reaction force from the tip tool attached to the anvil 46 decreases gradually as shown by arrow 85*b*. Thus, decrease of the rotation speed is detected by the value of a current to be supplied to the motor 3, and switching to the rotation driving mode by the pulse mode (1) is performed at time $T_2$.

The pulse mode (1) is a mode in which the motor 3 is not continuously driven but intermittently driven, and is driven in pulses so that "pause→normal rotation driving" is repeated multiple times. The expression "driven in pulses" means controlling driving so as to pulsate a gate signal to be applied to the inverter circuit 52, pulsate a driving current to be supplied to the motor 3, and thereby pulsate the rotation number or output torque of the motor 3. This pulsation is generated by repeating ON/OFF of a driving current with a large period (for example, about several tens of hertz to a hundred and several tens of hertz), such as ON (driving) of the driving current to be supplied to the motor from time $T_2$ to time $T_{21}$ (pause), ON (driving) of the driving current of the motor from time $T_{21}$ to time $T_3$, OFF (pause) of the driving current from time $T_3$ to time $T_{31}$, and ON of the driving current from time $T_{31}$ to time $T_4$. Although PWM control is performed for the control of the rotation number of the motor 3 in the ON state of the driving current, the period to be pulsated is sufficiently small compared with the period (usually several kilohertz) of duty ratio control.

In the example of FIG. 11, after supply of the driving current to the motor 3 for a given time period from $T_2$ is paused, and the rotating speed of the motor 3 decreases to arrow 85*b*, the control unit 51 (refer to FIG. 5) sends a driving signal 83*a* to the control signal output circuit 53, thereby supplying a pulsating driving current (driving pulse) to the motor 3 to accelerate the motor 3. This control during acceleration does not necessarily mean driving at a duty ratio of 100% but means control at a duty ratio of less than 100%. Next, striking power is given as shown by arrow 88*a* as the hammer 41 collides with the anvil 46 strongly at arrow 85*c*. When striking power is given, the supply of a driving current to the motor 3 for a given time period is paused, and the rotating speed of the motor decreases again as shown by arrow 85*b*. Thereafter, the control unit 51 sends a driving signal 83*b* to the control signal output circuit 53, thereby accelerating the motor 3. Then, striking power is given as shown by arrow 88*b* as the hammer 41 collides with the anvil 46 strongly at arrow 85*e*. In the pulse mode (1), the above-described intermittent driving of repeating "pause→normal rotation driving" of the motor 3 is repeated one time or multiple times. If it is detected that further higher fastening torque is required, switching to the rotation driving mode by the pulse mode (2) is performed. Whether or not further higher fastening torque is required can be determined using, for example, the rotation number (before or after arrow 85*e*) of the motor 3 when the striking power shown by arrow 88*b* is given.

Although the pulse mode (2) is a mode in which the motor 3 is intermittently driven, and is driven in pulses similarly to the pulse mode (1), the motor is driven so that "pause→reverse rotation driving→pause (stop)→normal rotation driving" is repeated plural times. That is, in the pulse mode (2), in order to add not only the normal rotation driving but also the reverse rotation driving of the motor 3, the hammer 41 is accelerated in the normal rotation direction so as to strongly collide with the anvil 46 after the hammer 41 is reversely rotated by a sufficient angular relation with respect to the anvil 46. By driving the hammer 41 in this way, strong fastening torque is generated in the anvil 46.

In the example of FIG. 11, when switching to the pulse mode (2) is performed at time $T_4$, driving of the motor 3 is temporarily paused, and then, the motor 3 is reversely rotated by sending a driving signal 84*a* in a negative direction to the control signal output circuit 53. When normal rotation or reverse rotation is performed, this normal rotation or reverse rotation is realized by switching the signal pattern of each driving signal (ON/OFF signal) to be output to each of the switching elements Q1 to Q6 from the control signal output circuit 53. If the motor 3 is reversely rotated by a given rotation angle, driving of the motor 3 is temporarily paused to start normal rotation driving. For this reason, a driving signal 84*b* in a positive direction is sent to the control signal output circuit 53. In the rotational driving using the inverter circuit 52, a driving signal is not switched to the plus side or minus side. However, a driving signal is classified into the + direction and – direction and is schematically expressed in FIG. 11 so that whether the motor is rotationally driven in any direction can be easily understood.

The hammer 41 collides with the anvil 46 at a time when the rotating speed of the motor 3 reaches a maximum speed (arrow 86*c*). Due to this collision, significant large fastening torque 89*a* is generated compared to fastening torques (88*a*, 88*b*) to be generated in the pulse mode (1). When collision is performed in this way, the rotation number of the motor 3 decreases so as to reach arrow 86*d* from arrow 86*c*. In addition, the control of stopping a driving signal to the motor 3 at the moment when the collision shown by arrow 89*a* is detected may be performed. In that case, if a fastening subject is a bolt, a nut, etc., the recoil transmitted to the user's hand after striking is little. By applying a driving current to the motor 3 as in the present embodiment even after collision, the reaction force to the user is small as compared to the drill mode, and is suitable for the operation in a middle load state. Thus, the fastening speed can be increased, and power consumption can be reduced as compared to a strong pulse mode. Thereafter, similarly, fastening with strong fastening torque is performed by repeating "pause→reverse rotation driving→pause (stop)→normal rotation driving" by a given number of times, and the motor 3 is stopped to complete the fastening operation as the user releases a trigger operation at time $T_7$. In addition to the release of the trigger operation by the user, the motor 3 may be stopped when the computing unit 51 determines that fastening with set fastening torque is completed based on the output of the striking impact detecting sensor 56 (refer to FIG. 5).

As described above, in the present embodiment, rotational driving is performed in the drill mode in an initial stage of fastening where only small fastening torque is required, fastening is performed in the impact mode (1) by intermittent driving of only normal rotation as the fastening torque becomes large, and fastening is strongly performed in the impact mode (2) by intermittent driving by the normal rotation and reverse rotation of the motor 3, in the final stage of fastening. In addition, driving may be performed using the impact mode (1) and the impact mode (2). The control of proceeding directly to the impact mode (2) from the drill mode without providing the impact mode (1) is also possible. Since the normal rotation and reverse rotation of the motor are alternately performed in the impact mode (2), fastening speed becomes significantly slower than that in the drill mode or impact mode (1). When the fastening speed becomes abruptly slow in this way, the sense of discomfort when transiting to the striking operation becomes large compared to an impact tool which has a conventional rotation striking mechanism. Thus, in the shifting to the impact mode (2) from the drill mode, an operation feeling becomes a natural feeling by interposing the impact mode (1) therebetween. For example, by performing fastening in the drill mode or impact mode (1) as much as possible, fastening operation time can be shortened.

Figure 12:
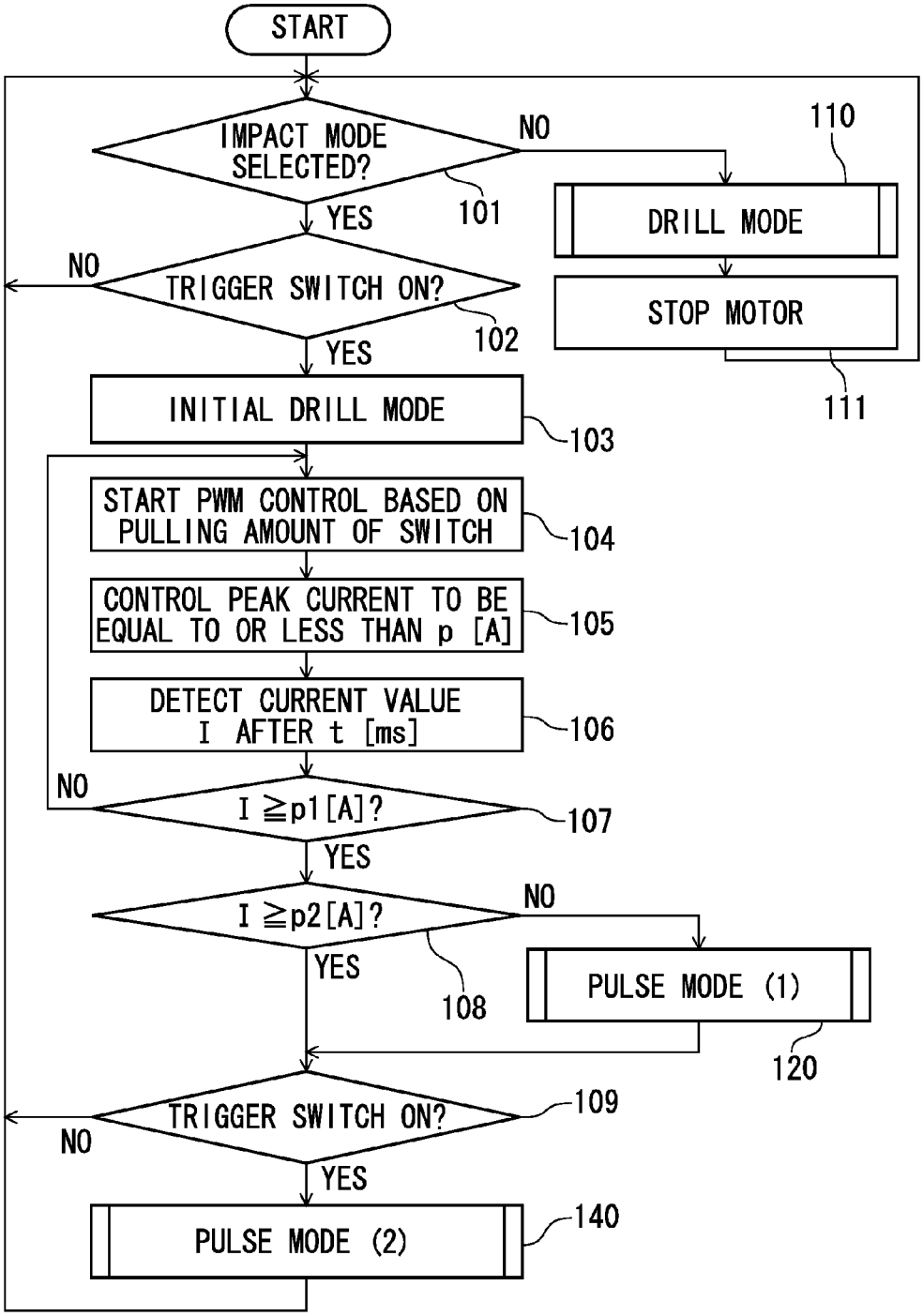
FIG. 12 illustrates a driving control procedure of the motor 3 related to the embodiment.

Next, the control procedure of the impact tool 1 related to the embodiment will be described with reference to FIG. 12 to FIG. 16. FIG. 12 illustrates the control procedure of the impact tool 1 related to the embodiment. The impact tool 1 determines whether or not the impact mode is selected using the toggle switch 32 (refer to FIG. 2) prior to start of the operation by the user (Step 101). If the impact mode is selected, the process proceeds to Step 102, and if the impact mode is not selected, that is, in the case of a normal drill mode, the process proceeds to Step 110.

In the impact mode, the computing unit 51 determines whether or not the trigger switch 8 is turned on. If the trigger switch is turned on (the trigger operating portion 8*a* is pulled), as shown in FIG. 11, the motor 3 is started by the drill mode (Step 103), and the PWM control of the inverter circuit 52 is started according to the pulling amount of the trigger operating portion 8*a* (Step 104). Then, the rotation of the motor 3 is accelerated while performing a control so that a peak current to be supplied to the motor 3 does not exceed an upper limit p. Next, the value I of a current to be supplied to the motor 3 after t milliseconds have elapsed after starting is detected using the output of the current detecting circuit 59 (refer to FIG. 5). If the detected current value I does not exceed p1 ampere, the process returns to Step 104, and if the current value has exceeded p1 ampere, the process proceeds to Step 108 (Step 107). Next, it is determined whether or not the detected current value I exceeds p2 ampere (Step 108).

Figure 14:
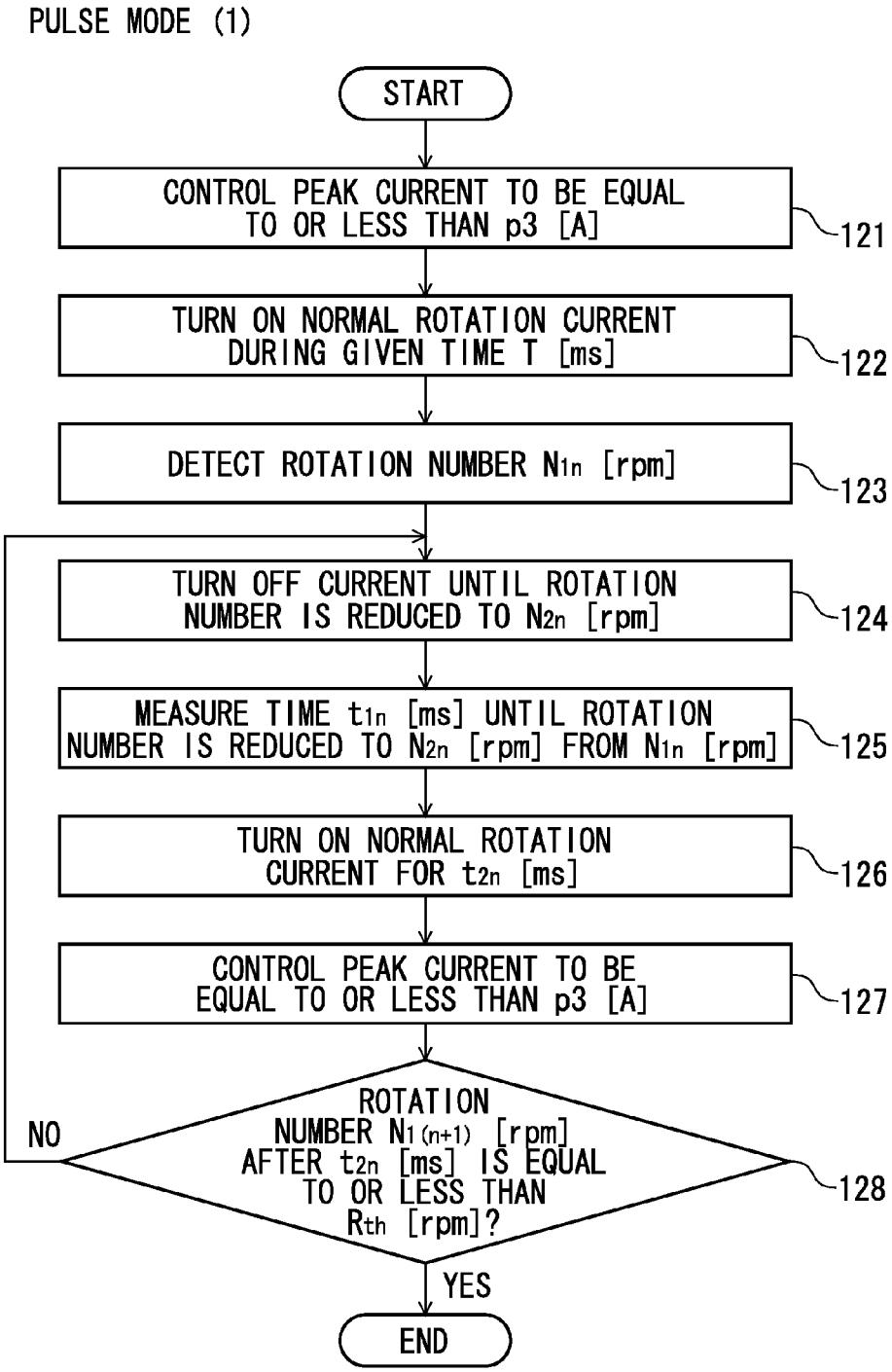
FIG. 14 illustrates the driving control procedure of the motor in a pulse mode (1) related to the embodiment.
Figure 16:
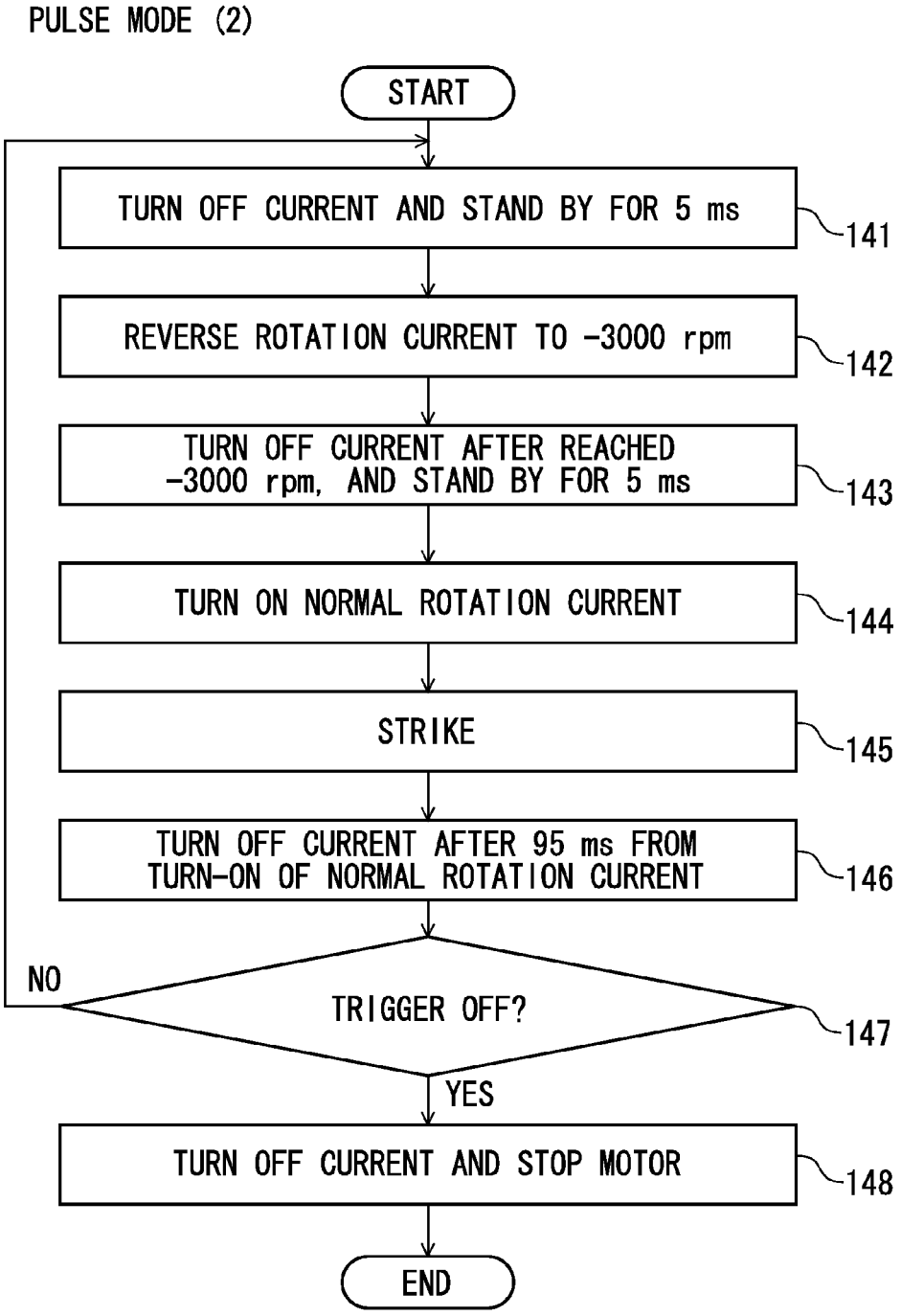
FIG. 16 illustrates the driving control procedure of the motor 3 in the pulse mode (2) related to the embodiment.

If the detected current value I does not exceed p2 [A] in Step 108, that is, if the relationship of $p1<I<p2$ is satisfied, the process proceeds to Step 109 (Step 120) after the procedure of the pulse mode (1) shown in FIG. 14 is executed. Then, if the detected current value I exceeds p2 [A], the process proceeds directly to Step 109, without executing the procedure of the pulse mode (1). In Step 109, it is determined whether or not the trigger switch 8 is set to ON. If the trigger switch is turned off, the processing returns to Step 101. If the ON state is continued, the processing returns to Step 101 after the procedure of the pulse mode (2) shown in FIG. 16 is executed.

If the drill mode is selected in Step 101, the drill mode 110 is executed, but the control of the drill mode is the same as the control of Steps 102 to 107. Then, by detecting a control current in an electronic clutch or an overcurrent state immediately before the motor 3 is locked as p1 of Step 107, thereby stopping the motor 3 (Step 111), the drill mode is ended, and the processing returns to Step 101.

Figure 13:
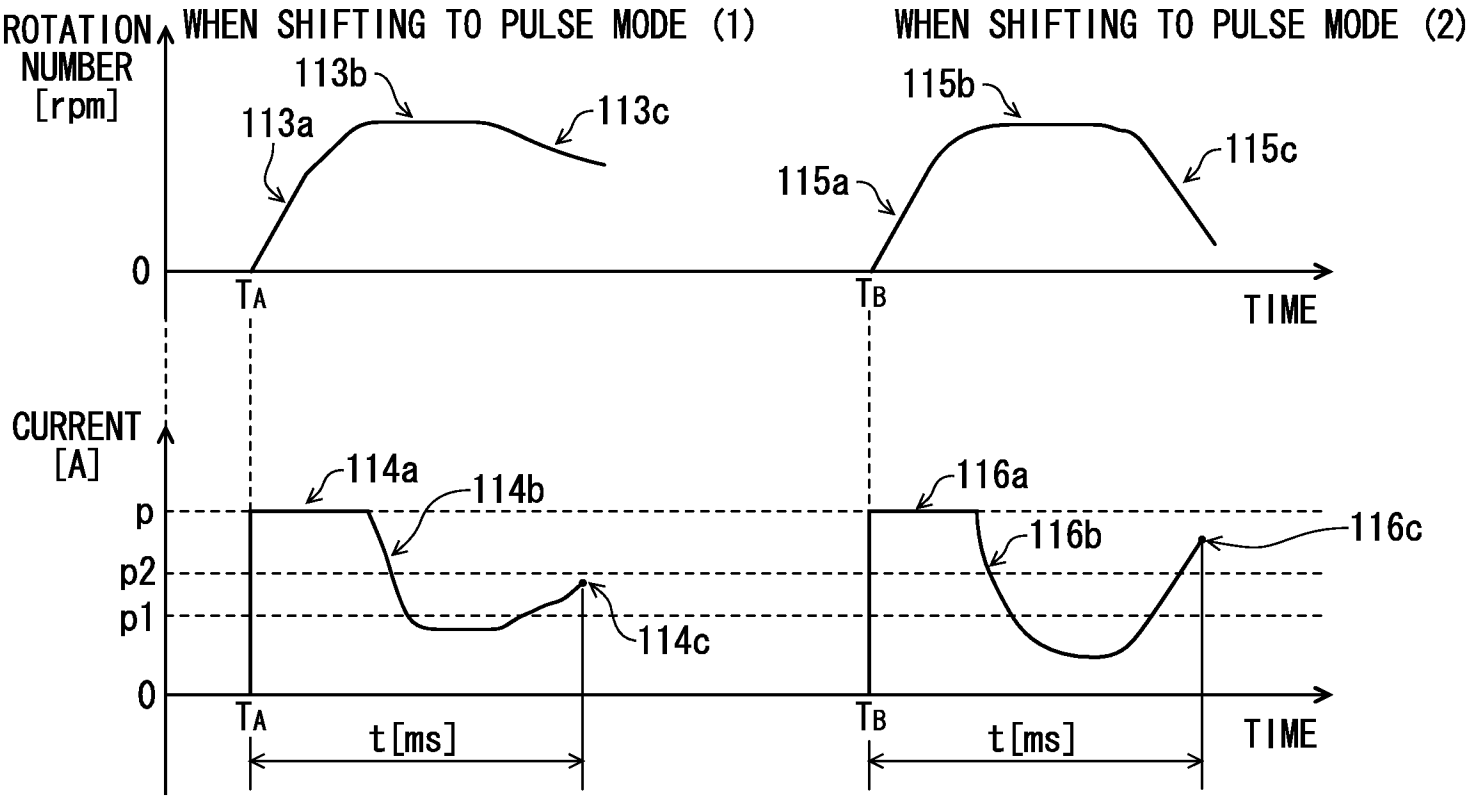
FIG. 13 illustrates graphs showing a current to be applied to the motor and the rotation number in a pulse mode (1) and a pulse mode (2).

The determination procedure of the mode shifting in Steps 107 and 108 will be described with reference to FIG. 13. An upper graph shows the relationship between elapsed time and the rotation number of the motor 3, a lower graph shows the relationship between a current value to be supplied to the motor 3, and time, and the time axes of the upper and lower graphs are made the same. In the left graph, when the trigger switch is pulled at time $T_A$ (equivalent to Step 102 of FIG. 12), the motor 3 is started and accelerated as shown by arrow 113*a*. During this acceleration, a constant current control in a state where the maximum current value p is limited as shown by arrow 114*a* is performed. When the rotation number of the motor 3 reaches a given rotation number (arrow 113*b*), a current during acceleration becomes a usual current as shown by arrow 114*b*. Therefore, the current value decreases. Thereafter, when the reaction force received from a fastening member increases as fastening of a screw, a bolt, etc. proceeds, the rotation number of the motor 3 decreases gradually as shown by arrow 113*c*, and the value of a current to be supplied to the motor 3 increases. Then, the current value is determined after t milliseconds have elapsed from the starting of the motor 3. If the relationship of $p1<I<p2$ is satisfied as shown by arrow 114*c*, the process shifts to the control of the pulse mode (1) which will be described later, as shown in Step 120.

In the right graph, when the trigger switch is pulled at time $T_B$ (equivalent to Step 102 of FIG. 12), the motor 3 is started and accelerated as shown by arrow 115*a*. During this acceleration, a constant current control in a state where the maximum current value p is limited as shown by arrow 116*a* is performed. When the rotation number of the motor 3 reaches a given rotation number (arrow 115*b*), a current during acceleration becomes a usual current as shown by arrow 116*b*. Therefore, the current value decreases. Thereafter, when the reaction force received from a fastening member increases as fastening of a screw, a bolt, etc. proceeds, the rotation number of the motor 3 decreases gradually as shown by arrow 115*c*, and the value of a current to be supplied to the motor 3 increases. In this example, the reaction force received from a fastening member increased rapidly. Therefore, as shown by arrow 116*c*, decrease of the rotation number of the motor 3 is large, and the rising degree of the current value is large. Then, since the current value after t milliseconds have elapsed from the starting of the motor 3 satisfies the relationship of $p2<I$ as shown by arrow 116*c*, the process shifts to the control of the pulse mode (2) shown in FIG. 16 as shown in Step 140.

Usually, in the fastening operation of a screw, a bolt, etc., required that fastening torque is not often constant due to variation in the machining accuracy of a screw or a bolt, the state of a fastening subject member, variation in materials, such as knots, grain, etc. of timber. Therefore, fastening may be performed at a stroke until immediately before completion of the fastening only by the drill mode. In such a case, when fastening in the impact mode (1) is skipped, and shifting to the fastening by the drill mode (2) with a higher fastening torque is made, the fastening operation can be efficiently completed in a short time.

Next, the control procedure of the impact tool in the pulse mode (1) will be described with reference to FIG. 14. If the process has shifted to the pulse mode (1), the peak current is first limited to equal to or less than p3 ampere (Step 121) after a given pause period, and the motor 3 is rotated by supplying a normal rotation current to the motor 3 during a given time, i.e., T milliseconds (Step 122). Next, the rotation number $N_{1n}$ [rpm] of the motor 3 after time T milliseconds have elapsed is detected (n=1, 2, . . . ) (Step 123). Next, a driving current to be supplied to the motor 3 is turned off, and the time $t_{1n}$ which is required until the rotation number of the motor 3 is lowered to $N_{2n}$ ($=N_{1n}/2$) from $N_{1n}$ is measured. Next, $t_{2n}$ is obtained from $t_{2n}=X-t_{1n}$, a normal rotation current is applied to the motor 3 during a period of this $t_{2n}$ (Step 126), and the peak current is suppressed to equal to or less than p3 ampere, thereby accelerating the motor 3. Next, it is determined whether or not the rotation number $N_{1(n+1)}$ of the motor 3 is equal to or less than a threshold rotation number $R_{th}$ for shifting to the pulse mode (2) after the elapse of the time $t_{2n}$. If the rotation number of the motor is equal to or less than $R_{th}$, the processing of the pulse mode (1) is ended, the processing returns to Step 120 of FIG. 12, and if the rotation number of the motor is equal to or more than $R_{th}$, the processing returns to Step 124 (Step 128).

Figure 15:
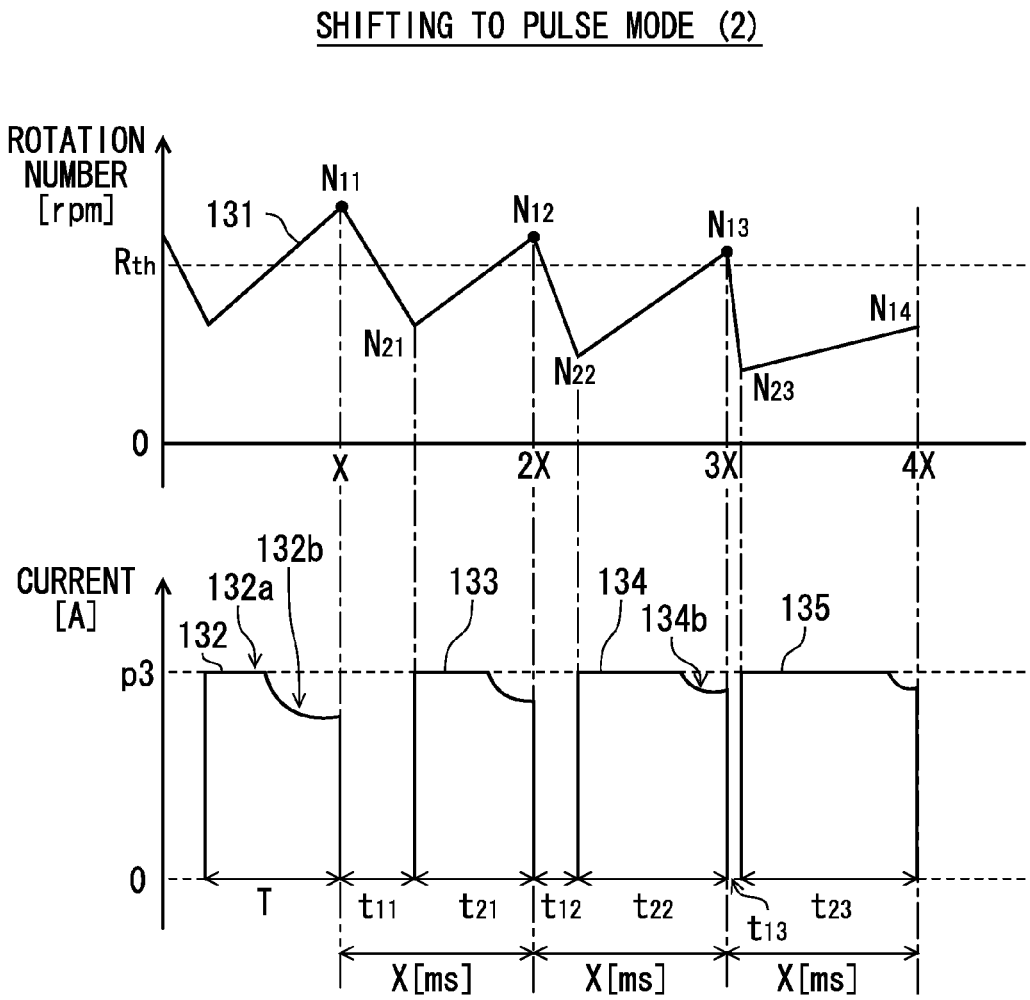
FIG. 15 illustrates the relationship between the rotation number of the motor 3 and elapsed time and the relationship between the value of a current to be supplied to the motor 3 and elapsed time.

FIG. 15 illustrates the relationship between the rotation number of the motor 3 and elapsed time and the relationship between a current to be supplied to the motor 3 and elapsed time while the control procedure illustrated in FIG. 14 is executed. A driving current 132 is first supplied to the motor 3 by time T. Since the driving current limits the peak current to equal to or less than p3 ampere, the current during acceleration is limited as shown by arrow 132*a*, and thereafter, the current value decreases as shown by arrow 132*b* as the rotation number of the motor 3 increases. At time $T_1$, when it is measured that the rotation number of the motor 3 has reached $N_{11}$, the rotation number $N_{21}$ which starts the rotation of the motor 3 from $N_{21}=N_{11}/2$ is calculated by calculation. The rotation number $N_{11}$ is, for example, 10,000 rpm. When the rotation number of the motor 3 decreases to $N_{21}$, a driving current 133 is supplied, and the motor 3 is accelerated again. Time $t_{2n}$ during which the driving current 133 is applied is determined by $t_{2n}=X-t_{1n}$. Similarly, although the same control is performed at times 2× and 3×, the rising degree of the rotation number of the motor 3 decreases as the fastening reaction force becomes large, and the rotation number $N_{14}$ will become equal to or less than the threshold rotation value $R_{th}$ at time 4×. At this time, the processing of the pulse mode (1) is ended, and the process shifts to the processing of the pulse mode (2).

Next, the control procedure of the impact tool in the pulse mode (2) will be described with reference to FIG. 16. First, a driving current to be supplied to the motor 3 is turned off, and standby is performed for 5 milliseconds (Step 141). Next, a reverse rotation current is supplied to the motor 3 so as to rotate the motor at −3000 rpm (Step 142). The 'minus' means that the motor 3 is rotated in a direction reverse to the rotation direction under operation at 3000 rpm. Next, if the rotation number of the motor 3 has reached −3000 rpm, a current to be supplied to the motor 3 is turned off, and standby is performed for 5 milliseconds (Step 143). The reason why standby is performed for 5 milliseconds is because there is a possibility that the main body of the impact tool may be shaken when the motor 3 is reversely rotated suddenly in a reverse direction. Further, this is also because there is no consumption of electric power during this standby, and thus, energy saving can be achieved. Next, a normal rotation current is turned on in order to rotate the motor 3 in the normal rotation direction (Step 144). A current to be supplied to the motor 3 is turned off 95 milliseconds after the normal rotation current is turned on. However, strong fastening torque is generated in the tip tool as the hammer 41 collides with (strikes) the anvil 46 before this current is turned off, (Step 145). Thereafter, it is detected whether or not the ON state of the trigger switch is maintained. If the trigger switch is in an OFF state, the rotation of a motor 3 is stopped, the processing of the pulse mode (2) is ended, and the processing returns to Step 140 of FIG. 12 (Steps 147 and 148). In Step 147, if the trigger switch 8 is in an ON state, the processing returns to Step 141 (Step 147).

As described above, according to the present embodiment, a fastening member can be efficiently fastened by performing continuous rotation, intermittent rotation only in the normal direction, and intermittent rotation in the normal direction and in the reverse direction for the motor using the hammer and the anvil between which the relative rotation angle is less than one rotation. Further, since the hammer and the anvil can be made into a simple structure, miniaturization and cost reduction of the impact tool can be realized.

Although the invention has been described hitherto based on the shown embodiments, the invention is not limited to the above-described embodiments and can be variously changed without departing from the spirit or scope thereof. For example, a brushless DC motor is exemplified as the motor in the present embodiment, the invention is not limited thereto, and other kinds of motor which can be driven in the normal direction and in the reverse direction may be used.

Further, the shape of the anvil and the hammer is arbitrary. It is only necessary to provide a structure in which the anvil and the hammer cannot continuously rotate relative to each other (cannot rotate while riding over each other), secure a given relative rotation angle of less than 360 degrees, and form a striking-side surface and a struck-side surface. For example, the protruding portion of the hammer and the anvil may be constructed so as not to protrude axially but to protrude in the circumferential direction. Further, since the protruding portions of the hammer and the anvil are not necessarily only protruding portions which become convex to the outside, and have only to be able to form a striking-side surface and a struck-side surface in a given shape, the protruding portions may be protruding portions (that is, recesses) which protrude inside the hammer or the anvil. The striking-side surface and the struck-side surface are not necessarily limited to flat surfaces, and may be a curved shape or other shapes which form a striking-side surface or a struck-side surface well.

Hereinafter, an electronic pulse driver 1001 is exemplified as a power tool related to an embodiment will be described with reference to FIGS. 17 to 29. The electronic pulse driver 1001 shown in FIG. 17 includes a housing 1002, a motor 1003, a hammer portion 1004, an anvil portion 1005, and a switch mechanism 1006. The housing 1002 is made of resin, forms the outer shell of the electronic pulse driver 1001, and includes a substantially tubular trunk portion 1021, and a handle portion 1022 extending from a trunk portion.

Figure 17:
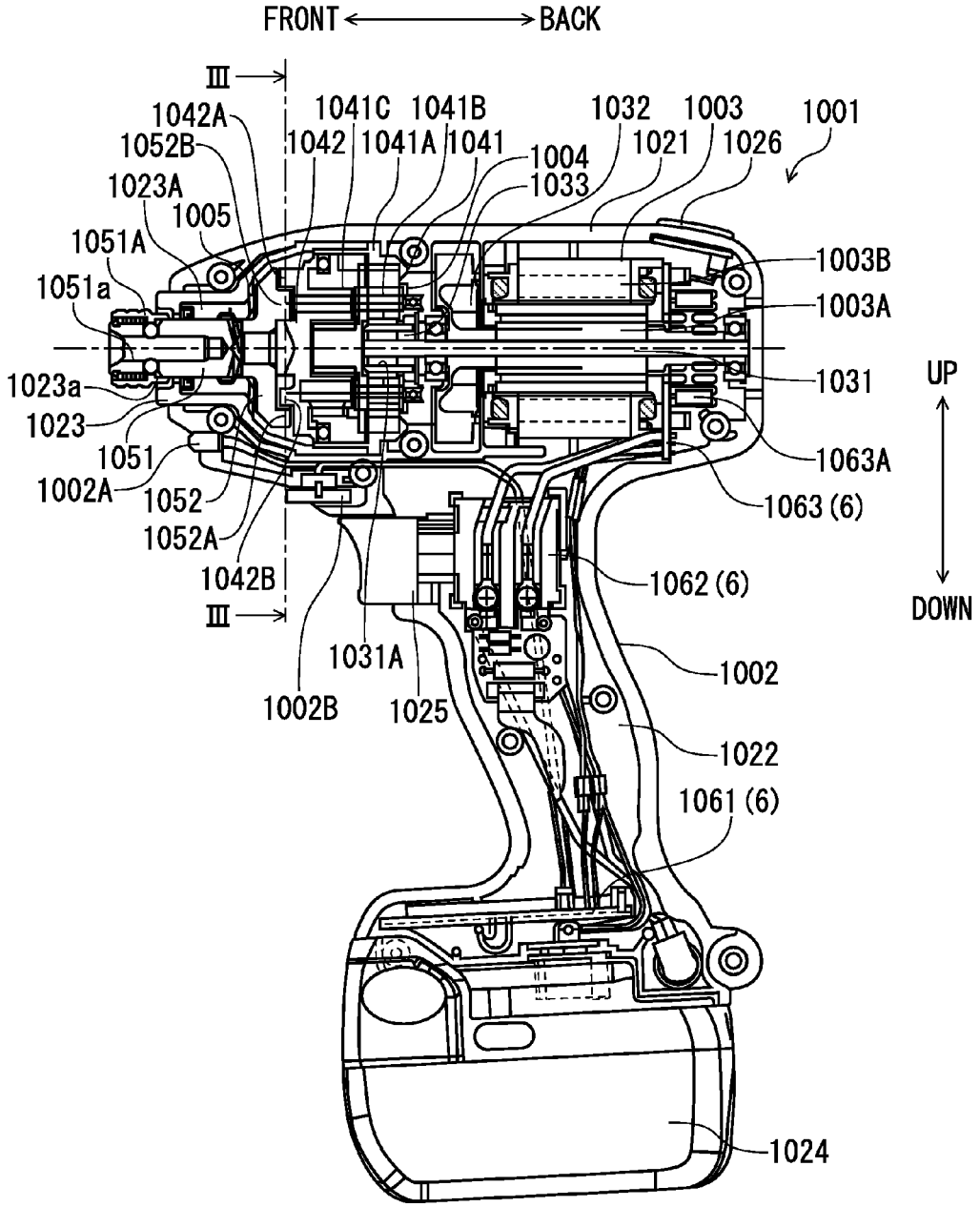
FIG. 17 is a sectional view of an electronic pulse driver related to a third embodiment.

As shown in FIG. 17, within the trunk portion 1021, the motor 1003 is arranged so that the longitudinal direction thereof coincides with the axial direction of the motor 1003, and the hammer portion 1004 and the anvil portion 1005 are aligned toward one axial end of the motor 1003. In the following description, a direction parallel to the axial direction of the motor 1003 is defined as a front-back direction with a direction toward the hammer portion 1004 and the anvil portion 1005 from the motor 1003 as the front side. Additionally, an up-down direction is defined with a direction in which the handle portion 1022 extends from a trunk portion 1021 as the lower side, and a direction orthogonal to the front-back direction is defined as a right-left direction.

A hammer case 1023 in which the hammer portion 1004 and the anvil portion 1005 are built is arranged at a front-side position within the trunk portion 1021. The hammer case 1023 is made of metal, is formed substantially in the shape of a funnel whose diameter becomes gradually smaller as it goes to the front, and is arranged so that a funnel-shaped tip faces the front side. A front end portion of the hammer case is formed with an opening 1023*a* through which a tip tool mounting portion 1051 which will be described later protrudes to the front side, and a metal 1023A which supports the anvil portion 1005 rotatably is provided at the inner wall which defines the opening 1023*a*.

In the trunk portion 1021, a light 1002A is held at a position near the opening 1023*a* and at a lower position of the hammer case 1023. The light 1002A is constructed so as to be capable of irradiating around a front end of a bit which is a tip tool which is not shown when the bit is mounted on the tip tool mounting portion 1051 which will be described later. Additionally, in the trunk portion 1021, a dial plate 1002B which is a switching portion is arranged in a rotationally operable manner at the lower position of the light 1002A. Because of the structure in which the light 1002A is held by the trunk portion 1021, there is no particular need to provide a member holding the light 1002A separately, and the light 1002A can be reliably held with a simple construction. Additionally, the light 1002A and dial plate 1002B are arranged substantially at the middle position of the trunk portion 1021, respectively, in the right-left direction. Additionally, the trunk portion 1021 is formed with an intake port and an exhaust port (not shown) through which ambient air is sucked into or exhausted from the trunk portion 1021 by a fan 1032 which will be described later.

The handle portion 1022 extends toward the lower side from the middle position of the trunk portion 1021 in the front-back direction, and is formed integrally with the trunk portion 1021. A switch mechanism 1006 is built inside the handle portion 1022, and a battery 1024 which supplies electric power to the motor 1003 is detachably mounted on the tip position of the switch mechanism in the extension direction. In the handle portion 1022, a trigger 1025 which is operated by a worker is provided at a front-side position in a root portion from the trunk portion 1021. Additionally, the position where the trigger 1025 is provided is a position near the dial plate 1002B below the aforementioned dial plate 1002B. Hence, the trigger 1025 and the dial plate 1002B can be operated with one finger, respectively. In addition, a drill mode, a clutch mode, and a pulse mode which will be described later can be switched by rotating the dial plate 1002B.

A display unit 1026 is arranged at an upper portion of the trunk portion 1021 on the rear side thereof. The display unit 1026 displays which mode is selected among the drill mode, clutch mode, and pulse mode which will be described later.

As shown in FIG. 17, the motor 1003 is a brushless motor including a rotor 1003A having an output shaft portion 1031, and a stator 1003B arranged at a position which faces the rotor 1003A, and is arranged within the trunk portion 1021 so that the axial direction of the output shaft portion 1031 coincides with the front-back direction. The output shaft portion 1031 protrudes forward or backward from the rotor 1003A, and is rotatably supported on the trunk portion 1021 by bearings in the protruding places thereof. In the output shaft portion 1031, the fan 1032 which rotates coaxially and integrally with the output shaft portion 1031 rotates is provided in a place where the output shaft portion protrudes to the front side. A pinion gear 1031A is provided so as to rotate coaxially and integrally with the output shaft portion 1031 at a foremost end position in the place where the output shaft portion protrudes to the front side.

The hammer portion 1004 includes a gear mechanism 1041 and a hammer 1042, and is arranged so as to be built within the hammer case 1023 on the front side of the motor 1003. The gear mechanism 1041 includes two planetary gear mechanisms 1041B and 1041C which share one outer gear 1041A. The outer gear 1041A is built within the hammer case 1023, and is fixed to the trunk portion 1021. One planetary gear mechanism 1041B is arranged within the outer gear 1041A so as to mesh with the outer gear 1041A, and the pinion gear 1031A is used as a sun gear. The other planetary gear mechanisms 1041C is arranged on the front side of the one planetary gear mechanism 1041B within the outer gear 1041A so as to mesh with the outer gear 1041A, and an output shaft of the one planetary gear mechanism 1041B is used as a sun gear.

Figure 19:
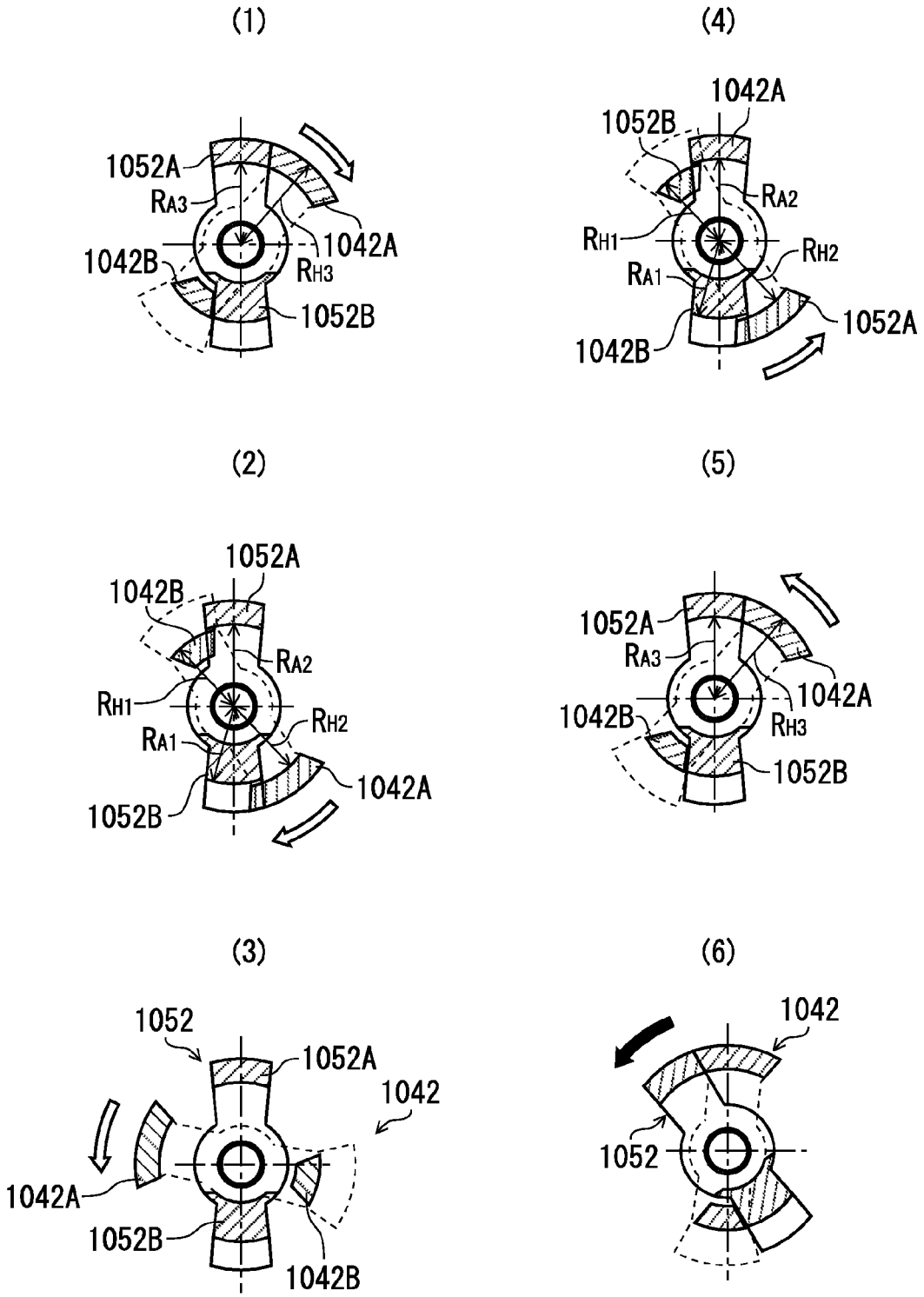
FIG. 19 illustrates the operating state of a hammer and an anvil of the electronic pulse driver related to the third embodiment.

The hammer 1042 is defined on the front surface of a planetary carrier of the planetary gear mechanism 1041C, and has a first engaging projection 1042A which protrudes toward the front side and is arranged at a position which has deviated from the rotation center of the planetary carrier of the planetary gear mechanism 1041C, and a second engaging projection 1042B which is located opposite to the first engaging projection 1042A across the rotation center of the planetary carrier of the planetary gear mechanism 1041C (FIG. 19).

The anvil portion 1005 includes the tip tool mounting portion 1051 and the anvil 1052, and is arranged in front of the hammer portion 1004. The tip tool mounting portion 1051 is cylindrically constructed, and is rotatably supported via the metal 1023A within the opening 1023*a* of the hammer case 1023. Additionally, the tip tool mounting portion 1051 has a drilled hole 1051*a* which is drilled toward the rear from the front end, and allows a bit (not shown) to be inserted thereinto, and has a chuck 1051A which holds the bit (not shown) at a front end portion.

The anvil 1052 is formed integrally with the tip tool mounting portion 1051 so as to be located within the hammer case 1023 behind the tip tool mounting portion 1051, and has a first engaged projection 1052A which protrudes toward the rear side, and is arranged at a position which has deviated from the rotation center of the tip tool mounting portion 1051, and a second engaged projection 1052B which is located opposite to the first engaged projection across the rotation center of the tip tool mounting portion 1051. When the hammer 1042 rotates, the first engaging projection 1042A and the first engaged projection 1052A collide with each other, and simultaneously, the torque of the hammer 1042 is transmitted to the anvil 1052 as the second engaging projection 1042B and the second engaged projection 1052B collide with each other. The detailed operation will be described later.

The switch mechanism 1006 includes a board 1061, a trigger switch 1062, a switching board 1063, and wiring lines which connect these. The board 1061 is arranged at a position near the battery 1024 within the handle portion 1022, is connected to the battery 1024, and is connected to the light 1002A, the dial plate 1002B, the trigger switch 1062, the switching board 1063, and the display unit 1026.

Figure 18:
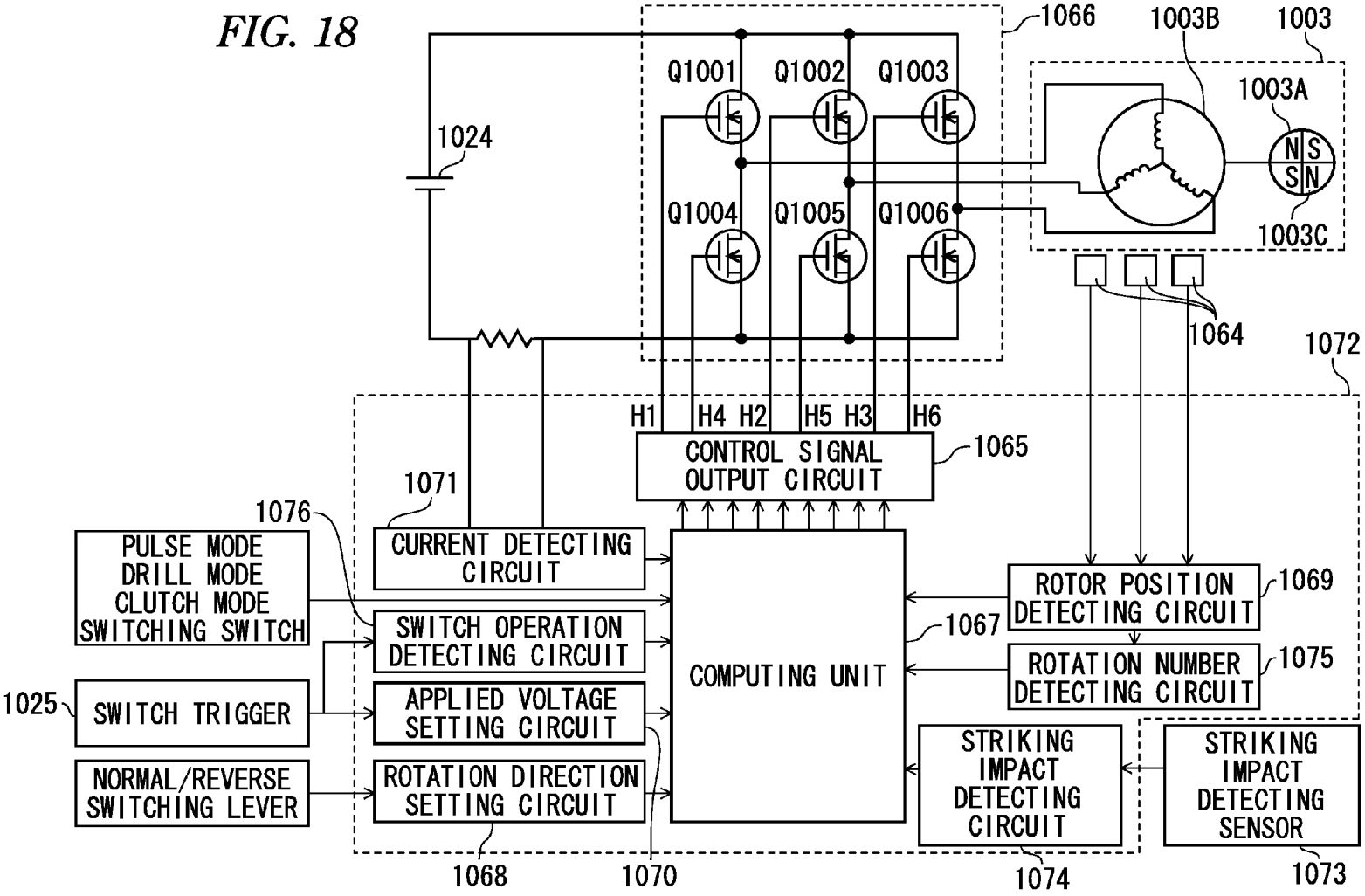
FIG. 18 is a control block diagram of the electronic pulse driver related to the third embodiment.

Next, the construction of a driving control system of a motor 1003 will be described with reference to FIG. 18. In the present embodiment, the motor 1003 includes a three-phase brushless DC motor. The rotor 1003A of this brushless DC motor including permanent magnets including plural (two sets in the present embodiment) N-S poles sets, and the stator 1003B includes three-phase stator wirings U, V, and W which are star-wired. In order to detect the rotational position of the rotor 1003A, rotational position detecting elements (Hall elements) 1064 are arranged at predetermined intervals, for example, at every 60-degrees angle in the circumferential direction of the rotor 1003A on the board 1061. Based on position detection signals from the rotational position detecting elements 1064, the energizing direction and time to the stator windings U, V, and W are controlled, and the motor 1003 rotates. The rotational position detecting elements 1064 are provided at positions which face the permanent magnets 1003C of the rotor 1003A on the switching board 1063.

Electronic elements to be loaded on the switching board 1063 include six switching elements Q1001 to Q1006, such as FET, which are connected in the form of a three-phase bridge. Respective gates of the six switching elements Q1001 to Q1006 which are bridge-connected are connected to a control signal output circuit 1065 loaded on the board 1061, and respective drains or respective sources of the six switching elements Q1001 to Q1006 are connected to the stator windings U, V, and W which are star-wired. Thereby, the six switching elements Q1001 to Q1006 perform switching operations by switching element driving signals (driving signals, such as H4, H5, and H6) input from the control signal output circuit 1065, and supply electric power to the stator windings U, V, and W with the direct current voltage of the battery 1024 to be applied to the inverter circuit 1066 being three-phase voltages (U phase, V phase, and W phase) Vu, Vv, and Vw.

Among switching elements driving signals (three-phase signals) which drive the respective gates of the six switching elements Q1001 to Q1006, driving signals for the three negative power supply side switching elements Q1004, Q1005, and Q1006 are supplied as pulse width modulation signals (PWM signals) H4, H5, and H6, and the pulse width (duty ratio) of the PWM signals is changed by the computing unit 1067 loaded on the board 1061 Based on a detection signal of the operation amount (stroke) of the trigger 1025, whereby the amount of electric power supplied to the motor 1003 is adjusted, and the start/stop and rotating speed of the motor 1003 are controlled.

Here, PWM signals are supplied to either the positive power supply side switching elements Q1001 to Q1003 or the negative power supply side switching elements Q1004 to Q1006 of the inverter circuit 1066, and the electric power to be supplied to the stator windings U, V, and W from the direct current voltage of the battery 1024 is controlled by switching the switching elements Q1001 to Q1003 or the switching elements Q1004 to Q1006 at high speed. In addition, PWM signals are supplied to the negative power supply side switching elements Q1004 to Q1006. Therefore, the rotating speed of the motor 1003 can be controlled by controlling the pulse width of the PWM signals, thereby adjusting the electric power to be supplied to each of the stator windings U, V, and W.

The control unit 1072 is carried on the board 1061, and has a control signal output circuit 1065, a computing unit 1067, a current detecting circuit 1071, a switch operation detecting circuit 1076, an applied voltage setting circuit 1070, a rotational direction setting circuit 1068, a rotor position detecting circuit 1069, a rotation number detecting circuit 1075, and a striking impact detecting circuit 1074. The computing unit 1067 includes a central processing unit (CPU) for outputting a driving signal Based on a processing program and data, a ROM for storing a processing program or control data, and a RAM for temporarily storing data, a timer, etc., although not shown. The computing unit 1067 forms a driving signal for alternately switching predetermined switching elements Q1001 to Q1006 Based on output signals of the rotational direction setting circuit 1068 and the rotor position detecting circuit 1069, and outputs the control signal to the control signal output circuit 1065. This alternately energizes a predetermined winding wire of the stator windings U, V, and W, and rotates the rotor 1003A in a set rotational direction. In this case, driving signals to be applied to the negative power supply side switching elements Q1004 to Q1006 are output as PWM modulating signals Based on an output control signal of the applied voltage setting circuit 1070. The value of a current to be supplied to the motor 1003 is measured by the current detecting circuit 1071, and is adjusted so as to become set driving electric power as the value of the current is fed back to the computing unit 1067. In addition, the PWM signals may be applied to the positive power supply side switching elements Q1001 to Q1003.

The electronic pulse driver 1001 is provided with a normal/reverse switching lever (not shown) for switching the rotational direction of the motor 1003. Whenever the rotational direction setting circuit 1068 detects the change of the normal/reverse switching lever (not shown), the lever switches the rotational direction of the motor 1003 to transmit the control signal thereof to the computing unit 1067. A striking impact detecting sensor 1073 which detects the magnitude of the impact generated in the anvil 1052 is connected to the control unit 1072, and the output thereof is input to the computing unit 1067 via the striking impact detecting circuit 1074.

FIG. 19 is a sectional view seen from the direction III in FIG. 17, and illustrates the positional relationship between the hammer 1042 and the anvil 1052 during the operation of the electronic pulse driver 1001. FIG. 19(1) shows a state where the first engaging projection 1042A and the first engaged projection 1052A come in contact with each other, and simultaneously the second engaging projection 1042B and the second engaged projection 1052B come in contact with each other. The external diameter RH3 of the first engaging projection 1042A and the external diameter RA3 of the first engaged projection 1052A are made equal to each other. From this state, the hammer 1042 rotates in a clockwise direction of FIG. 19, and is brought into a state shown in FIG. 19(2). Since the internal diameter RH2 of the first engaging projection 1042A is made greater than the external diameter RA1 of the second engaged projection 1052B, the first engaging projection 1042A and the second engaged projection 1052B do not come into contact with each other. Similarly, since the external diameter RH1 of the second engaging projection 1042B is made smaller than the internal diameter RA2 of the first engaged projection 1052A, the second engaging projection 1042B and the first engaged projection 1052A do not come into contact with each other. Then, when the hammer 1042 rotates to a position shown in FIG. 19(3), the motor 1003 starts reverse rotation, and the hammer 1042 rotates in the counterclockwise direction. At the position shown in FIG. 19(3), the hammer 1042 is brought into a state where the hammer 1042 has reversely rotated to a maximum reversal position with respect to the anvil 1052. Through the normal rotation of the motor 1003, the hammer 1042 operates as shown in FIG. 19(5) via a state shown in FIG. 19(4) such that the first engaging projection 1042A and the first engaged projection 1052A collide with each other, and simultaneously the second engaging projection 1042B and second engaged projection 1052B collide with each other. Through the impact at the time of this collision, as shown in FIG. 19(6), the anvil 1052 rotates in the counterclockwise direction.

As described above, two engaging projections provided on the hammer 1042 collide with two engaging projections provided on the anvil 1052 at positions symmetrical with respect to the rotating axial center. By such a construction, the balance at the time of striking is stabilized, and a worker can be made to be hardly shaken by the electronic pulse driver 1001 at the time of striking.

Additionally, since the internal diameter RH2 of the first engaging projection 1042A is made greater than the external diameter RA1 of the second engaged projection 1052B, and the external diameter RH1 of the second engaging projection 1042B is made smaller than the internal diameter RA2 of the first engaged projection 1052A, the relative rotation angle between the hammer 1042 and the anvil 1052 can be made greater than 180 degrees. Thereby, a sufficient reversal angle and acceleration distance of the hammer 1042 with respect to the anvil 1052 can be secured.

Additionally, the first engaging projection 1042A and the second engaging projection 1042B are able to collide with the first engaged projection 1052A and the second engaged projection 1052B at both ends in the circumferential direction. Therefore, an impact operation is possible not only during normal rotation but also during reverse rotation. Thus, an easy-to-use impact tool can be provided. Additionally, when the anvil 1052 is struck by the hammer 1042, the anvil 1052 is not struck in the axial direction (forward). Thus, the tip tool is prevented from being pressed against a member to be worked, which is an advantage when fastening a wood screw into timber.

Next, operation modes which can be used in the electronic pulse driver according to the present embodiment will be described with reference to FIGS. 20 to 25. The electronic pulse driver according to the present embodiment has three operation modes including a drill mode, a clutch mode, and a pulse mode.

Figure 20:
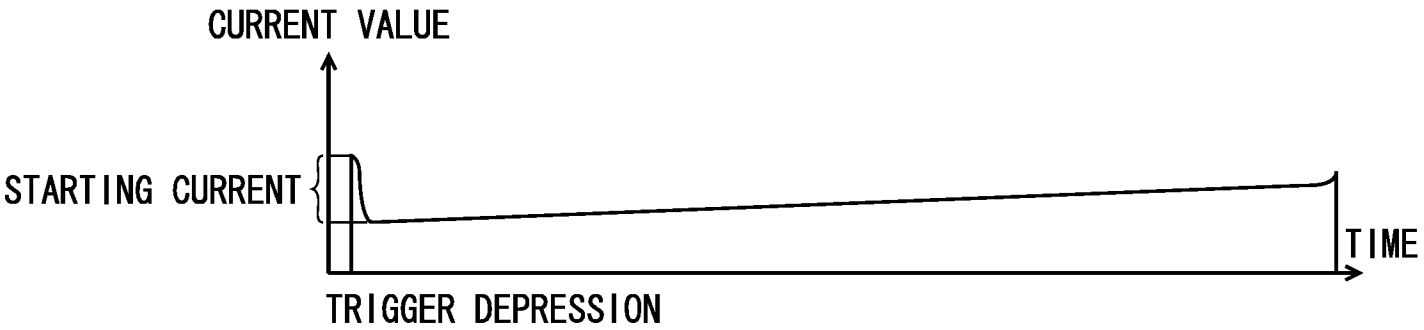
FIG. 20 illustrates a control in a drill mode of the electronic pulse driver related to the third embodiment.

The drill mode is a mode in which the hammer 1042 and the anvil 1052 are integrally rotated, and is used mainly in a case where a wood screw is fastened. An electric current which flows into the motor 1003 increases as fastening proceeds as shown in FIG. 20.

Figure 21:
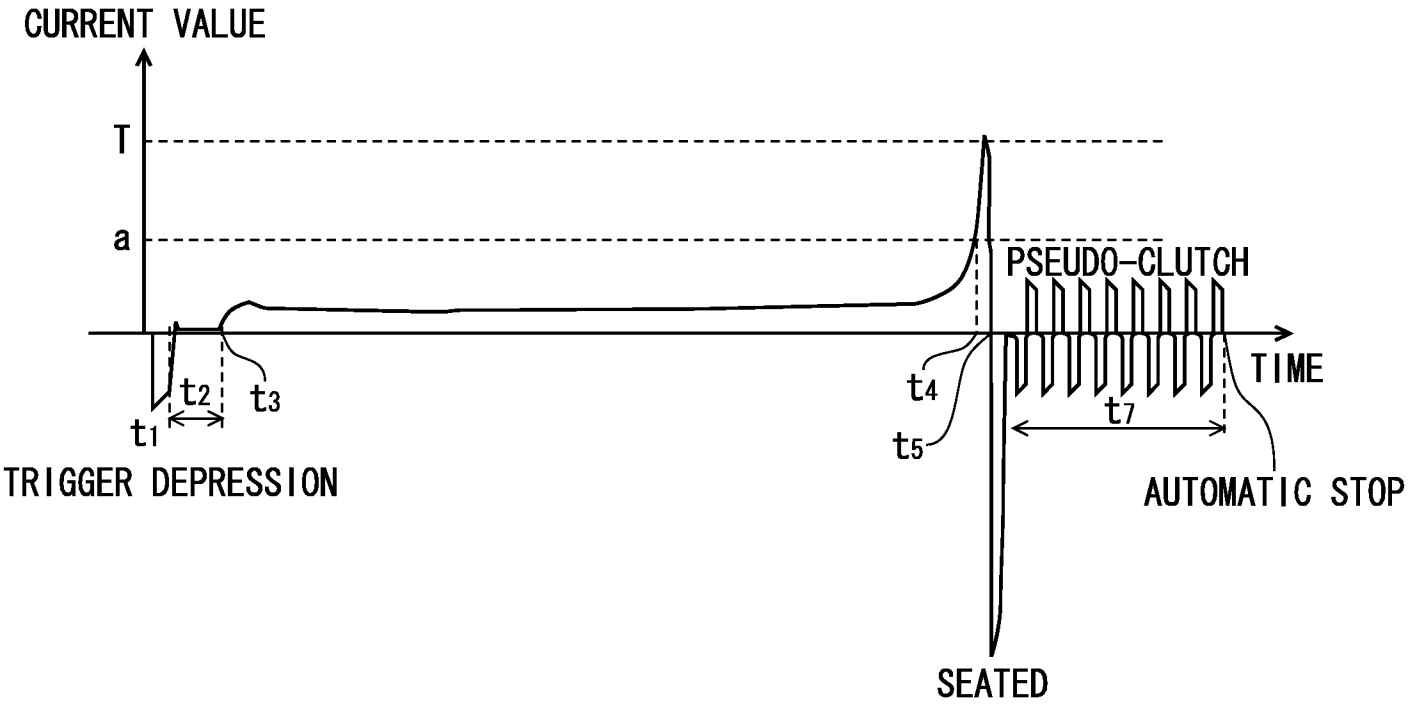
FIG. 21 illustrates a control when a bolt is fastened in a clutch mode of the electronic pulse driver related to the third embodiment.
Figure 22:
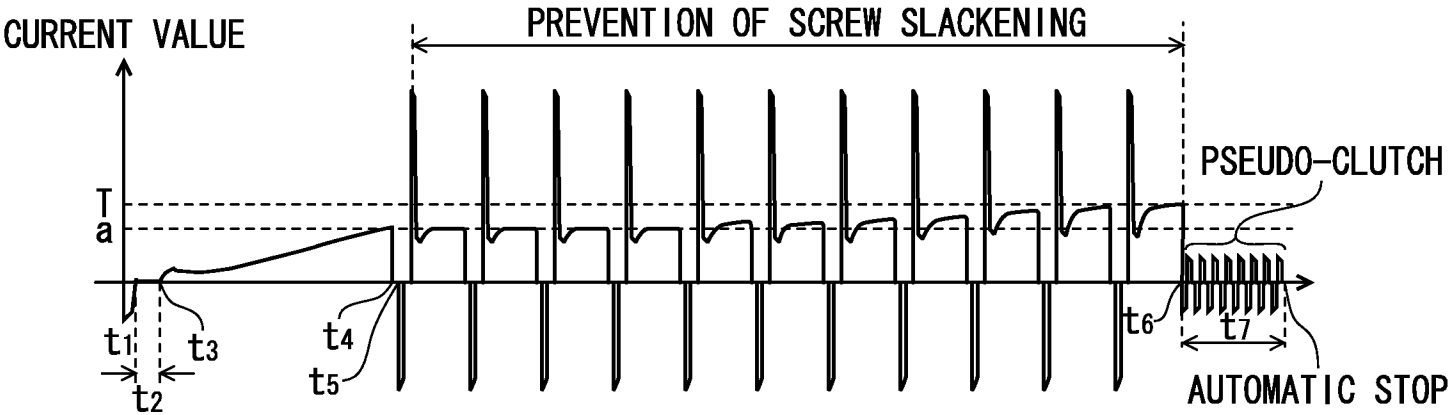
FIG. 22 illustrates a control when a wood screw is fastened in the clutch mode of the electronic pulse driver related to the third embodiment.

The clutch mode, as shown in FIGS. 21 and 22, is a mode in which driving of the motor 1003 is stopped in a case where an electric current which flows into the motor 1003 in a state where the hammer 1042 and the anvil 1052 have been integrally rotated has increased to a target value (target torque), and is mainly used in a case where importance is placed on fastening with an accurate torque, such as a case where a fastener which is outwardly visible after fastening is fastened. In addition, although described later, in the clutch mode, the motor 1003 is reversely rotated for generation of a pseudo-clutch, and when a wood screw is fastened, the motor 1003 is reversely rotated for prevention of screw slackening (refer to FIG. 22).

Figure 23:
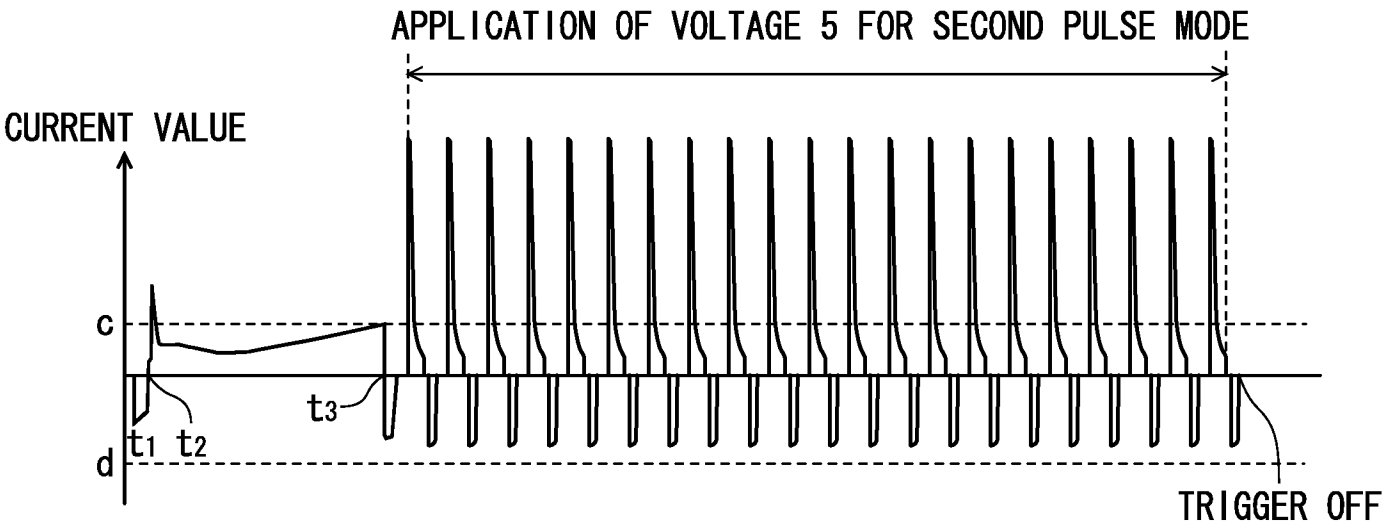
FIG. 23 illustrates a control when a bolt is fastened in a pulse mode of the electronic pulse driver related to the third embodiment.
Figure 24:
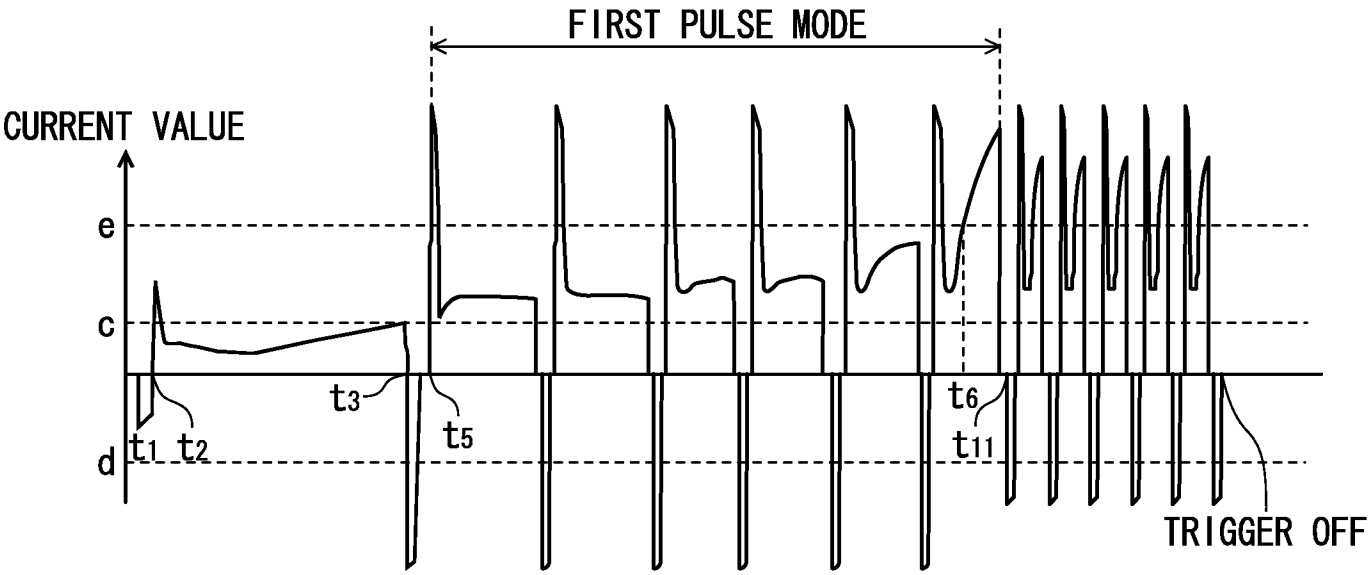
FIG. 24 illustrates a control in a case where shifting to a second pulse mode is not carried out when a wood screw is fastened in the pulse mode of the electronic pulse driver related to the third embodiment.
Figure 25:
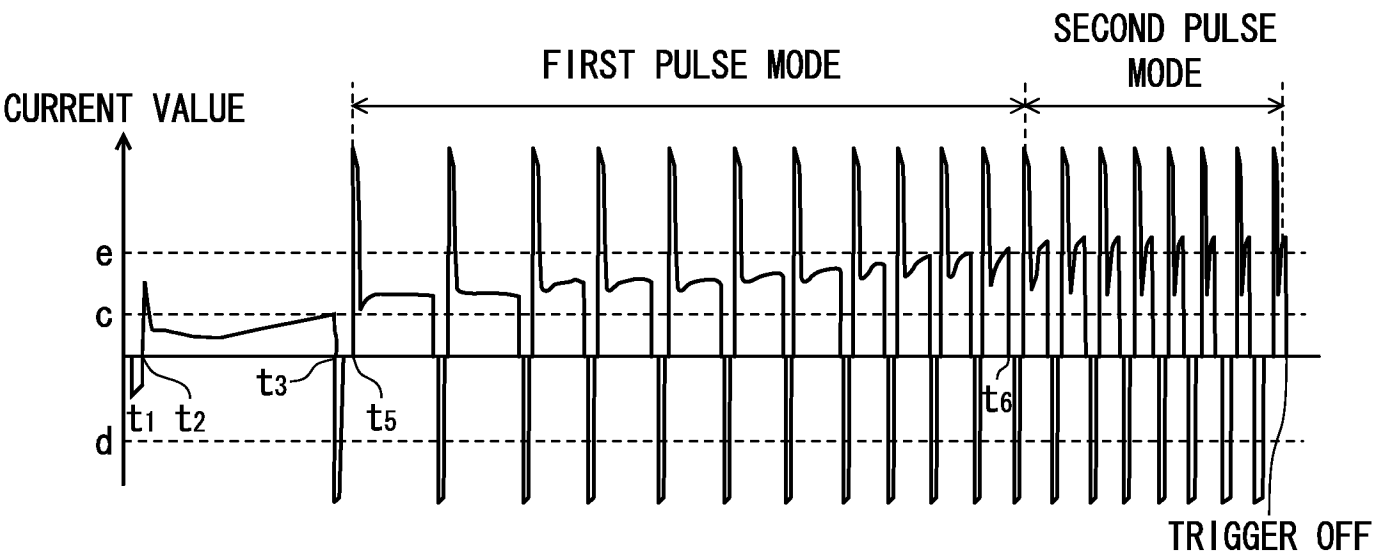
FIG. 25 illustrates a control in a case where shifting to the second pulse mode is carried out when a wood screw is fastened in the pulse mode of the electronic pulse driver related to the third embodiment.

The pulse mode, as shown in FIGS. 23 to 25, is a mode in which the normal rotation and reverse rotation of the motor 1003 are alternately switched and a fastener is fastened by striking in a case where an electric current which flows into the motor 1003 in a state where the hammer 1042 and the anvil 1052 have been integrally rotated has increased to a predetermined value (predetermined torque), and is mainly used in, for example, a case where a long screw is fastened at a place where the screw is not outwardly visible. Thereby, a powerful fastening force can be supplied, and simultaneously, a repulsive force from a member to be worked can be reduced.

Next, the control by the control unit 1072 when the electronic pulse driver according to the present embodiment performs a fastening work will be described. In addition, since a special control is not performed regarding the drill mode, the description thereof is omitted. Additionally, in the following description, a starting current will not be taken into consideration in the determination based on an electric current. Additionally, an abrupt increase in the value of an electric current when an electric current for normal rotation has been imparted will also not be taken into consideration. This is because, for example, an abrupt increase in the value of an electric current when a normal rotation current as shown in FIGS. 22 to 25 is imparted does not contribute to screw or bolt fastening. By providing a dead time of, for example, about 20 ms, it is possible to avoid taking into consideration this abrupt increase in the value of an electric current.

First, a case where the operation mode is set to the clutch mode will be described with reference to FIGS. 21, 22, and 26.

Figure 26:
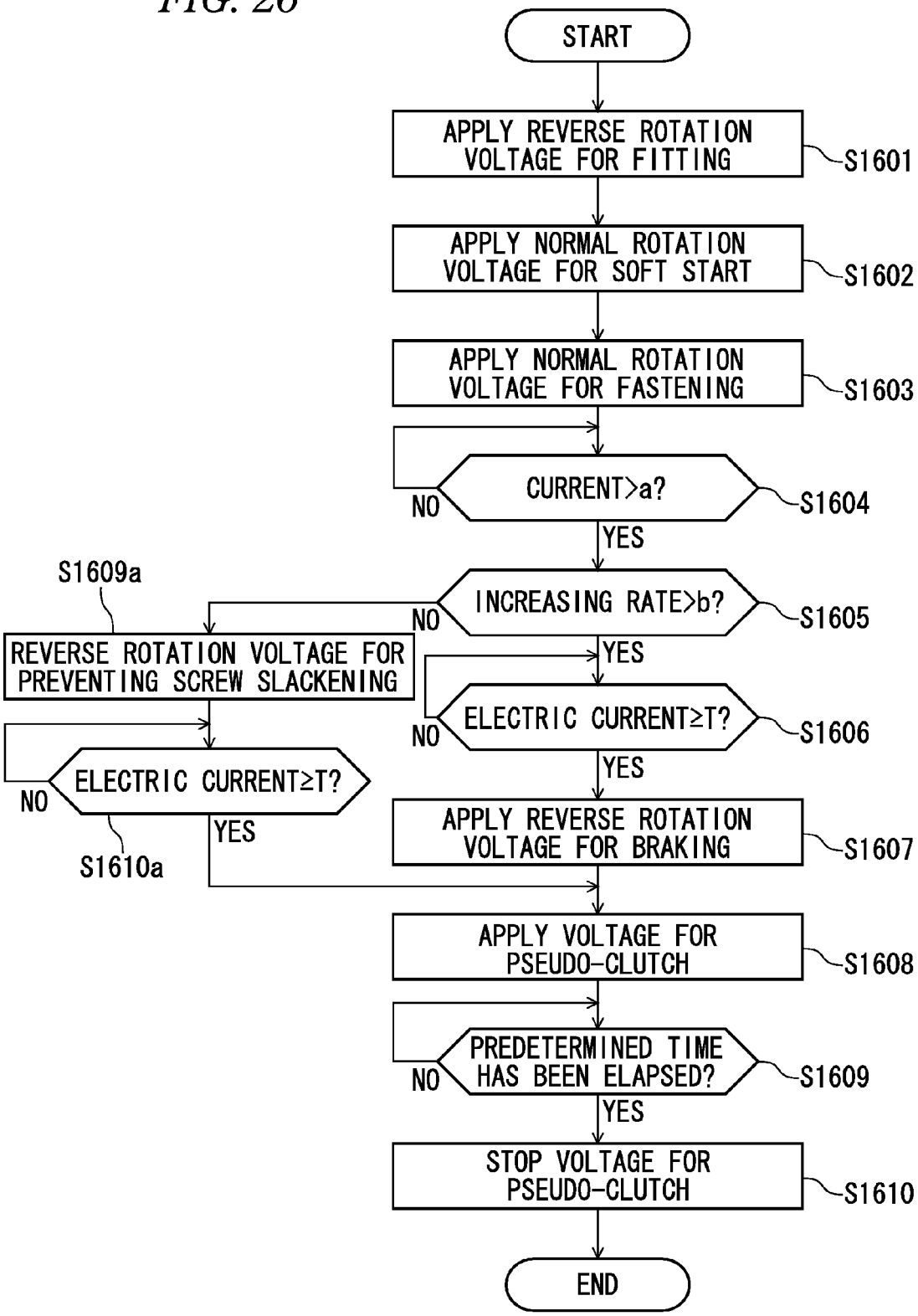
FIG. 26 is a flow chart when a fastener is fastened in the clutch mode of the electronic pulse driver related to the third embodiment.

FIG. 21 illustrates a control when a fastener (hereinafter, bolt), such as a bolt, is fastened in the clutch mode, FIG. 22 illustrates a control when a fastener (hereinafter, a wood screw), such as a wood screw, is fastened in the clutch mode, and FIG. 26 is a flow chart when a fastener is fastened in the clutch mode.

The flow chart of FIG. 26 is started by pulling a trigger, and the fastening work is completed by determining that a target torque has been reached in a case where an electric current which flows into the motor 1003 has increased to a target current value T (refer to FIGS. 21 and 22), in the clutch mode according to the present embodiment.

When the trigger is pulled, the control unit 1072 first applies a reverse rotation voltage for fitting to the motor 1003, thereby reversing the hammer 1042 to make the hammer collide with the anvil 1052 lightly ($t_1$ of FIGS. 21 and 22, and S1601 of FIG. 26). In the present embodiment, the reverse rotation voltage for fitting is set to 5.5 V, and the reverse rotation voltage application time for fitting is set to 200 ms. This makes it possible to make the fastener and the tip tool fit to each other reliably.

When the trigger has been pulled, there is a possibility that the hammer 1042 and the anvil 1052 are separated from each other. In that state, when an electric current flows into the motor 1003, striking is applied to the anvil 1052 by the hammer 1042. Meanwhile, the clutch mode is a mode in which driving of the motor 1003 is stopped in a case where an electric current which flows into the motor 1003 in a state where the hammer 1042 and the anvil 1052 have been integrally rotated has increased to a target value (target torque). In this case, when striking may be applied to the anvil 1052, the torque which exceeds the target value may be supplied to the fastener simply by the striking. Particularly when the increased fastening of fastening a screw or the like which has been fastened again is performed, such a problem becomes conspicuous.

Accordingly, in the clutch mode, subsequently to S1601, a normal rotation voltage for pre-start is applied to the motor 1003 during a first period in order to bring the hammer 1042 into contact with the anvil 1052 without rotating the anvil 1052 (pre-start) ($t_2$ of FIGS. 21 and 22, and S1602 of FIG. 26). In the present embodiment, the normal rotation voltage for pre-start is set to 1.5 V, and the normal rotation voltage application time for pre-start is set to 800 ms. Additionally, in the present embodiment, there is a possibility that the hammer 1042 and the anvil 1052 are separated from each other by about 315 degrees. Thus, the first period is set to a period which is taken in order for the hammer 1042 to be rotated 315 degrees by the motor 1003 to which the normal rotation voltage for pre-start has been applied.

Subsequently, a normal rotation voltage for fastening the fastener is applied to the motor 1003 ($t_3$ of FIGS. 21 and 22, and S1603 of FIG. 26), and it is determined whether or not an electric current which flows into the motor 1003 became greater than a threshold value a (S1604). In the present embodiment, the normal rotation voltage for fastening is set to 14.4 V, and the threshold value a is a current value in the final stage of wood screw fastening within a range where screw slackening does not occur, and is set to 15 A in the present embodiment.

If an electric current which flows into the motor 1003 is greater than the threshold value a ($t_4$ of FIG. 21 and FIG. 22, and S1604: YES of FIG. 26), it is determined whether or not the increasing rate of the electric current is greater than a threshold value b (S1605). The increasing rate of the electric current can be computed according to $(A(Tr+t)-A(Tr))/A(Tr)$, for example, as in the case of FIG. 21. t represents the elapsed time from a certain point of time Tr. Additionally, the increasing rate of the electric current can be computed according to (A(N+1)−A(N))/A(N), as in the case of FIG. 22. N is a maximum value of an electric current in the load of a specific normal rotation current, and N+1 is a maximum value of an electric current in the load of the normal rotation current next to the specific normal rotation current. For example, in the case of FIG. 22, the threshold value b of (A(N+1)−A(N))/A(N) is set to 20%.

Generally, if a bolt is fastened, as shown in FIG. 21, an electric current, which flows into the motor 1003, abruptly increases in the final stage of fastening. In contrast, in a case where a wood screw is fastened, as shown in FIG. 22, the electric current gently increases.

Accordingly, the control unit 1072 determines that the fastener is a bolt if the increasing rate of the electric current when an electric current which flows into the motor 1003 becomes greater than the threshold value a is greater than the threshold value b, and determines that the fastener is a wood screw if the increasing rate is equal to or less than the threshold value b.

The fastener in a case where the increasing rate of the electric current is greater than the threshold value b is a bolt which does not need to take screw slackening into consideration. Therefore, when the value of the electric current has subsequently increased to the target current value T (t5 of FIG. 21, and S1606: YES of FIG. 26), the supply of torque to the bolt is stopped. However, as described above, the electric current abruptly increases in the case of the bolt. Therefore, there is a possibility that torque is imparted to the bolt by an inertial force, simply by stopping the application of a normal rotation voltage. Therefore, in the present embodiment, a reverse rotation voltage for braking is applied to the motor 1003 in order to stop the supply of the torque to the bolt, (t5 of FIG. 21, and S1607 of FIG. 26). In the present embodiment, the reverse rotation voltage application time for braking is set to 5 ms.

Subsequently, a normal rotation voltage and a reverse rotation voltage for a pseudo-clutch are alternately applied to the motor 1003 (t7 of FIGS. 21 and 22, and S1608 of FIG. 26). In the present embodiment, the normal rotation voltage and reverse rotation voltage application time for a pseudo-clutch are set to 1000 ms (1 second). Here, the pseudo-clutch means that, when a desired torque has been obtained as a predetermined current value is reached, a function to notify the worker of the event is provided. Although the output from the motor is not practically lost, a notification means which provides notification that the output from the motor is lost in a pseudo manner is provided.

When the reverse rotation voltage for a pseudo-clutch is applied, the hammer 1042 is separated from the anvil 1052, and when the normal rotation voltage for a pseudo-clutch is applied, the hammer 1042 strikes the anvil 1052. However, since the normal rotation voltage and reverse rotation voltage for a pseudo-clutch are set to such a voltage (for example, 2 V) that a fastening force is not applied to the fastener, a pseudo-clutch is only generated as a striking sound. Through the generation of this pseudo-clutch, a user is able to recognize the end of fastening.

On the other hand, since the fastener in a case where the increasing rate of the electric current is equal to or less than the threshold value b is a wood screw which needs to take screw slackening into consideration, a reverse rotation voltage for screw slackening is subsequently applied to the motor 1003 at predetermined intervals with respect to a voltage for fastening (t5 of FIG. 22, and S1609*a* of FIG. 26). The screw slackening means that, as the fitting between a cross-shaped concave portion provided in a screw head of a wood screw and a cross-shaped convex portion of a tip tool (bit) is released, the cross-shaped convex portion of the tip tool will be unevenly caught by the cross-shaped concave portion, and the cross-shaped concave portion will collapse. The anvil is reversely rotated by the application of the reverse rotation voltage for screw slackening. Through the reverse rotation of this anvil, the cross-shaped convex portion of the tip tool attached to the anvil, and the cross-shaped concave portion of the wood screw are fitted to each other firmly. In addition, the reverse rotation voltage for screw slackening is not for increasing the acceleration distance for imparting striking to the anvil 1052 from the hammer 1042, but for imparting reverse rotation to the anvil 1052 from the hammer 1042 to such a degree that the torque of reverse rotation is imparted to the screw from the anvil 1052. In the present embodiment, the reverse rotation voltage for screw slackening is set to a voltage of 14.4 V.

Then, when the electric current has increased to the target current value T (t6 of FIG. 22, and S1610*a*: YES of FIG. 26), the normal rotation voltage and reverse rotation voltage for a pseudo-clutch (hereinafter referred to as voltages for a pseudo-clutch) are alternately applied to the motor 1003, a pseudo-clutch is generated (t7 of FIG. 22, and S1608 of FIG. 26), and the end of fastening is notified to a user.

Finally, the application of the voltage for a pseudo-clutch is stopped after the elapse of a predetermined time (S1609: YES) from the application of the voltage for a pseudo-clutch (S1610).

Next, a case where the operation mode is set to the pulse mode will be described with reference to FIGS. 23 to 25, and FIG. 27.

Figure 27:
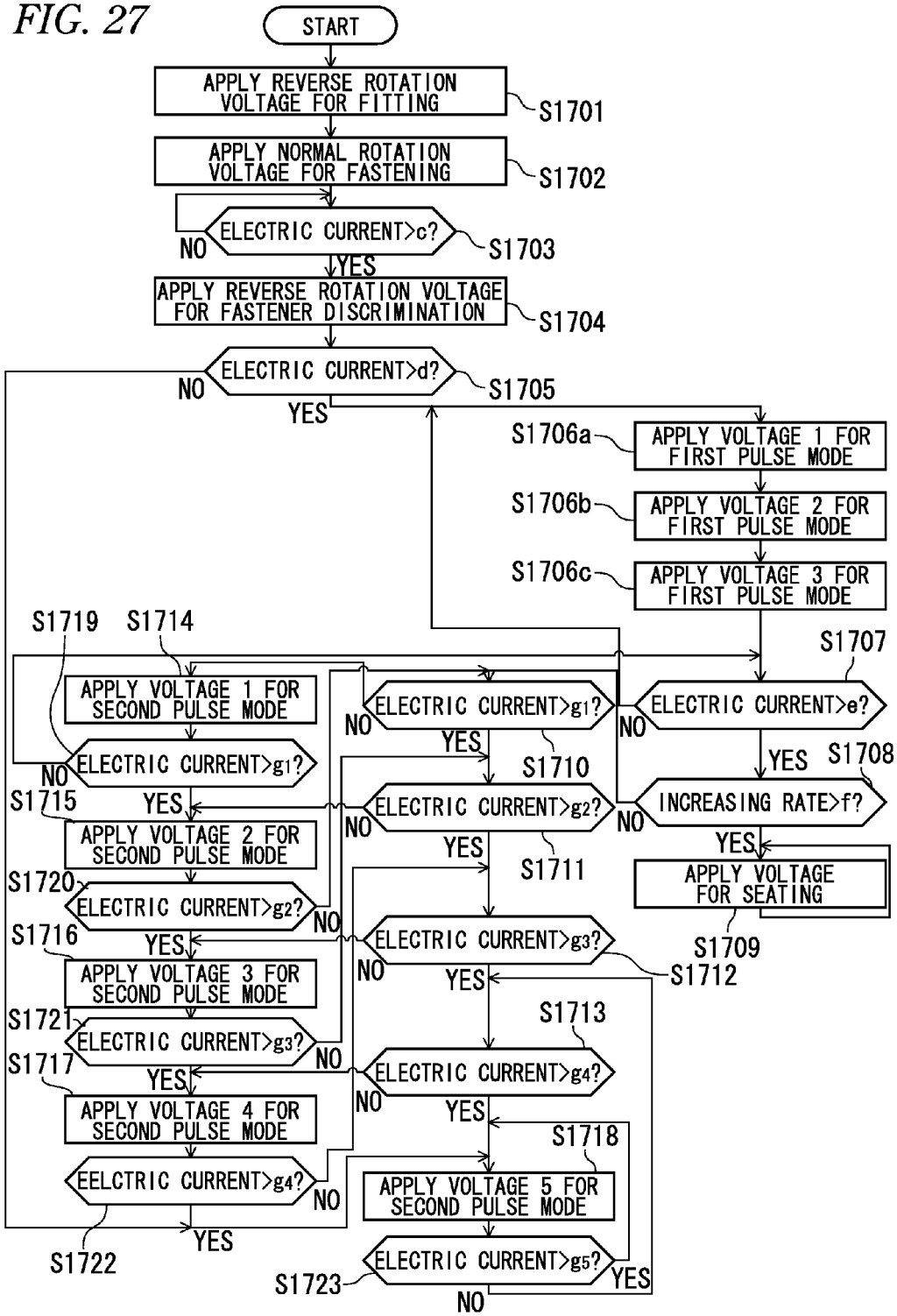
FIG. 27 is a flow chart when a fastener is fastened in the pulse mode of the electronic pulse driver related to the third embodiment.

FIG. 23 illustrates a control when a bolt is fastened in the pulse mode, FIG. 24 illustrates a control in a case where shifting to a second pulse mode which will be described later is not carried out when a wood screw is fastened in the pulse mode, FIG. 25 illustrates a control in a case where shifting to the second pulse mode which will be described later is carried out when a wood screw is fastened in the pulse mode, and FIG. 27 is a flow chart when a fastener is fastened in the pulse mode.

Additionally, the flow chart of FIG. 27 is also started by pulling a trigger, similarly to the clutch mode.

When the trigger is pulled, the control unit 1072 first applies the reverse rotation voltage for fitting to the motor 1003 similarly to the clutch mode ($t_1$ of FIGS. 23 to 25, and S1701 of FIG. 27). On the other hand, in the pulse mode, importance is not placed on fastening with accurate torque. Thus, a step equivalent to S1602 (pre-start) in the clutch mode is omitted.

Next, the same normal rotation voltage for fastening as that in the clutch mode is applied ($t_2$ of FIGS. 23 to 25, and S1702 of FIG. 27), and it is determined whether an electric current which flows into the motor 1003 has become greater than a threshold value c (S1703).

Here, in the case of a wood screw, the load (electric current) increases gradually from the beginning of fastening. In contrast, in the case of a bolt, the load increases only slightly at the beginning of fastening, and abruptly increases when the fastening has proceeded to some extent. When the load is applied in the case of a bolt, a reaction force received from fasteners which make a pair becomes greater than a reaction force received from a member to be worked in the case of a wood screw. Accordingly, in the case of a bolt, a force which is auxiliary for a reverse rotation voltage is received from the fasteners which make a pair. Therefore, when the reverse rotation voltage for a fastener is applied to the motor 1003, a reverse rotation current which has a smaller absolute value than that in the case of a wood screw flows into the motor 1003. In the present embodiment, an electric current near the start of an increase in the load in the case of a bolt (for example, 15 A) is set to the threshold value c.

If an electric current which flows into the motor 1003 has become greater than the threshold value c, a reverse rotation voltage for fastener discrimination is applied to the motor 1003 ($t_3$ of FIGS. 23 to 25, and S1704 of FIG. 27). The reverse rotation voltage for fastener discrimination is set to such a value (for example, 14.4V) that striking is not imparted to the anvil 1052 from the hammer 1042.

Then, the control unit 1072 determines whether or not the absolute value of an electric current which flows into the motor 1003 when the reverse rotation voltage for fastener discrimination is applied is greater than a threshold value d (S1705), discriminates that a wood screw is fastened if the absolute value is greater than the threshold value d (FIGS. 24 and 25), and that a bolt is fastened if the absolute value is equal to or less than the threshold value d (FIG. 23), and controls the motor 1003 so as to perform the striking fastening according to the fastener which has been discriminated. In the present embodiment, the threshold value d is set to 20 A.

In detail, striking fastening is performed by alternately applying a normal rotation voltage and a reverse rotation voltage to the motor 1003. In the present embodiment, however, a normal rotation voltage and a reverse rotation voltage are alternately applied to the motor 1003 so that a period (hereinafter referred to as a reverse rotation period) during which a reverse rotation voltage is applied with respect to a period (hereinafter referred to as a normal rotation period) during which a normal rotation voltage is applied increases in proportion to the magnitude of the load.

Additionally, in a case where the fastening by pressing becomes difficult, shifting to the fastening by striking is usual. However, it is preferable from the viewpoint of user comfort to perform the shifting gradually. Accordingly, in the present embodiment, striking fastening centered on pressing is performed in a first pulse mode, and striking fastening centered on striking is performed in a second pulse mode.

Specifically, in the first pulse mode, a pressing force is supplied to the fastener during a long normal rotation period. On the other hand, in the second pulse mode, the reverse rotation period increases gradually as the load becomes large, while striking power is supplied with the normal rotation period being gradually decreased. In addition, in the present embodiment, in the first pulse mode, in order to reduce the reaction force from a member to be worked, the normal rotation period is gradually decreased while the reverse rotation period remains constant as the load becomes large.

Returning to the flow chart of FIG. 27, shifting to the first pulse mode and the second pulse mode will be described.

First, shifting to the first pulse mode and second pulse mode if the absolute value of an electric current which flows into the motor 1003 is greater than the threshold value d (S1705: YES), i.e., if a wood screw is fastened will be described.

In this case, the control unit 1072 first applies a voltage for the first pulse mode to the motor 1003 in order to perform striking fastening centered on pressing (t5 of FIGS. 24 and 25, and S1706*a* to S1706*c* of FIG. 27). Specifically, pause (5 ms)→reverse rotation voltage (15 ms)→pause (5 ms)→normal rotation voltage (300 ms) which are equivalent to one set is applied to the motor 1003 (S1706*a*). After the elapse of a predetermined time, pause (5 ms)→reverse rotation voltage (15 ms)→pause (5 ms)→normal rotation voltage (200 ms) which are equivalent to one set is applied to the motor 1003 (S1706*b*). Further, after the elapse of a predetermined time, pause (5 ms)→reverse rotation voltage (15 ms)→pause (5 ms)→normal rotation voltage (100 ms) which are equivalent to one set is applied to the motor 1003 (S1706*c*).

Subsequently, the control unit 1072 determines whether or not an electric current which flows into the motor 1003 when the voltage for the first pulse mode is applied is greater than a threshold value e (S1707). The threshold value e is provided to discriminate whether or not shifting to the second pulse mode should be carried out, and is set to 75 A in the present embodiment.

If an electric current which flows into the motor 1003 when the voltage (normal rotation voltage) for the first pulse mode is applied is equal to or less than the threshold value e (S1707: NO), S1706*a* to S1707*c*, and S1707 are repeated. In addition, whenever the number of times by which the voltage for the first pulse mode is applied increases, the load becomes large, and the reaction force from a member to be worked becomes large. Therefore, in order to reduce the reaction force from a member to be worked, the voltage for the first pulse mode such that the normal rotation period decreases gradually while the reverse rotation period remains constant is applied. In the present embodiment, the normal rotation period is set so as to decrease such as 300 ms→200 ms→100 ms.

On the other hand, if an electric current which flows into the motor 1003 when the voltage (normal rotation voltage) for the first pulse mode is applied is greater than the threshold value e (t6 of FIGS. 24 and 25, and S1707: YES of FIG. 27), first, it is determined whether or not an increasing rate in an electric current caused by the voltage for the first pulse mode (normal rotation voltage) is greater than a threshold value f (S1708). The threshold value f is provided to discriminate whether or not a wood screw is seated on to a member to be worked, and is set to 4% in the present embodiment.

If the increasing rate in the electric current is greater than the threshold value f (S1708: YES of FIGS. 24 and 27), a wood screw is regarded as seated on a member to be worked. Therefore, in order to reduce a subsequent reaction force, a voltage for seating is applied to the motor 1003 ($t_{11}$ of FIG. 24, and S1709 of FIG. 27). In addition, the voltage for seating in the present embodiment is repeated with pause (5 ms)→reverse rotation voltage (15 ms)→pause (5 ms)→normal rotation voltage (40 ms) as one set.

On the other hand, if the increasing rate in the electric current is equal to or less than the threshold value f (S1708: NO), the load is high irrespective of the fact that a wood screw is not seated. Thus, the fastening force centered on the pressing force caused by the voltage for the first pulse mode is regarded to be insufficient. Accordingly, shifting to the second pulse mode will be carried out after that.

In the present embodiment, the second pulse mode is selected from voltages 1 to 5 for the second pulse mode. As for the voltages 1 to 5 for the second pulse mode, in this order, the reverse rotation period increases, while the normal rotation period decreases. Specifically, one set of pause (5 ms)→reverse rotation voltage (15 ms)→pause (5 ms)→normal rotation voltage (75 ms) is performed in the voltage 1 for the second pulse mode, one set of pause (7 ms)→reverse rotation voltage (18 ms)→pause (10 ms)→normal rotation voltage (65 ms) is performed in the voltage 2 for the second pulse mode, one set of pause (9 ms)→reverse rotation voltage (20 ms)→pause (12 ms)→normal rotation voltage (59 ms) is performed in the voltage 3 for the second pulse mode, one set of pause (11 ms)→reverse rotation voltage (23 ms)→pause (13 ms)→normal rotation voltage (53 ms) is performed in the voltage 4 for the second pulse mode, and one set of pause (15 ms)→reverse rotation voltage (25 ms)→pause (15 ms)→normal rotation voltage (45 ms) is performed in the voltage 5 for the second pulse mode.

First, if shifting to the second pulse mode has been determined in S1708 (S1708: NO), it is determined whether or not an electric current which flows into the motor 1003 when the normal rotation voltage of the voltage for the first pulse mode is applied (during falling) is greater than a threshold value $g_1$ (S1710). The threshold value $g_1$ is provided to discriminate whether or not a voltage for the second pulse mode which is higher than the voltage 1 for the second pulse mode should be applied to the motor 1003, and is set to 76 A in the present embodiment. In addition, in the following, an electric current which flows into the motor 1003 when the normal rotation voltage of each voltage for the pulse mode is applied is generically referred to as a reference current.

If the reference current is greater than the threshold value $g_1$ (S1710: YES), it is determined whether or not the electric current is greater than a threshold value $g_2$ (S1711). The threshold value $g_2$ is provided to discriminate whether or not a voltage for the second pulse mode which is higher than the voltage 2 for the second pulse mode should be applied to the motor 1003, and is set to 77 A in the present embodiment.

If the electric current is greater than the threshold value $g_2$ (S1711: YES), it is determined whether or not the electric current is greater than a threshold value $g_3$ (S1712). The threshold value $g_3$ is provided to discriminate whether or not a voltage for the second pulse mode which is higher than the voltage 3 for the second pulse mode should be applied to the motor 1003, and is set to 79 A in the present embodiment.

If the electric current is greater than the threshold value $g_3$ (S1712: YES), it is determined whether or not the electric current is greater than a threshold value $g_4$ (S1713). The threshold value $g_4$ is provided to discriminate whether or not a voltage for the second pulse mode which is higher than the voltage 4 for the second pulse mode should be applied to the motor 1003, and is set to 80 A in the present embodiment.

In the manner as described above, it is first determined which voltage for the second pulse mode should be applied to the motor 1003 Based on an electric current which flows into the motor 1003 when the voltage (normal rotation voltage) for the first pulse mode is applied, and subsequently, the determined voltage for the second pulse is applied to the motor 1003.

Specifically, if the electric current is equal to or less than the threshold value $g_1$ (S1710: NO), the voltage 1 for the second pulse mode is applied to the motor 1003 (S1714); if the electric current is greater than the threshold value $g_1$, and is equal to or less than the threshold value $g_2$ (S1711: NO), the voltage 2 for the second pulse mode is applied to the motor 1003 (S1715); if the electric current is greater than threshold value $g_2$, and is equal to or less than the threshold value $g_3$ (S1712: NO), the voltage 3 for the second pulse mode is applied to the motor 1003 (S1716); if the electric current is greater than the threshold value $g_3$, and is equal to or less than the threshold value $g_4$ (S1713: NO), the voltage 4 for the second pulse mode is applied to the motor 1003 (S1717); and if the electric current is greater than the threshold value 4 (S1713: YES), the voltage 5 for the second pulse modes is applied to the motor 1003 (S1718).

After the application (S1714) of the voltage 1 for the second pulse mode, it is subsequently determined whether or not an electric current which flows into the motor 1003 when the voltage 1 (normal rotation voltage) for the second pulse mode is applied is greater than the threshold value $g_1$ (S1719).

If the electric current is equal to or less than the threshold value $g_1$ (S1719: NO), the processing returns to S1707 where it is determined again which of the voltages for the first pulse mode and the voltage 1 for the second pulse mode should be applied to the motor 1003. On the other hand, if the electric current is greater than the threshold value $g_1$ (S1719: YES), the voltage 2 for the second pulse mode is applied to the motor 1003 (S1715).

After the application (S1715) of the voltage 2 for the second pulse mode, it is subsequently determined whether or not an electric current which flows into the motor 1003 when the voltage 2 (normal rotation voltage) for the second pulse mode is applied is greater than the threshold value $g_2$ (S1720).

If the electric current is equal to or less than the threshold value $g_2$ (S1720: NO), the processing returns to S1710 where it is determined again which of the voltage 1 for the second pulse mode and the voltage 2 for the second pulse mode should be applied to the motor 1003. On the other hand, if the electric current is greater than the threshold value $g_2$ (S1720: YES), the voltage 3 for the second pulse mode is applied to the motor 1003 (S1716).

After the application (S1716) of the voltage 3 for the second pulse mode, it is subsequently determined whether or not an electric current which flows into the motor 1003 when the voltage 3 (normal rotation voltage) for the second pulse mode is applied is greater than the threshold value $g_3$ (S1721).

If the electric current is equal to or less than the threshold value $g_3$ (S1721: NO), the processing returns to S1711 where it is determined again which of the voltage 2 for the second pulse mode and the voltage 3 for the second pulse mode should be applied to the motor 1003. If the electric current is greater than the threshold value $g_3$ (S1721: YES), the voltage 4 for the second pulse mode is applied to the motor 1003 (S1717).

After the application (S1717) of the voltage 4 for the second pulse mode, it is subsequently determined whether or not an electric current which flows into the motor 1003 when the voltage 4 (normal rotation voltage) for the second pulse mode is applied is greater than the threshold value $g_4$ (S1722).

If the electric current is equal to or less than the threshold value $g_4$ (S1722: NO), the processing returns to S1712 where it is determined again which of the voltage 3 for the second pulse mode and the voltage 4 for the second pulse mode should be applied to the motor 1003. If the electric current is greater than the threshold value $g_4$ (S1722: YES), the voltage 5 for the second pulse mode is applied to the motor 1003 (S1718).

After the application (S1718) of the voltage 5 for the second pulse mode, it is subsequently determined whether or not an electric current which flows into the motor 1003 when the voltage 5 (normal rotation voltage) for the second pulse mode is applied is greater than the threshold value $g_5$ (S1723). The threshold value $g_5$ is provided to discriminate whether or not the voltage 5 for the second pulse mode should be applied to the motor 1003, and is set to 82 A in the present embodiment.

If the electric current is equal to or less than the threshold value $g_5$ (S1723: NO), the processing returns to S1713 where it is determined again which of the voltage 4 for the second pulse mode and the voltage 5 for the second pulse mode should be applied to the motor 1003. If the electric current is greater than the threshold value $g_5$ (S1723: YES), the voltage 5 for the second pulse mode is applied to the motor 1003 (S1718).

On the other hand, if the absolute value of an electric current which flows into the motor 1003 is equal to or less than the threshold value d (S1705: NO), i.e., if a bolt is fastened, it is preferable that there is no necessity for the fastening by pressing, and striking is preferably carried out in a mode where the reaction force is most reduced. Accordingly, in this case, the voltage 5 for the second pulse mode is applied to the motor 1003 without via the first pulse mode and the voltages 1 to 4 for the second pulse mode (S1718).

As such, in the electronic pulse driver in the pulse mode according to the present embodiment, with an increase in an electric current (load) which flows into the motor 1003, the ratio of the reverse rotation period to the normal rotation period is increased (a decrease in the normal rotation period of the first pulse mode (S1706 of FIG. 27), shifting to the second pulse mode from the first pulse mode (S1707 of FIG. 27), and the shifting between the second pulse modes 1 to 5 (S1719 to S1722 of FIG. 27)). Thus, a reaction force from a member to be worked can be suppressed, and an impact tool which is comfortable when being used can be provided.

Additionally, in the electronic pulse driver 1001 in the pulse mode according to the present embodiment, the fastening is performed in the first pulse mode centered on a pressing force if an electric current which flows into the motor 1003 is equal to or less than the threshold value e when a wood screw is fastened. Thus, the fastening is performed in the second pulse mode centered on striking power if the electric current is greater than the threshold value e (S1707 of FIG. 27). Thus, it is possible to perform fastening in a mode which is more suitable for a wood screw.

Additionally, in the electronic pulse driver 1001 in the pulse mode according to the present embodiment, the reverse rotation voltage for fastener discrimination is applied to the motor 1003 (S1704 of FIG. 27). In that case, if an electric current which flows into the motor 1003 is greater than the threshold value d, the fastener is determined to be a wood screw, and if the electric current is less than the threshold value d, the fastener is determined to be a bolt. The processing proceeds to modes which are suitable for the respective cases (S1705 of FIG. 27). Thus, it is possible to perform suitable fastening according to the kind of fasteners.

Additionally, in the electronic pulse driver 1001 in the pulse mode according to the present embodiment, if the increasing rate of an electric current when an electric current which flows into the motor 1003 has increased to the threshold value e is equal to or more than the threshold value f (S1708: YES of FIG. 27), a wood screw is regarded as seated, and the voltage for seating is applied to the motor 1003 with the switching cycle of normal rotation electric power and reverse rotation electric power being shortened. Thereby, the subsequent reaction force from a member to be worked can be reduced, and simultaneously, the same feeling as a conventional electronic pulse driver in which a striking interval becomes short as fastening proceeds is provided.

Additionally, in the electronic pulse driver 1001 in the pulse mode according to the present embodiment, shifting to the optimal second pulse mode according to an electric current which flows into the motor 1003 from the first pulse mode is carried out (S1710 to S1713 of FIG. 27). Thus, even if the electric current which flows into the motor 1003 has abruptly increased, it is possible to perform fastening in a suitable striking mode.

Additionally, in the electronic pulse driver in the pulse mode according to the present embodiment, the shifting between the second pulse modes 1 to 5 is possible only between the second pulse modes where switching cycles of normal rotation and reverse rotation are adjacent to each other (S1719 to S1723 of FIG. 27). Thus, it is possible to prevent an abrupt change in feeling.

Additionally, in the electronic pulse driver 1001 in the present embodiment, the hammer 1042 is reversely rotated and struck on the anvil 1052 by applying the reverse rotation voltage for fitting to the motor 1003 before application of the reverse rotation voltage for fastening (S1601 of FIG. 26). Thus, even if the fitting between a fastener and a tip tool is insufficient, the fastener and the tip tool can be made to fit to each other firmly, and it is possible to prevent the tip tool from coming out of the fastener during operation.

Additionally, in the electronic pulse driver 1001 in the clutch mode according to the present embodiment, the hammer 1042 and the anvil 1052 are brought into contact with each other by applying the normal rotation voltage for prestart before the normal rotation voltage for fastening is applied (S1601 of FIG. 26, and S1701 of FIG. 27). Thus, it is possible to prevent a torque exceeding a target torque from being supplied to a fastener due to the striking.

Additionally, in the electronic pulse driver 1001 in the clutch mode according to the present embodiment, a pseudo-clutch is stopped after the elapse of a predetermined time from the generation thereof (S1609 and S1610 of FIG. 26). Thus, it is possible to suppress power consumption and a temperature rise.

Additionally, in the electronic pulse driver 1001 in the clutch mode according to the present embodiment, the reverse rotation voltage for braking is applied to the motor 1003 when a bolt is fastened, and a target torque is reached (S1607 of FIG. 26). Thus, even if a fastener like the bolt in which torque abruptly increases just before a target torque is fastened, it is possible to prevent the torque caused by an inertial force from being supplied, and it is possible to supply an accurate target torque.

Next, an electronic pulse driver 1201 according to a fourth embodiment will be described with reference to FIGS. 28 and 29.

In the third embodiment, the aspect of striking has been changed when an electric current or the like has been increased to a certain threshold value, without taking a change in temperature into consideration. However, for example, since the viscosity of the grease within the gear mechanism 1041 is low in cold districts, an electric current which flows into the motor 1003 tends to become greater than usual. In that case, an electric current which flows into the motor 1003 is apt to exceed the threshold value, and irrespective of a situation where the aspect of striking is changed, there is a possibility of changing the striking aspect.

Accordingly, the present embodiment is characterized by changing a threshold value in consideration of a change in temperature. Specifically, a temperature detection unit is provided on the switching board 1063, and the control unit 1072 changes each threshold value Based on a temperature detected by the temperature detection unit.

Figure 28:
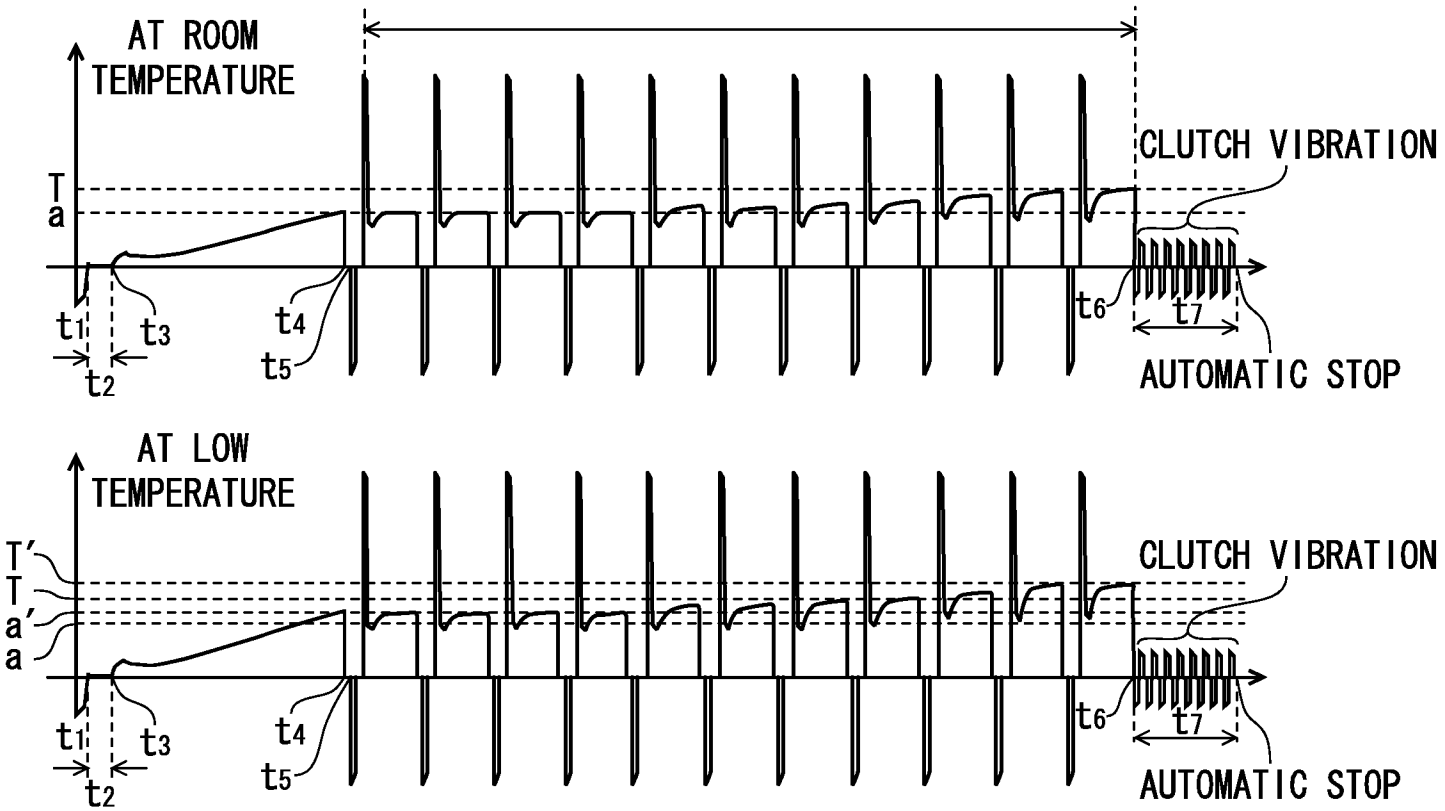
FIG. 28 illustrates a threshold value change during fastening of a wood screw in the clutch mode of an electronic pulse driver related to a fourth embodiment.
Figure 29:
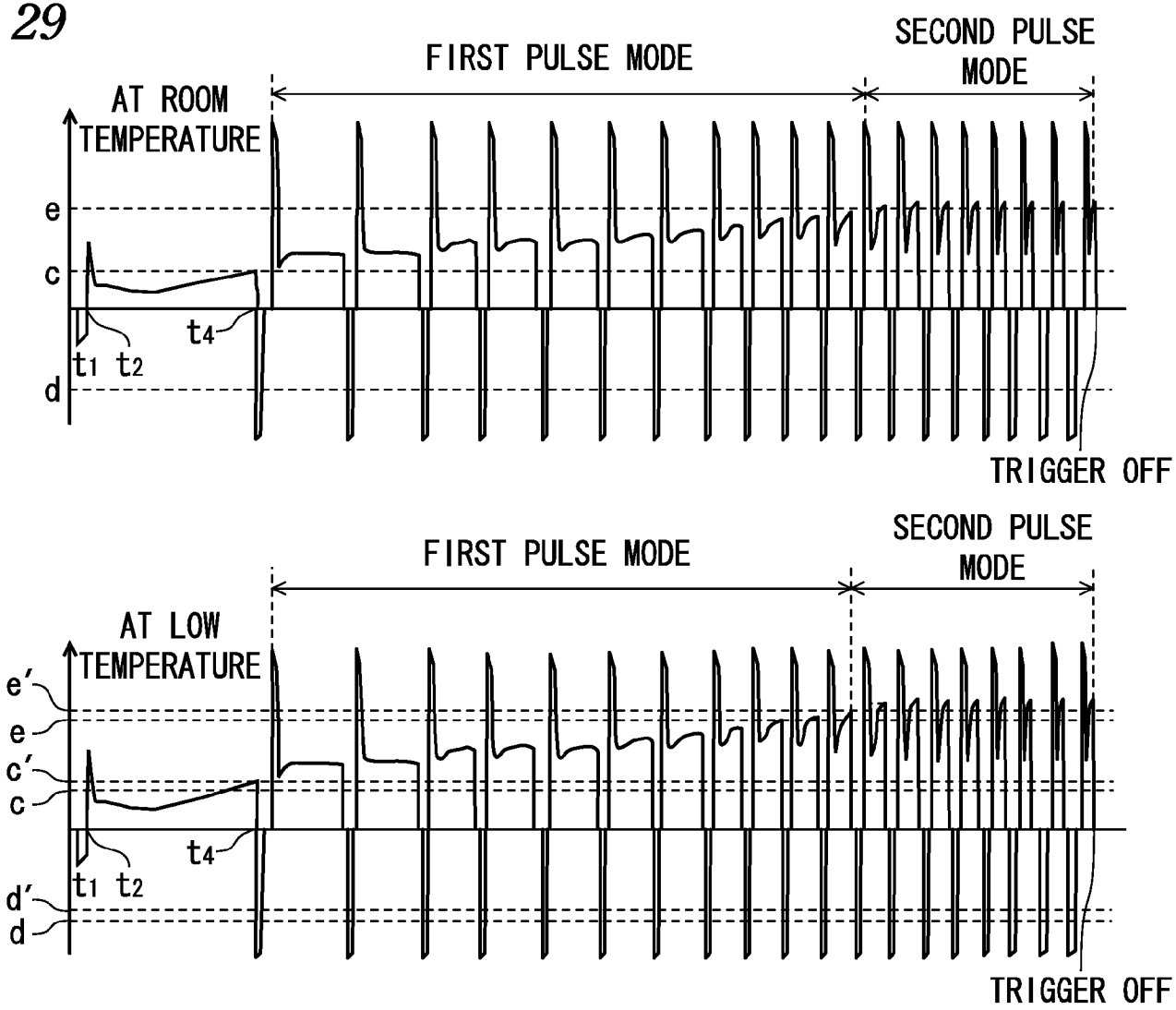
FIG. 29 illustrates a threshold value change during fastening of a wood screw in the pulse mode of the electronic pulse driver related to the fourth embodiment.

FIG. 28 illustrates a threshold value change during fastening of a wood screw in the clutch mode, and FIG. 29 illustrates a threshold value change during fastening of a wood screw in the pulse mode.

The control unit 1072, for example, as shown in FIG. 28, sets a threshold value a' and a target current value T' which trigger the application of a reverse rotation voltage for screw slackening at a low temperature to values which are higher than the threshold value a and the target current value T which trigger the application of a reverse rotation voltage for screw slackening at room temperature, and as shown in FIG. 29, sets a threshold value c' for shifting to the first pulse mode and a threshold value e' for shifting to the second pulse mode at a low temperature to values which are higher than the threshold value c for shifting to the first pulse mode and the threshold value e for shifting to the second pulse mode at room temperature.

By changing the threshold value in consideration of a change in temperature in this way, it is possible to change the aspect of striking in a suitable situation. In addition, the threshold value to be changed is not limited to the aforementioned one, and any other threshold values may be changed. Additionally, the temperature detection unit may be provided at locations other than the motor 1003.

Next, an electronic pulse driver 1301 according to a fifth embodiment will be described with reference to FIG. 14.

In the fourth embodiment, importance is given to workability, and the threshold value is changed. In the present embodiment, however, importance is given to the durability of the electronic pulse driver 1201, and the switching cycle of normal rotation and reverse rotation is changed.

Specifically, even in the present embodiment, similarly to the fourth embodiment, the motor 1003 is equipped with a temperature detection unit, and the control unit 1072 changes the switching cycle of normal rotation and reverse rotation Based on a temperature detected by the temperature detection unit. In addition, even in this case, the temperature detection unit may be provided at locations other than the motor 1003.

Figure 30:
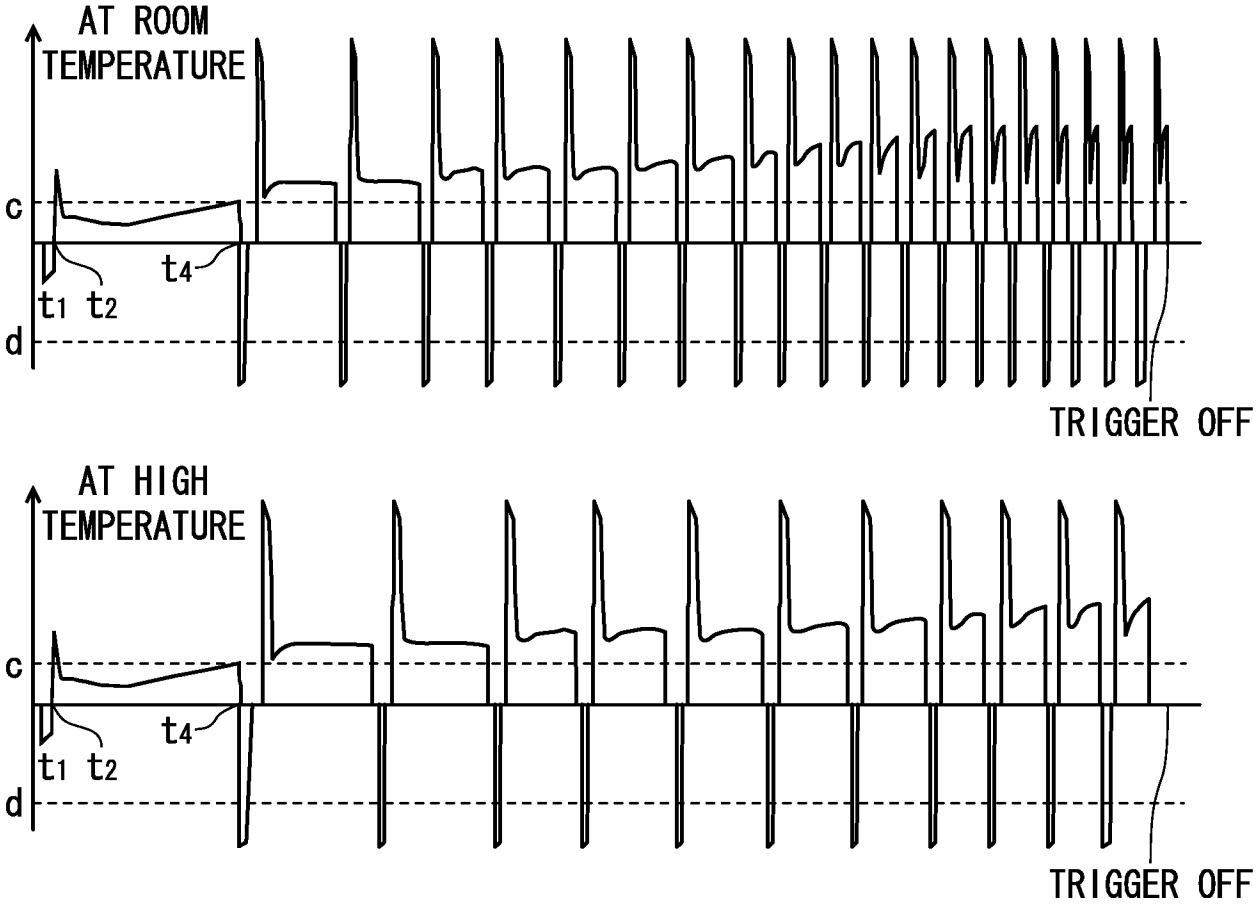
FIG. 30 illustrates a change in the switching cycle of normal rotation and reverse rotation during fastening of a wood screw in the pulse mode of the electronic pulse driver related to a fifth embodiment.

FIG. 30 illustrates a change in the switching cycle of normal rotation and reverse rotation during fastening of a wood screw in the pulse mode.

The control unit 1072, for example, as shown in FIG. 30, sets the switching cycle of the normal rotation period and reverse rotation period of the first pulse mode at a high temperature to be longer than the switching cycle of the normal rotation period and reverse rotation period of the first pulse mode at room temperature. This can suppress generation of heat caused at the time of switching, and can suppress any damage caused by the high temperature of FET of the electronic pulse driver 1301. Additionally, the coating of a starter coil can be kept from being damaged by heat, and it is possible to enhance the durability of the whole electronic pulse driver 1301.

Next, an electronic pulse driver 1401 according to a sixth embodiment will be described with reference to FIGS. 16 and 17. The same components as those of the electronic pulse driver 1001 according to the third embodiment are designated by the same reference numerals, and the description thereof is omitted.

Figure 32:
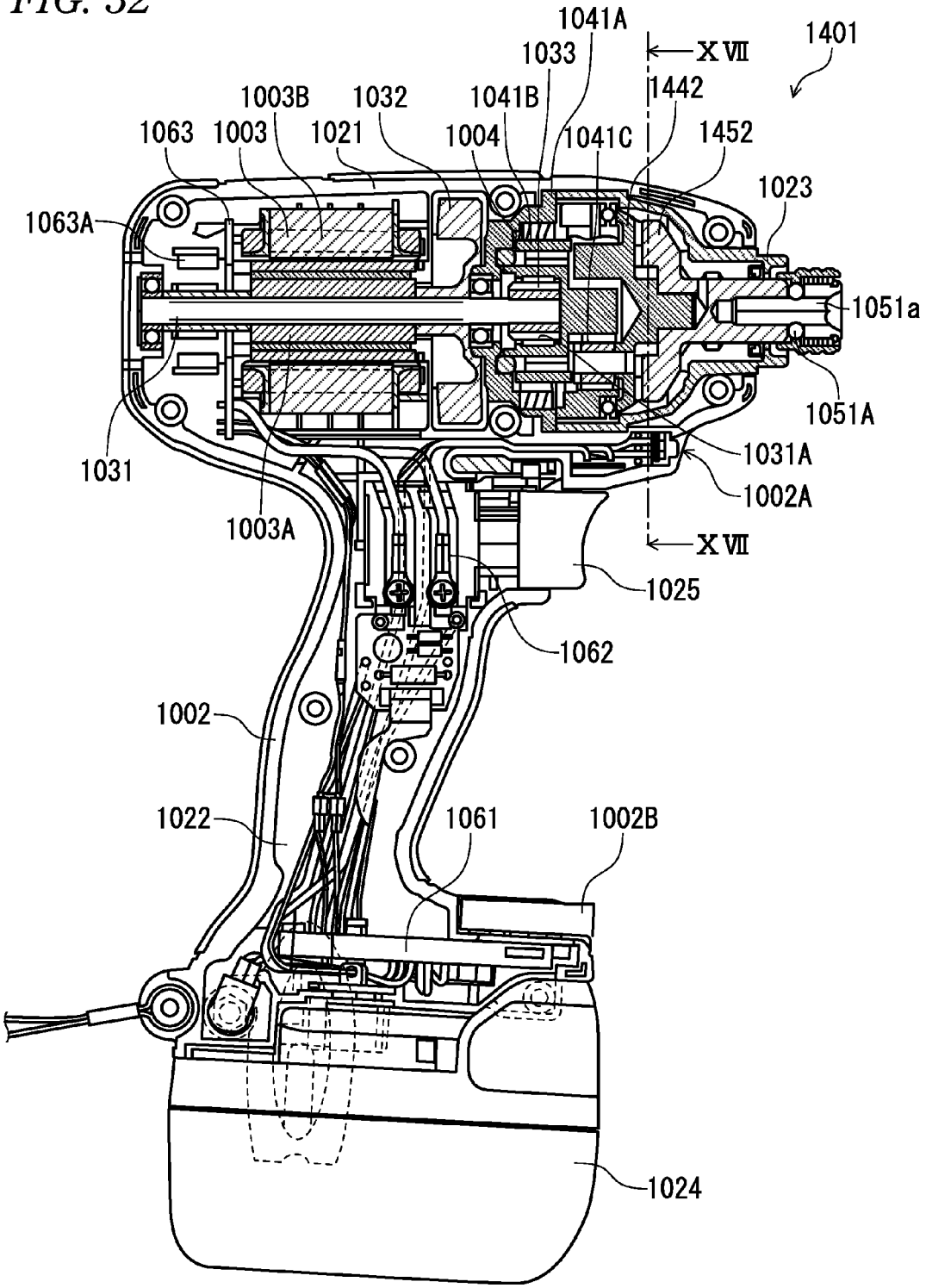
FIG. 32 is a sectional view of an electronic pulse driver related to a sixth embodiment.

As shown in FIG. 32, the electronic pulse driver 1401 includes a hammer 1442 and an anvil 1452. In the electronic pulse driver 1001 according to the third embodiment, the gap in a rotational direction between the hammer 1042 and the anvil 1052 is set to about 315 degrees. In the electronic pulse driver 1401 according to the sixth embodiment, the gap in a rotational direction between the hammer 1442 and the anvil 1452 is set to about 135 degrees.

Figure 33:
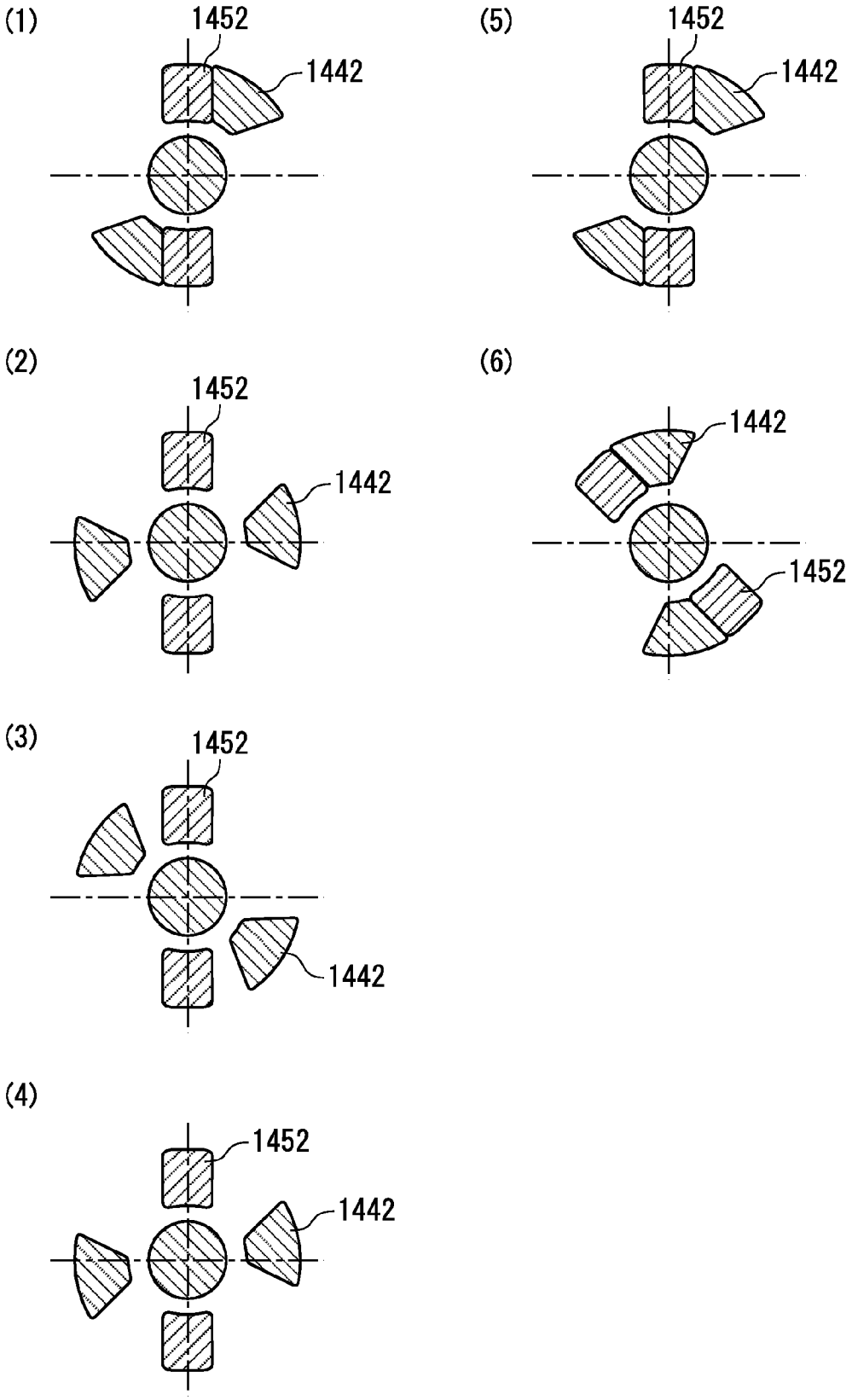
FIG. 33 illustrates the operating state of a hammer and an anvil of the electronic pulse driver related to the sixth embodiment.

FIG. 33 is a sectional view seen from the direction XVII of FIG. 32, and illustrates the positional relationship between the hammer 1442 and the anvil 1452 during the operation of the electronic pulse driver 1401. Reverse rotation is carried out to the maximum reversal position of the hammer 1442 with respect to the anvil 1452 in FIG. 33(3) via the state of FIG. 33(2) from a state where the hammer 1442 and the anvil 1452 come into contact with each other like FIG. 33(1). Then, the motor 1003 normally rotates, the hammer 1442 and the anvil 1452 collide with each other (FIG. 33(5)), and the anvil 1452 rotates in the counterclockwise direction of FIG. 33 by the impact (FIG. 33(6)).

In this case, the voltage value, current value, number-of-seconds, etc. of the third embodiment can be appropriately changed so as to suit the electronic pulse driver 1401 in the sixth embodiment.

In addition, the electronic pulse driver of the invention is not limited to the above-described embodiments, and various modifications and improvements can be made within the scope set forth in the claims.

Figure 31:
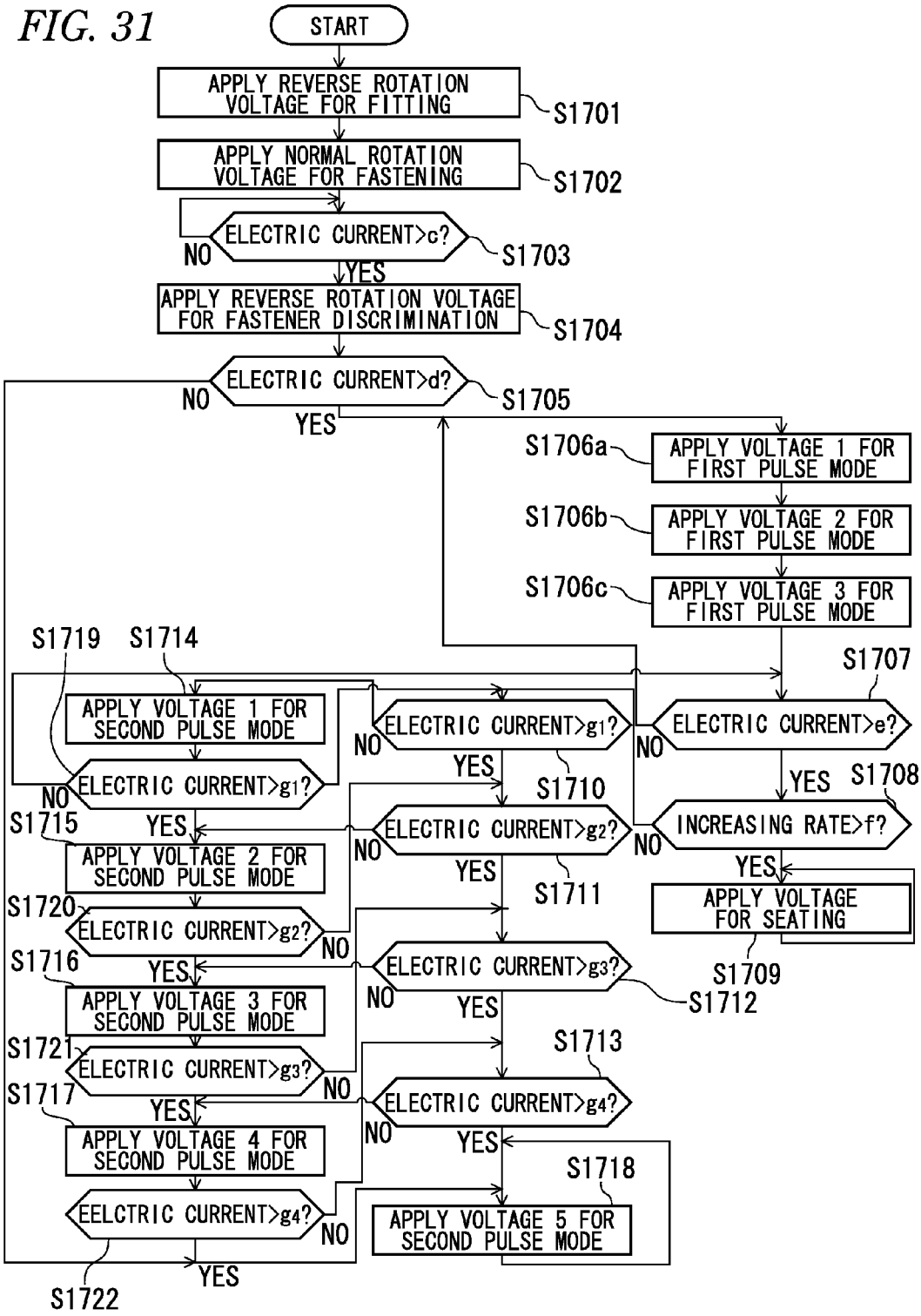
FIG. 31 is a flow chart showing a modification of the electronic pulse driver related to the embodiment.
Figure 34:
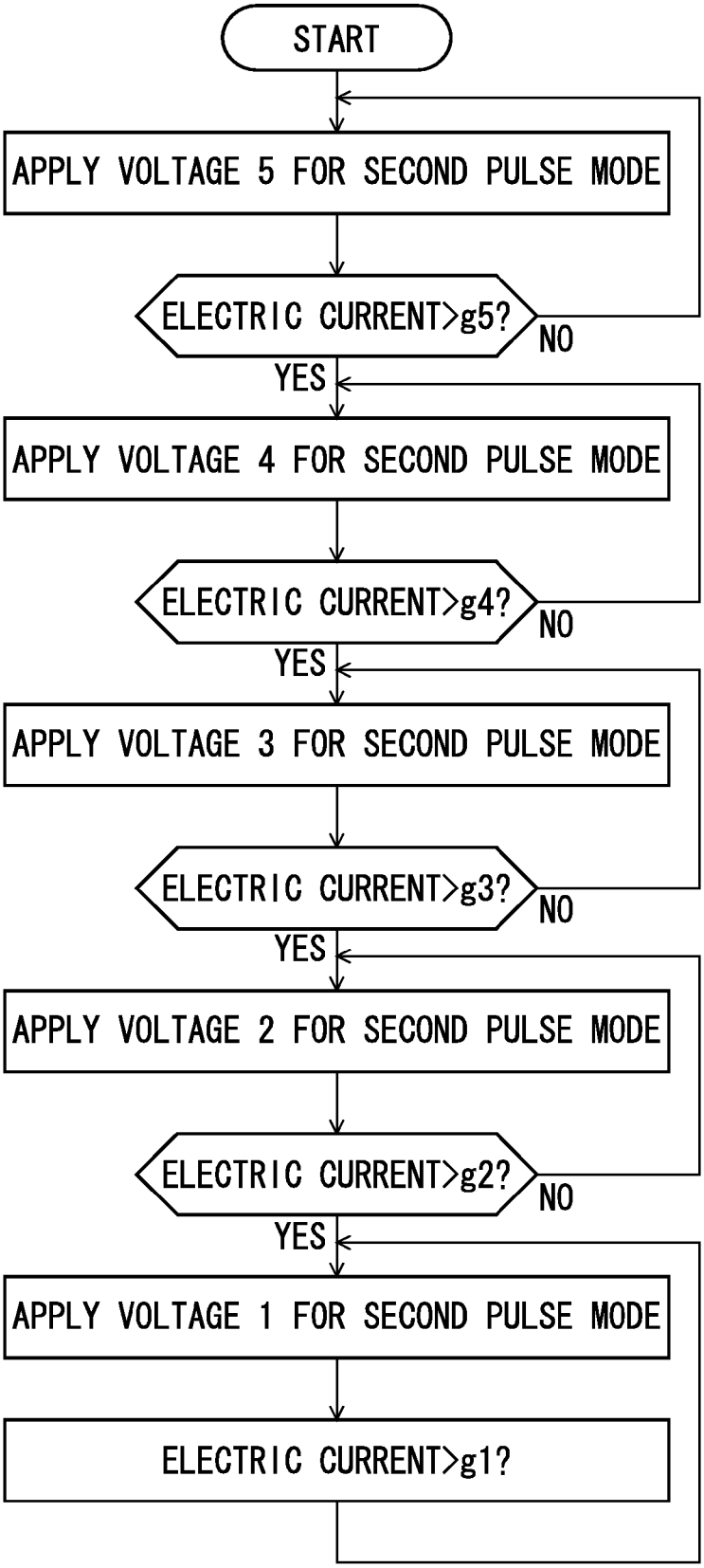
FIG. 34 is a schematic diagram when a wood screw is loosened in the pulse mode of the electronic pulse driver related to the sixth embodiment.

For example, in the above-described embodiments, in the shifting between the second pulse modes 1 to 5, even a case where the processing returns to a voltage for the second pulse mode one place before a voltage (S1719 to S1722: NO of FIG. 26) is considered. However, as shown in FIG. 31, a worker feels comfortable as a result of performing a control so as not to return to a previous voltage for the second pulse mode. Additionally, although the control when a wood screw or a bolt is fastened has been described in the above-described embodiments, the idea of the invention can be utilized even during loosening (removal). Specifically, as shown in the schematic diagram of FIG. 34, when a wood screw or the like is loosened, application of a voltage is started from the voltage 5 for the second pulse mode with a longest reverse rotation period, and as an electric current becomes equal to or less than each threshold value, a gradual change to the voltage 1 for the second pulse mode is made. Thereby, even when a wood screw or the like is made, it is possible to provide a comfortable feeling.

Additionally, in the above-described embodiments, a fastener is discriminated Based on an electric current which flows into the motor 1003 after application of the reverse rotation voltage for fastener discrimination (S1705 of FIG. 27). However, the fastener may be discriminated Based on the rotation number or the like of the motor 1003.

Additionally, in the above-described embodiments, the same threshold values $g_1$ to $g_4$ as S1710 to S1713 are used in S1719 to S1722 of FIG. 27. However, separate values may be used.

Additionally, in the above-described embodiments, there is only one anvil 1052 provided in the electronic pulse driver. Thus, there is a possibility that the anvil 1052 and the hammer 1042 are separated from each other by the maximum 360 degrees. However, for example, another anvil may be provided between the anvil and the hammer. Thereby, it is possible to shorten the time required when the reverse rotation voltage for fitting is applied (S1601 of FIGS. 26, and S1701 of FIG. 27) or when the normal rotation voltage for pre-start is applied (S1602 of FIG. 26).

Additionally, in the above-described embodiments, the hammer 1042 and the anvil 1052 are brought into contact with each other by applying the normal rotation voltage for pre-start. However, other aspects are conceivable as long as the initial position relationship of the hammer 1042 with respect to the anvil 1052 can be kept constant even if the hammer and the anvil are not necessarily brought into contact with each other.

Additionally, although the power tool of the invention is constructed so that the hammer is normally rotated or reversely rotated, the electric power need not have such a construction. For example, a power tool which strikes the anvil by continuously driving the hammer so as to be normally rotated may be adopted. Although the power tool of the invention has a construction in which the hammer is driven by an electric motor driven by a charging battery, the hammer may be driven by power sources other than the electric motor. For example, as examples of the power sources, an engine may be used, or an electric motor may be driven by a fuel cell or a solar cell.

INDUSTRIAL APPLICABILITY

According to an aspect of the invention, there is provided an impact tool in which an impact mechanism is realized by a hammer and an anvil with a simple mechanism.

According to another aspect of the invention, there is provided an impact tool which can drive a hammer and an anvil between which the relative rotation angle is less than 360 degrees, thereby performing a fastening operation, by devising a driving method of a motor.

The invention claimed is:

1. A power tool comprising:

a motor capable of normally rotating and reversely rotating;

a hammer rotated in a normal rotation direction or a reverse rotation direction by a driving force being supplied thereto from the motor;

an anvil struck and rotated by the rotation of the hammer, a tip tool holding portion capable of holding a tip tool and transmitting the rotation of the anvil to the tip tool;

an electric power supply unit which alternately switches between normal rotation electric power or reverse rotation electric power so as to be supplied to the motor; and a control unit which controls the electric power supply unit so as to increase the ratio of a period during which the reverse rotation electric power is supplied with respect to a period during which the normal rotation electric power is supplied, with an increase in an electric current which flows into the motor.

2. The power tool of claim 1, wherein the control unit controls the electric power supply unit in a first mode in which the normal rotation period during which the normal rotation electric power is supplied is reduced, in a first step where the electric current which flows into the motor increases to a predetermined value, and controls the electric power supply unit in a second mode in which the reverse rotation period during which the reverse rotation electric power is supplied is increased, in a second step where the electric current which flows into the motor has exceeded the predetermined value.

3. The power tool of claim 2, wherein the control unit is capable of selecting one mode from a plurality of second modes with different ratios, in the second step.

4. The power tool of claim 2, wherein the control unit permits only shifting to a second mode with a long reverse rotation period from a second mode with a short reverse rotation period, among a plurality of second modes with different ratios, in the second step.

5. The power tool of claim 2, wherein the control unit permits only shifting to a second mode which is adjacent in the length of the reverse rotation period, among a plurality of second modes with different ratios, in the second step.

* * * * *